US011100860B2

(12) United States Patent
Toyoda et al.

(10) Patent No.: US 11,100,860 B2
(45) Date of Patent: Aug. 24, 2021

(54) DISPLAY DEVICE, DISPLAY DEVICE DRIVING METHOD, DISPLAY ELEMENT, AND ELECTRONIC APPARATUS

(71) Applicant: SONY CORPORATION, Tokyo (JP)

(72) Inventors: Takashi Toyoda, Kanagawa (JP); Seiichiro Jinta, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/778,146

(22) Filed: Jan. 31, 2020

(65) Prior Publication Data

US 2020/0168152 A1 May 28, 2020

Related U.S. Application Data

(63) Continuation of application No. 15/768,134, filed as application No. PCT/JP2016/073930 on Aug. 16, 2016, now Pat. No. 10,586,489.

(30) Foreign Application Priority Data

Oct. 27, 2015 (JP) ..... 2015-210650

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0819* (2013.01);
(Continued)

(58) Field of Classification Search
CPC ..... G09G 3/3233; G09G 2300/0876; G09G 2300/0819; G09G 2310/0251;
(Continued)

(56) References Cited

U.S. PATENT DOCUMENTS

2008/0158114 A1 7/2008 Kim
2012/0169799 A1* 7/2012 Ono ..... G09G 3/325 345/690
2016/0117989 A1 4/2016 Kumeta et al.

FOREIGN PATENT DOCUMENTS

JP 2006-516745 A 7/2006
JP 2008-165166 A 7/2008
(Continued)

OTHER PUBLICATIONS

Non-Final Office Action for U.S. Appl. No. 15/768,134, dated May 9, 2019, 19 pages.
(Continued)

*Primary Examiner* — Charles V Hicks
(74) *Attorney, Agent, or Firm* — Chip Law Group

(57) ABSTRACT

The display element includes a current-driven light-emitting unit, a capacitor unit including a first capacitor and a second capacitor, an n-channel driving transistor that causes a current corresponding to a voltage held by the capacitor unit to flow through the light-emitting unit and a first switching transistor that writes a video signal voltage to the capacitor unit. In a state in which the first capacitor holds a voltage corresponding to a threshold voltage of the driving transistor, a video signal voltage is written to the second capacitor through the first switching transistor in a conducting state.

10 Claims, 53 Drawing Sheets

(52) U.S. Cl.
CPC ..... *G09G 2300/0876* (2013.01); *G09G 2310/0251* (2013.01); *G09G 2310/06* (2013.01); *G09G 2320/0233* (2013.01); *G09G 2330/021* (2013.01)

(58) Field of Classification Search
CPC ..... G09G 2310/06; G09G 3/3291; G09G 2320/0233; G09G 2330/021
See application file for complete search history.

(56) References Cited

FOREIGN PATENT DOCUMENTS

| | | | |
|---|---|---|---|
| JP | 2005-542845 | A | 11/2008 |
| JP | 2008-287139 | A | 11/2008 |
| JP | 2009-134110 | A | 6/2009 |
| JP | 2010-113101 | A | 5/2010 |
| JP | 2016-085296 | A | 5/2016 |
| WO | 2004/066249 | A1 | 8/2004 |
| WO | 2006/130981 | A1 | 12/2006 |

OTHER PUBLICATIONS

Notice of Allowance for U.S. Appl. No. 15/768,134, dated Oct. 30, 2019, 08 pages.
International Search Report and Written Opinion of PCT Application No. PCT/JP2016/073930, dated Nov. 15, 2016, 09 pages of English Translation and 07 pages of ISRWO.
International Preliminary Report on Patentability of PCT Application No. PCMP2016/073930, dated May 11, 2018, 09 pages of English Translation and 04 pages of IPRP.
Office Action for CN Patent Application No. 201680062375.8, dated Aug. 4, 2020, 9 pages of Office Action and 13 pages of English Translation.

* cited by examiner

[ BEFORE $H'_{m-4}$ ]

[ $H'_{m-3}$ ]

[ $H'_{m-2}$ ]

[ $H'_{m-2}$ ] (CONTINUED)

[ $H'_{m-1}$ ]

[ $H_m$ ]

[ $H_{m+1}$ ]

[ $H_{m-1}$ ]

[ $H''_m$ ]

[ $H''_{m+1}$ ]

[ BEFORE $H'_{m-4}$ ]

[ $H'_{m-3}$ ]

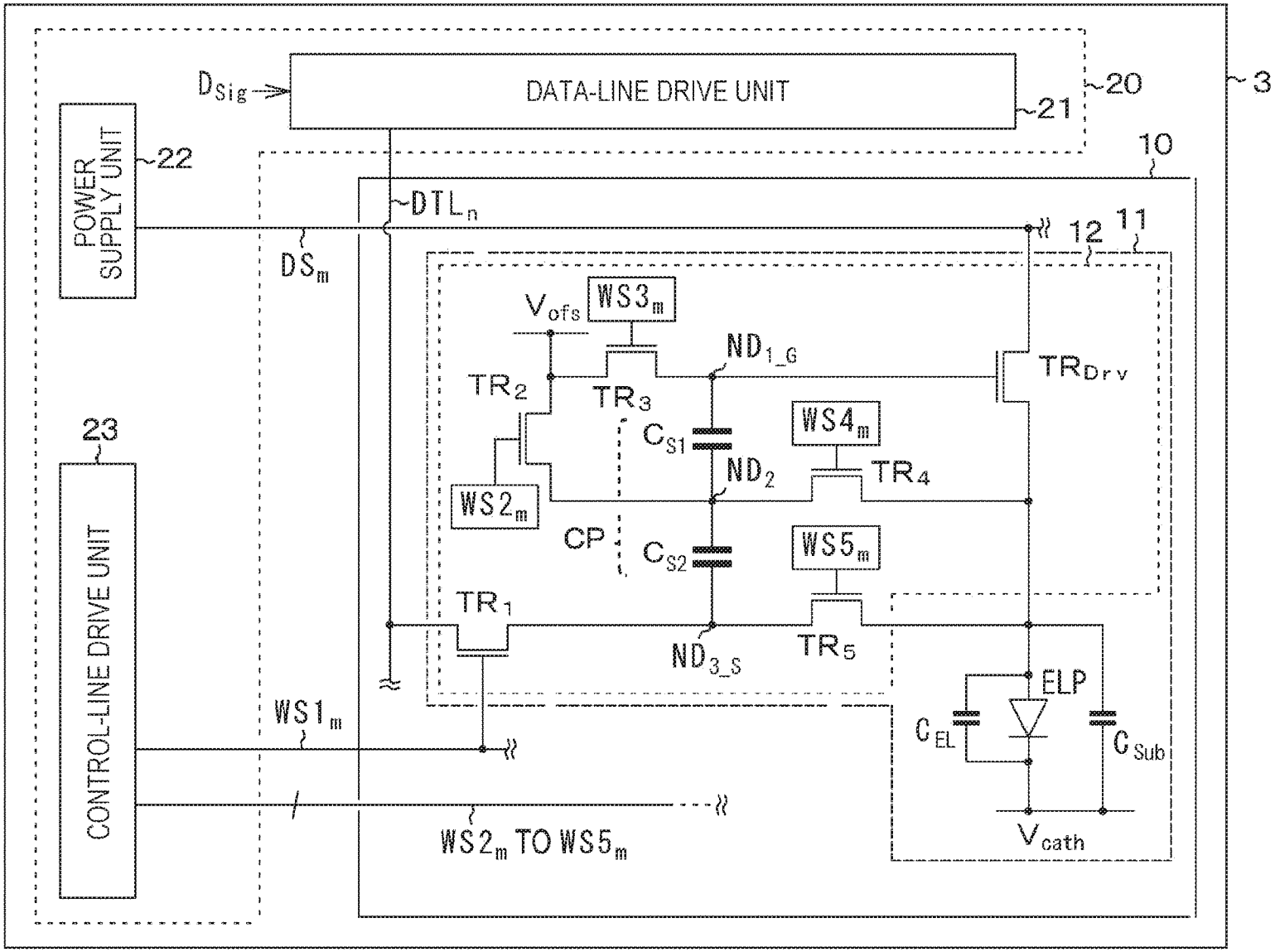
FIG. 11
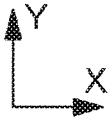

Y X

[ $H'_{m-2}$ ]

[ $H'_{m-2}$ ] (CONTINUED)

X

Y

DISPLAY DEVICE, DISPLAY DEVICE DRIVING METHOD, DISPLAY ELEMENT, AND ELECTRONIC APPARATUS

CROSS-REFERENCE TO RELATED APPLICATIONS

The present application is a continuation application of U.S. patent application Ser. No. 15/768,134, filed Apr. 13, 2018, which is a national stage entry of PCT/JP2016/073930, filed Aug. 16, 2016, which claims priority from prior Japanese Priority Patent Application JP 2015-210650 filed in the Japan Patent Office on Oct. 27, 2015, the entire contents of which are hereby incorporated by reference.

TECHNICAL FIELD

The present disclosure relates to a display device, a display device driving method, a display element, and an electronic apparatus.

BACKGROUND ART

A display element provided with a current-driven light-emitting unit, and a display device provided with the display element, are well known. For example, a display element provided with a light-emitting unit that uses electroluminescence of an organic material (hereinafter, may be merely referred to as "organic EL display element") attracts attention as a display element that is capable of high-luminance light emission by low-voltage DC driving.

As with liquid crystal display devices, in the field of, for example, display devices, each of which is provided with an organic EL display element, as well, a simple matrix method and an active matrix method are well known as driving methods. The active matrix method has a disadvantage that a structure becomes complicated. However, the active matrix method has, for example, an advantage that the brightness of an image can be made high. An organic EL display element driven by the active matrix method is provided with not only a light-emitting unit that includes an organic layer including a light-emitting layer and the like, but also a driving circuit having a driving transistor for driving the light-emitting unit.

A value of a current flowing through the driving transistor is influenced not only by a voltage of a gate electrode with respect to a source region of the driving transistor (so-called a voltage between the gate and the source) but also by a threshold voltage of the driving transistor. The threshold voltage of the driving transistor disperses on a display element basis, and therefore causes uneven brightness. For example, Japanese Patent Application Laid-Open No. 2008-287139 (Patent Document 1) discloses the feature of performing the operation of canceling an influence, which is exerted by the dispersion in threshold voltage of a driving transistor, every time a video signal is written to a display element.

CITATION LIST

Patent Document

Patent Document 1: Japanese Patent Application Laid-Open No. 2008-287139

SUMMARY OF THE INVENTION

Problems to be Solved by the Invention

The operation of canceling the influence, which is exerted by the dispersion in threshold voltage of a driving transistor, every time a video signal is written becomes a factor for increasing the power consumption of a display device. In general, the power consumption of an electronic apparatus is desired to be low. Accordingly, a reduction in power consumption of a display device is also expected.

Therefore, an object of the present invention is to provide: a display device that is capable of further reducing the power consumption while canceling an influence exerted by the dispersion in threshold voltage of a driving transistor; a method for driving the display device; a display element; and an electronic apparatus.

Solutions to Problems

In order to achieve the above-described object, a display device according to the present disclosure includes: a display unit in which display elements are arranged; and a drive unit for driving the display unit, in which:

the display elements each include: a current-driven light-emitting unit; a capacitor unit including a first capacitor and a second capacitor; an n-channel driving transistor that causes a current corresponding to a voltage held by the capacitor unit to flow through the light-emitting unit; and a first switching transistor that writes a video signal voltage to the capacitor unit;

in the capacitor unit, one end of the first capacitor is connected to a gate electrode of the driving transistor to form a first node, the other end of the first capacitor is connected to one end of the second capacitor to form a second node, and the other end of the second capacitor is connected to one end of the light-emitting unit, and to the other source/drain region of the driving transistor to form a third node;

in the driving transistor, one source/drain region is connected to an electric supply line, and the other source/drain region is connected to the light-emitting unit;

in the first switching transistor, one source/drain region is connected to a data line, and the other source/drain region is connected to the third node; and in a state in which the first capacitor holds a voltage corresponding to a threshold voltage of the driving transistor, the drive unit writes a video signal voltage to the second capacitor through the first switching transistor in a conducting state.

In order to achieve the above-described object, there is provided a method for driving a display device according to the present disclosure, the display device including: a display unit in which display elements are arranged; and a drive unit for driving the display unit, in which:

the display elements each include: a current-driven light-emitting unit; a capacitor unit including a first capacitor and a second capacitor; an n-channel driving transistor that causes a current corresponding to a voltage held by the capacitor unit to flow through the light-emitting unit; and a first switching transistor that writes a video signal voltage to the capacitor unit;

in the capacitor unit, one end of the first capacitor is connected to a gate electrode of the driving transistor to form a first node, the other end of the first capacitor is connected to one end of the second capacitor to form a second node, and the other end of the second capacitor is connected to one end of the light-emitting unit, and to the other source/drain region of the driving transistor to form a third node;

in the driving transistor, one source/drain region is connected to an electric supply line, and the other source/drain region is connected to the light-emitting unit;

in the first switching transistor, one source/drain region is connected to a data line, and the other source/drain region is connected to the third node; and in a state in which the first capacitor holds a voltage corresponding to a threshold voltage of the driving transistor, the drive unit writes a video signal voltage to the second capacitor through the first switching transistor in a conducting state.

In order to achieve the above-described object, a display element according to the present disclosure includes:

a current-driven light-emitting unit; a capacitor unit including a first capacitor and a second capacitor; an n-channel driving transistor that causes a current corresponding to a voltage held by the capacitor unit to flow through the light-emitting unit; and a first switching transistor that writes a video signal voltage to the capacitor unit; in which:

in the capacitor unit, one end of the first capacitor is connected to a gate electrode of the driving transistor to form a first node, the other end of the first capacitor is connected to one end of the second capacitor to form a second node, and the other end of the second capacitor is connected to one end of the light-emitting unit, and to the other source/drain region of the driving transistor to form a third node;

in the driving transistor, one source/drain region is connected to an electric supply line, and the other source/drain region is connected to the light-emitting unit;

in the first switching transistor, one source/drain region is connected to a data line, and the other source/drain region is connected to the third node; and in a state in which the first capacitor holds a voltage corresponding to a threshold voltage of the driving transistor, a video signal voltage is written to the second capacitor through the first switching transistor in a conducting state.

In order to achieve the above-described object, an electronic apparatus according to the present disclosure includes a display device, in which:

the display device includes: a display unit in which display elements are arranged; and a drive unit for driving the display unit;

the display elements each include: a current-driven light-emitting unit; a capacitor unit including a first capacitor and a second capacitor; an n-channel driving transistor that causes a current corresponding to a voltage held by the capacitor unit to flow through the light-emitting unit; and a first switching transistor that writes a video signal voltage to the capacitor unit;

in the capacitor unit, one end of the first capacitor is connected to a gate electrode of the driving transistor to form a first node, the other end of the first capacitor is connected to one end of the second capacitor to form a second node, and the other end of the second capacitor is connected to one end of the light-emitting unit, and to the other source/drain region of the driving transistor to form a third node;

in the driving transistor, one source/drain region is connected to an electric supply line, and the other source/drain region is connected to the light-emitting unit;

in the first switching transistor, one source/drain region is connected to a data line, and the other source/drain region is connected to the third node; and in a state in which the first capacitor holds a voltage corresponding to a threshold voltage of the driving transistor, the drive unit writes a video signal voltage to the second capacitor through the first switching transistor in a conducting state.

Effects of the Invention

In the display device, the display device driving method, the display element, and the electronic apparatus according to the present disclosure, in a state in which the first capacitor holds a voltage corresponding to a threshold voltage of the driving transistor, a video signal voltage is written to the second capacitor through the first switching transistor in a conducting state. This enables a frequency of operations of holding, in the first capacitor, a voltage corresponding to a threshold voltage of the driving transistor to be reduced. Therefore, the power consumption can be further reduced while canceling an influence exerted by the dispersion in threshold voltage of the driving transistor. It should be noted that the effects described herein are not necessarily limited, and may be any one of the effects described in the present disclosure.

BRIEF DESCRIPTION OF DRAWINGS

Following FIGS. 4B, 5A, and 5B are drawings each schematically illustrating conducting state/non-conducting state and the like of each transistor that is included in the driving circuit of the display element of the display device according to the first embodiment.

Following FIGS. 5B, 6A, and 6B are drawings each schematically illustrating conducting state/non-conducting state and the like of each transistor that is included in the driving circuit of the display element of the display device according to the first embodiment.

Following FIGS. 6B, 7A, and 7B are drawings each schematically illustrating conducting state/non-conducting state and the like of each transistor that is included in the driving circuit of the display element of the display device according to the first embodiment.

Following FIGS. 7B, 8A, and 8B are drawings each schematically illustrating conducting state/non-conducting state and the like of each transistor that is included in the driving circuit of the display element of the display device according to the first embodiment.

FIG. 11 is a conceptual diagram illustrating a display device according to a third embodiment.

Following FIGS. 13B, 14A, and 14B are drawings each schematically illustrating conducting state/non-conducting state and the like of each transistor that is included in the driving circuit of the display element of the display device according to the third embodiment.

Following FIGS. 14B, 15A, and 15B are drawings each schematically illustrating conducting state/non-conducting state and the like of each transistor that is included in the driving circuit of the display element of the display device according to the third embodiment.

Following FIGS. 15B, 16A, and 16B are drawings each schematically illustrating conducting state/non-conducting state and the like of each transistor that is included in the driving circuit of the display element of the display device according to the third embodiment.

Following FIGS. 16B, 17A, and 17B are drawings each schematically illustrating conducting state/non-conducting state and the like of each transistor that is included in the driving circuit of the display element of the display device according to the third embodiment.

Following FIGS. 20B, 21A, and 21B are drawings each schematically illustrating conducting state/non-conducting state and the like of each transistor that is included in the driving circuit of the display element of the display device according to the fourth embodiment.

Following FIGS. 21B, 22A, and 22B are drawings each schematically illustrating conducting state/non-conducting state and the like of each transistor that is included in the driving circuit of the display element of the display device according to the fourth embodiment.

Following FIGS. 22B, 23A, and 23B are drawings each schematically illustrating conducting state/non-conducting state and the like of each transistor that is included in the driving circuit of the display element of the display device according to the fourth embodiment.

Following FIGS. 23B, 24A, and 24B are drawings each schematically illustrating conducting state/non-conducting state and the like of each transistor that is included in the driving circuit of the display element of the display device according to the fourth embodiment.

Following FIGS. 27B, 28A, and 28B are drawings each schematically illustrating conducting state/non-conducting state and the like of each transistor that is included in the driving circuit of the display element of the display device according to the fifth embodiment.

Following FIGS. 28B, 29A, and 29B are drawings each schematically illustrating conducting state/non-conducting state and the like of each transistor that is included in the driving circuit of the display element of the display device according to the fifth embodiment.

Following FIGS. 29B, 30A, and 30B are drawings each schematically illustrating conducting state/non-conducting state and the like of each transistor that is included in the driving circuit of the display element of the display device according to the fifth embodiment.

Following FIGS. 30B, 31A, and 31B are drawings each schematically illustrating conducting state/non-conducting state and the like of each transistor that is included in the driving circuit of the display element of the display device according to the fifth embodiment.

Following FIGS. 36B, 37A, and 37B are drawings each schematically illustrating conducting state/non-conducting state and the like of each transistor that is included in the driving circuit of the display element of the display device according to the seventh embodiment.

Following FIGS. 37B, 38A, and 38B are drawings each schematically illustrating conducting state/non-conducting state and the like of each transistor that is included in the driving circuit of the display element of the display device according to the seventh embodiment.

Following FIGS. 38B, 39A, and 39B are drawings each schematically illustrating conducting state/non-conducting state and the like of each transistor that is included in the driving circuit of the display element of the display device according to the seventh embodiment.

Figure 39A:
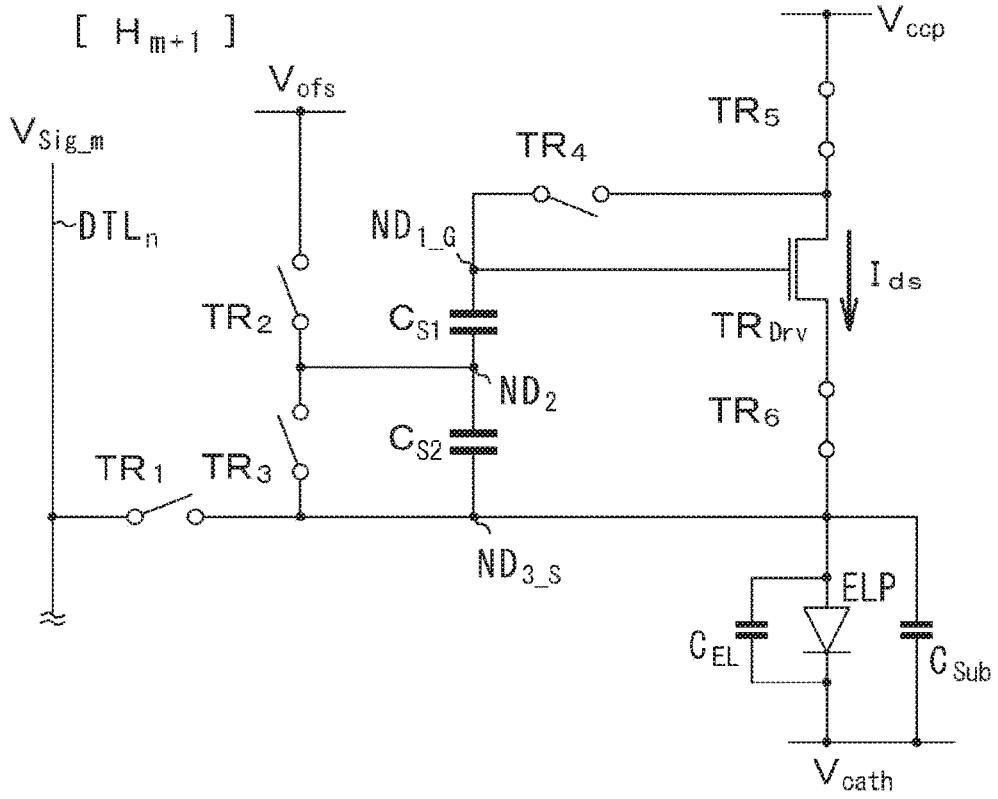
Figure 39B:
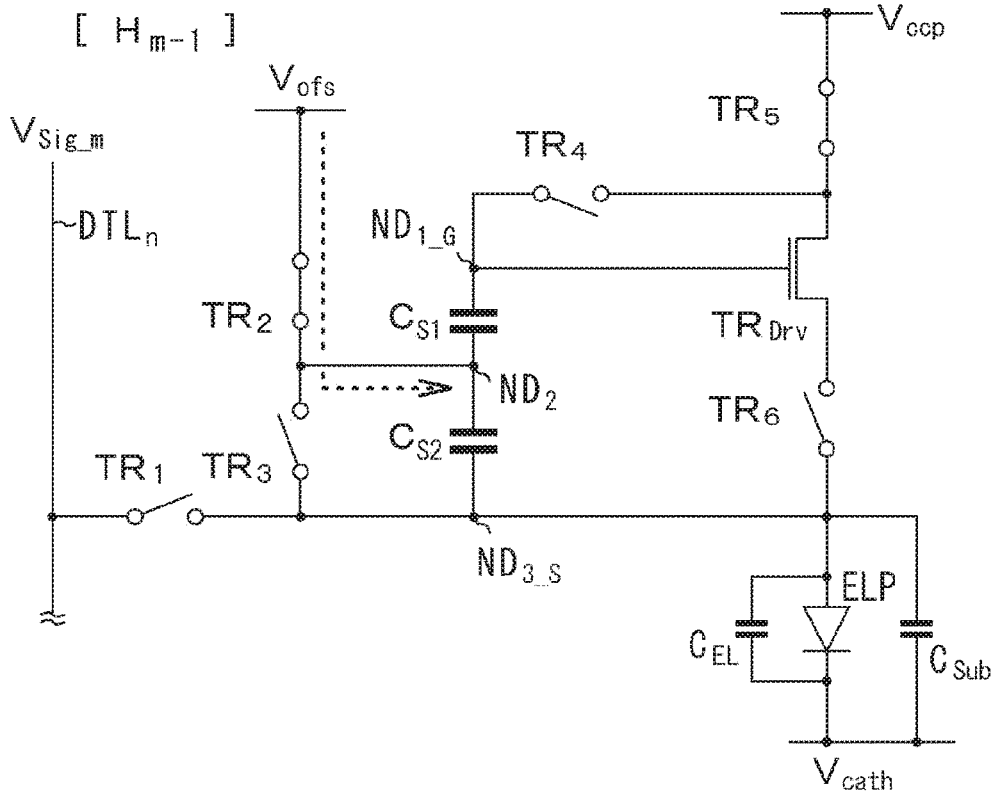
Figure 40A:
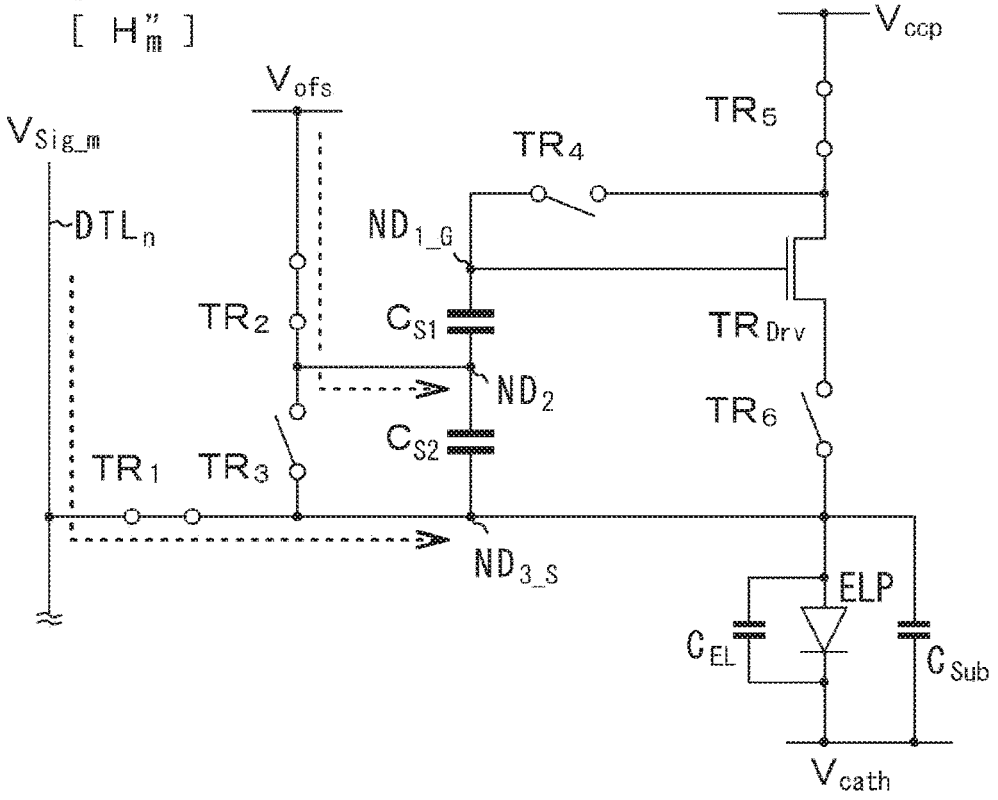
Figure 40B:
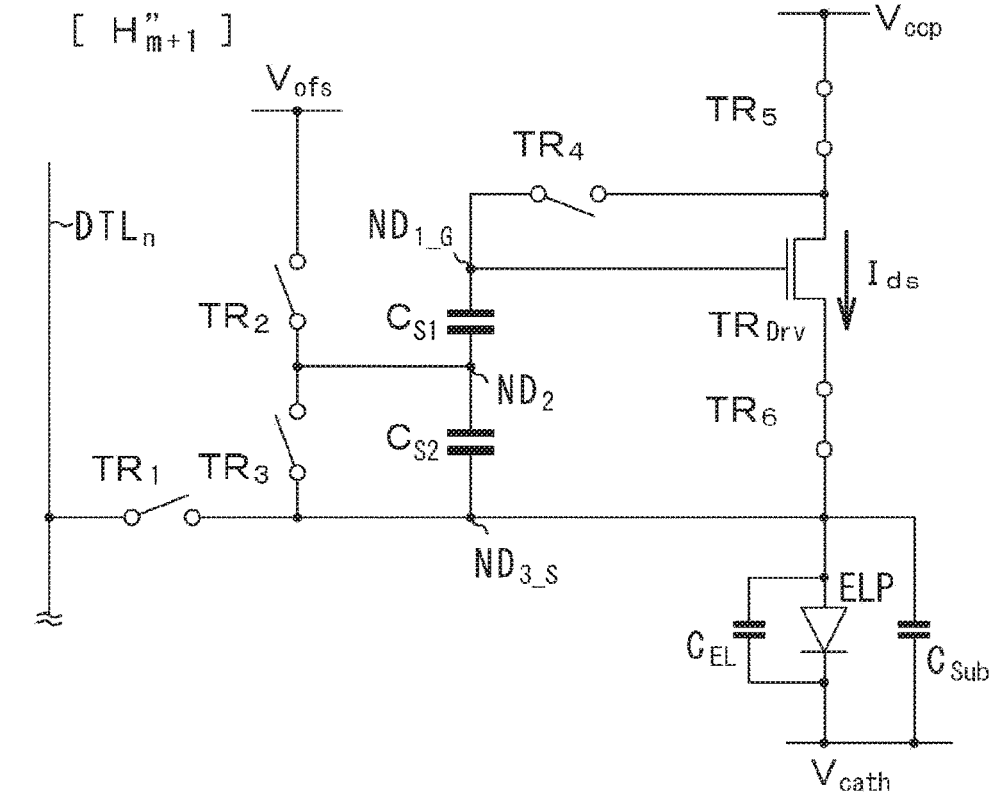

Following FIGS. 39B, 40A, and, 40B are drawings each schematically illustrating conducting state/non-conducting state and the like of each transistor that is included in the driving circuit of the display element of the display device according to the seventh embodiment.

Figure 41:
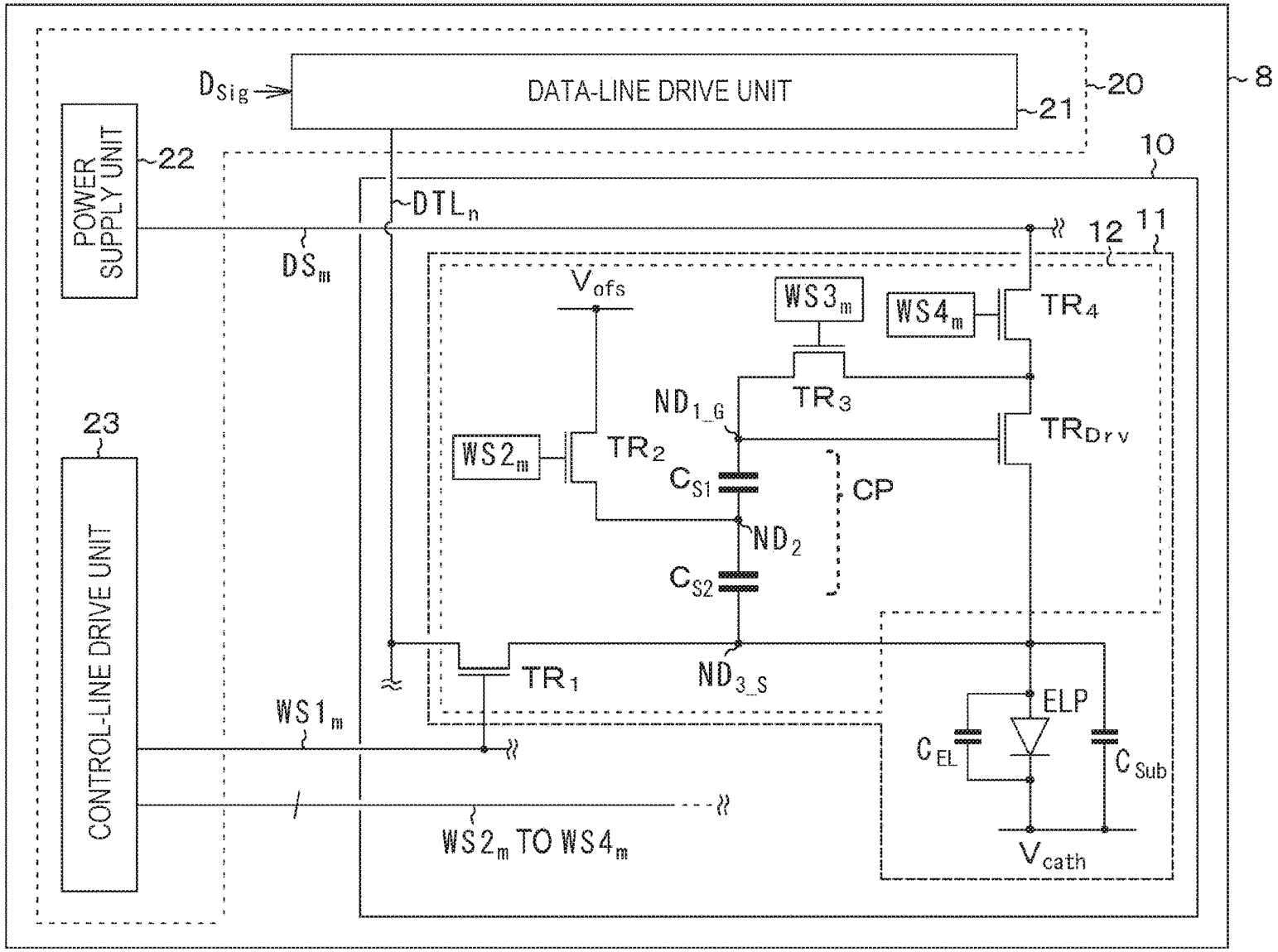

FIG. 41 is a conceptual diagram illustrating a display device according to an eighth embodiment.

Figure 42:
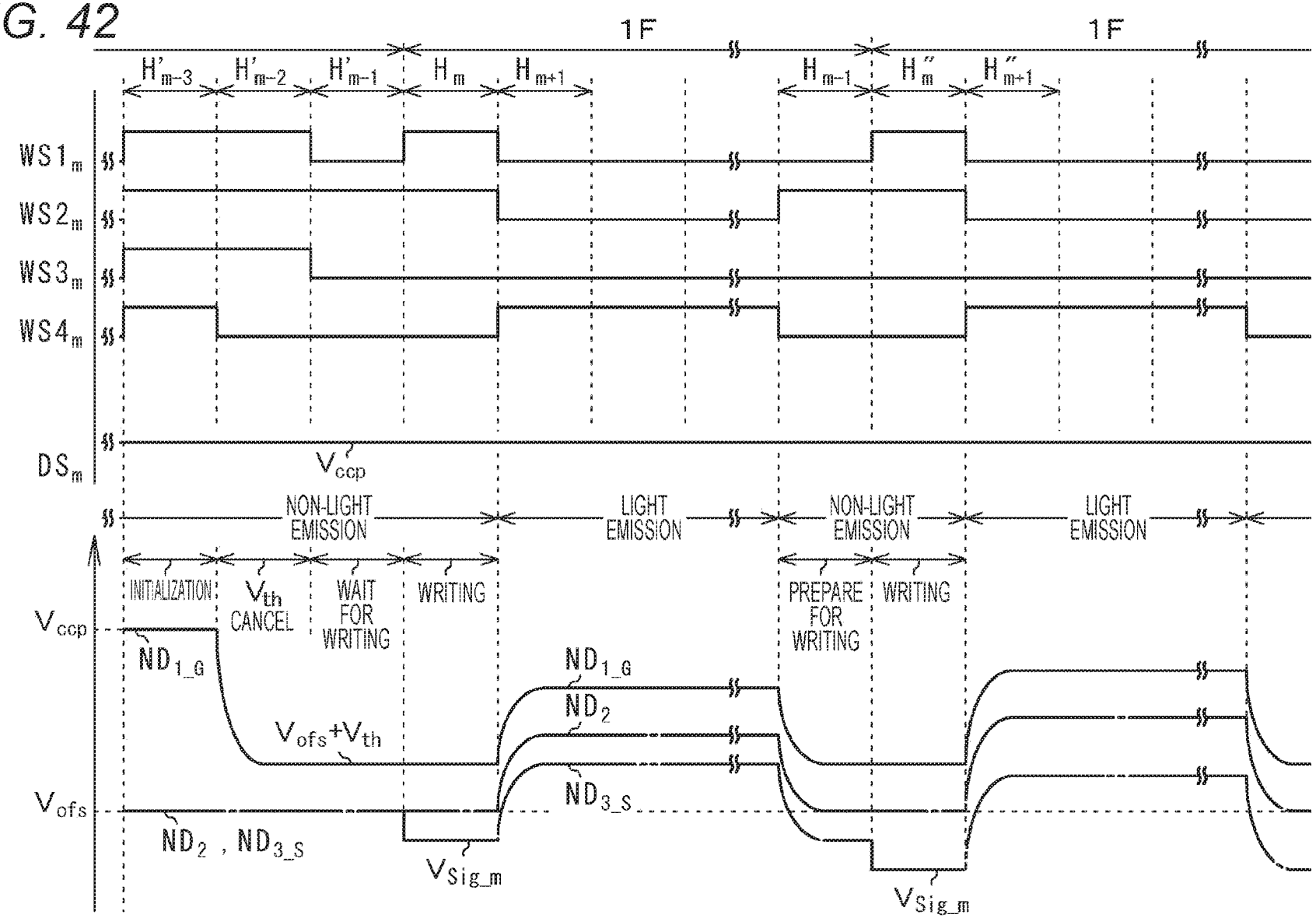

FIG. 42 is a schematic timing chart illustrating the operation of the display device according to the eighth embodiment, more specifically, the operation of the (n, m)th display element of the display device.

Figure 43A:
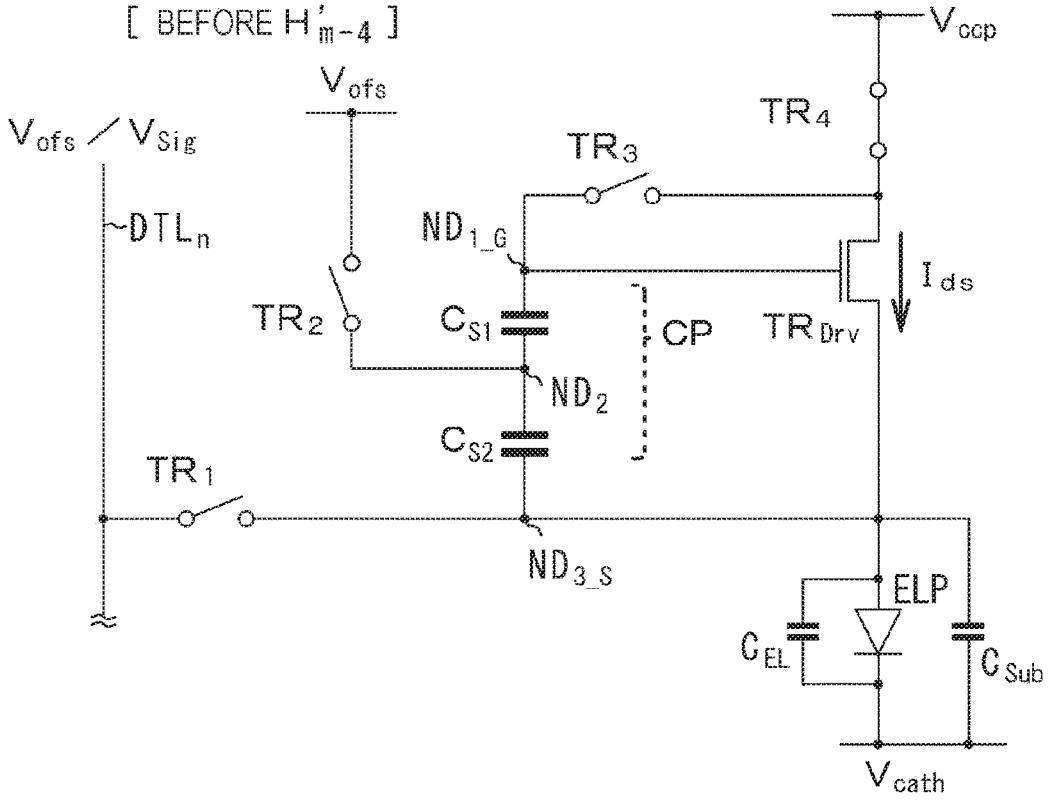
Figure 43B:
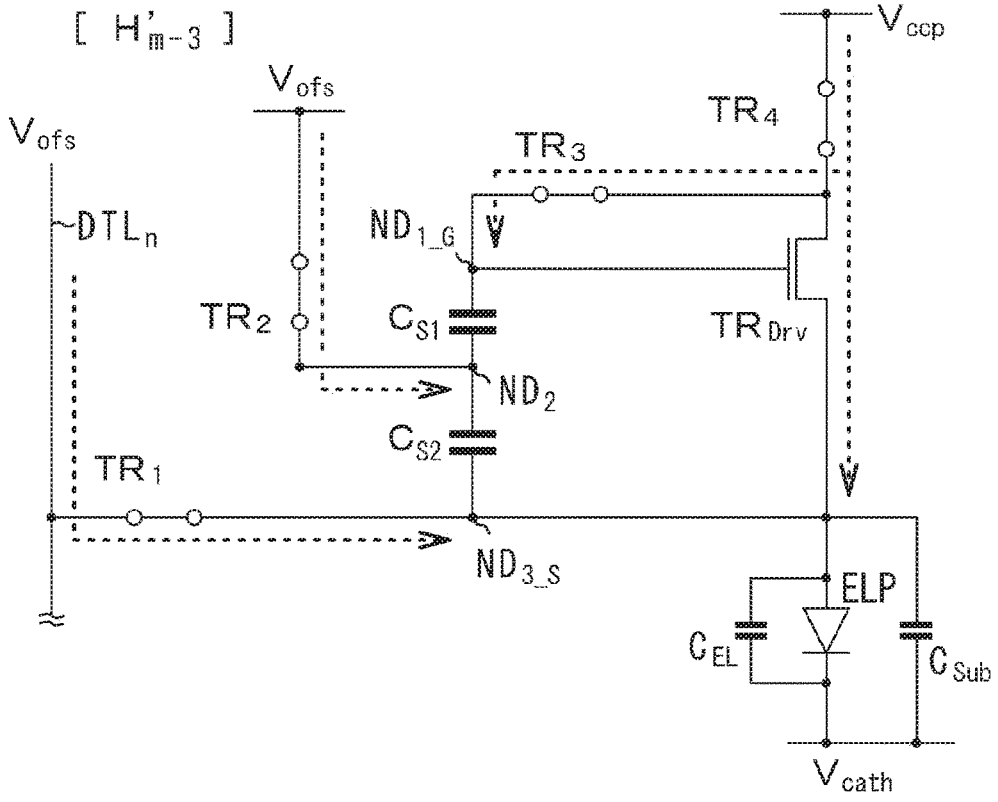

FIGS. 43A and 43B are drawings each schematically illustrating conducting state/non-conducting state and the like of each transistor that is included in a driving circuit of the display element of the display device according to the eighth embodiment.

Figure 44A:
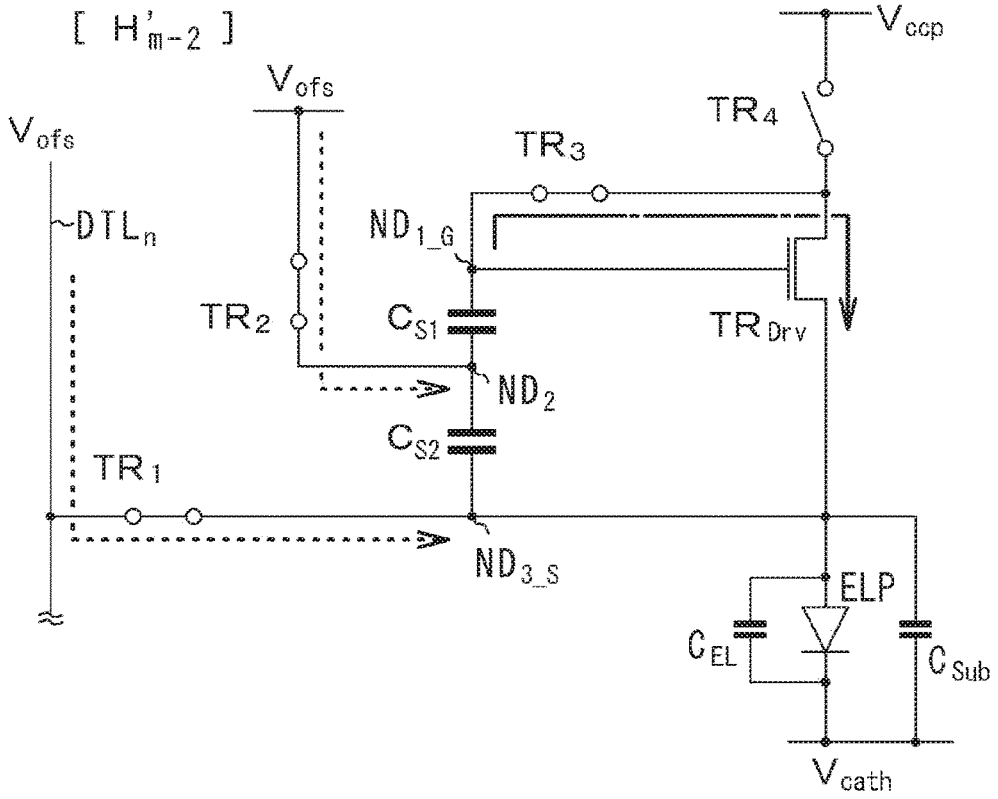
Figure 44B:
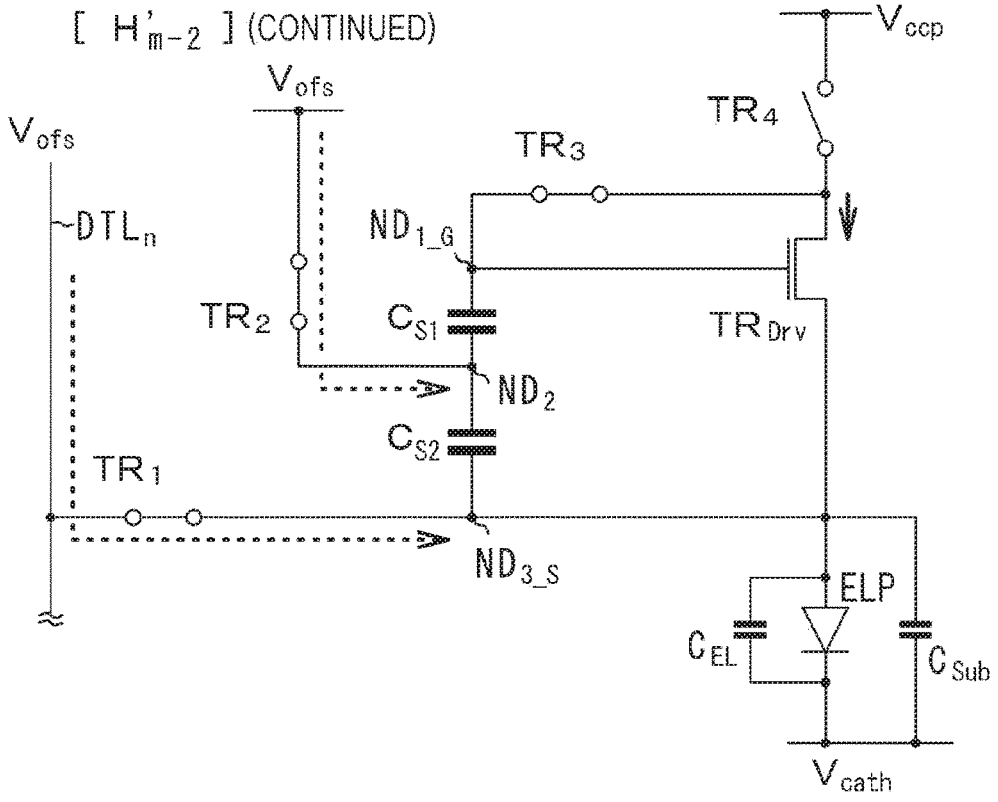

Following FIGS. 43B, 44A, and 44B are drawings each schematically illustrating conducting state/non-conducting state and the like of each transistor that is included in the driving circuit of the display element of the display device according to the eighth embodiment.

Figure 45A:
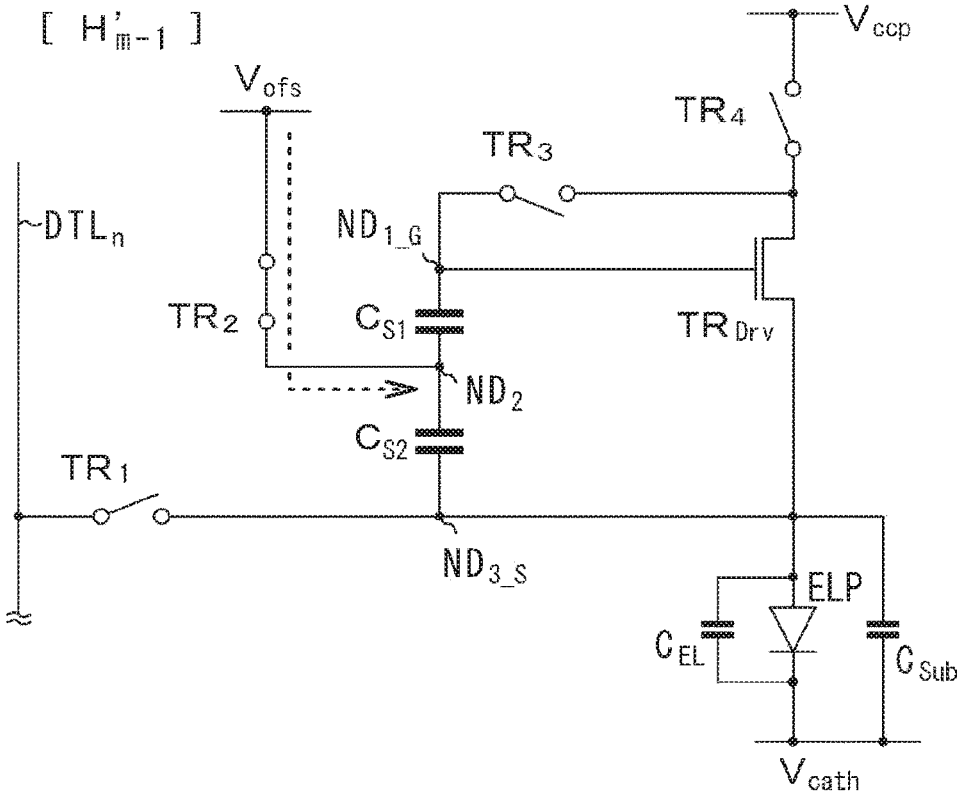

Following FIGS. 44B, 45A and, 45B are drawings each schematically illustrating conducting state/non-conducting state and the like of each transistor that is included in the driving circuit of the display element of the display device according to the eighth embodiment.

Figure 45B:
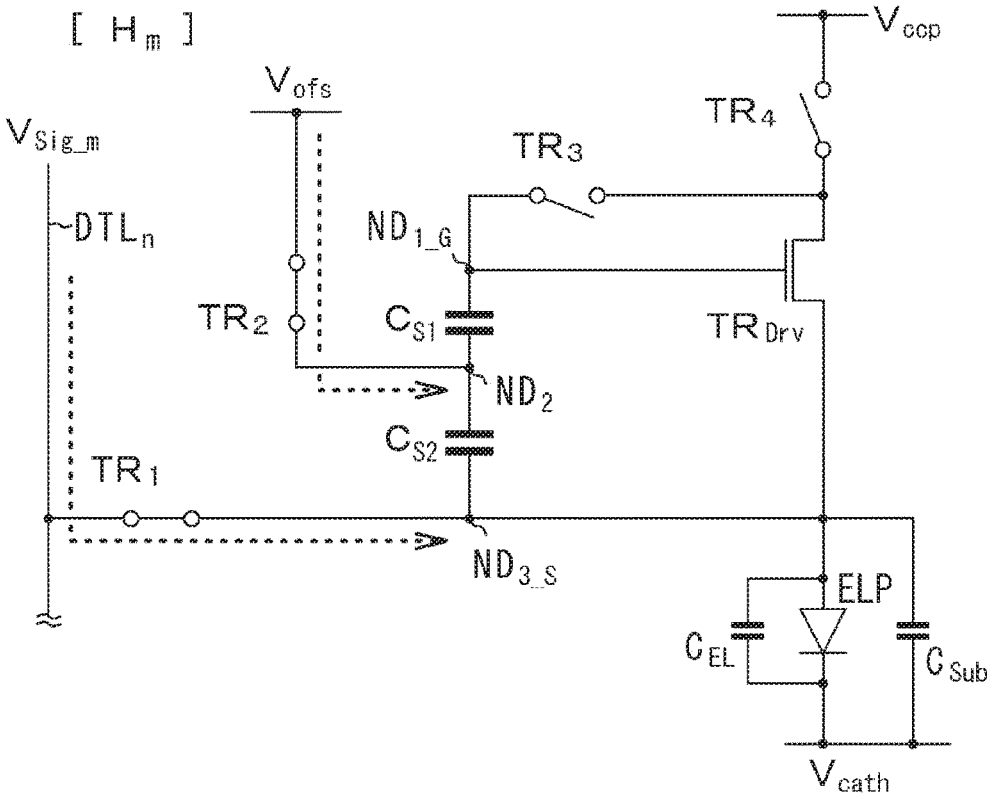
Figure 46A:
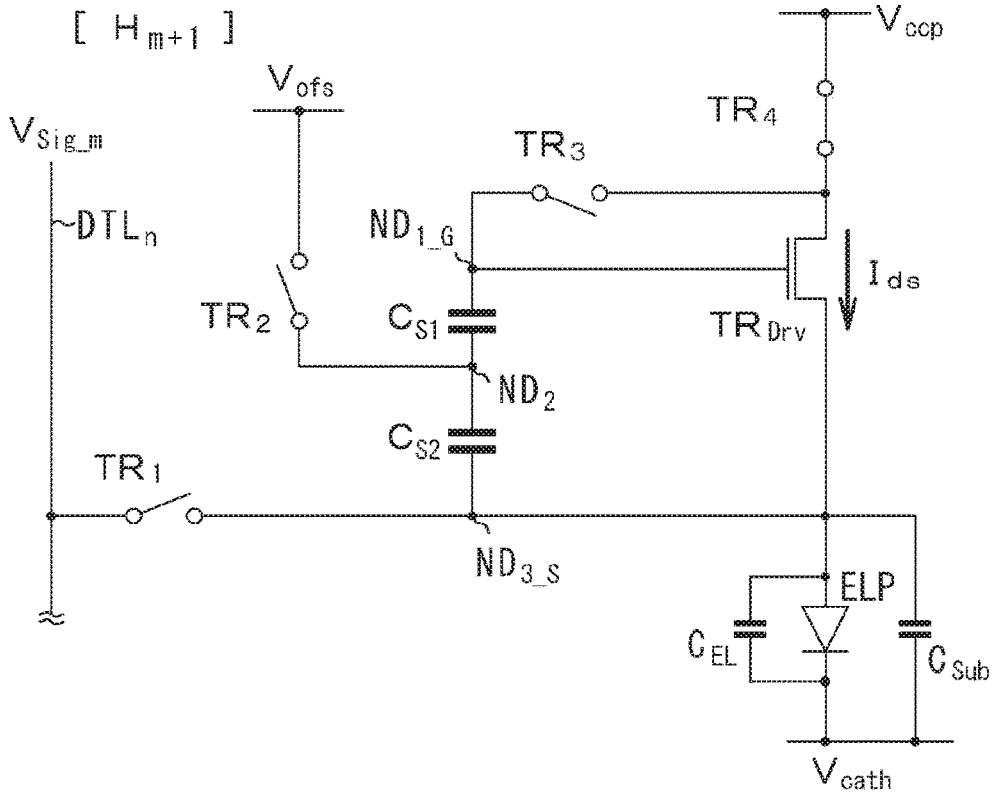
Figure 46B:
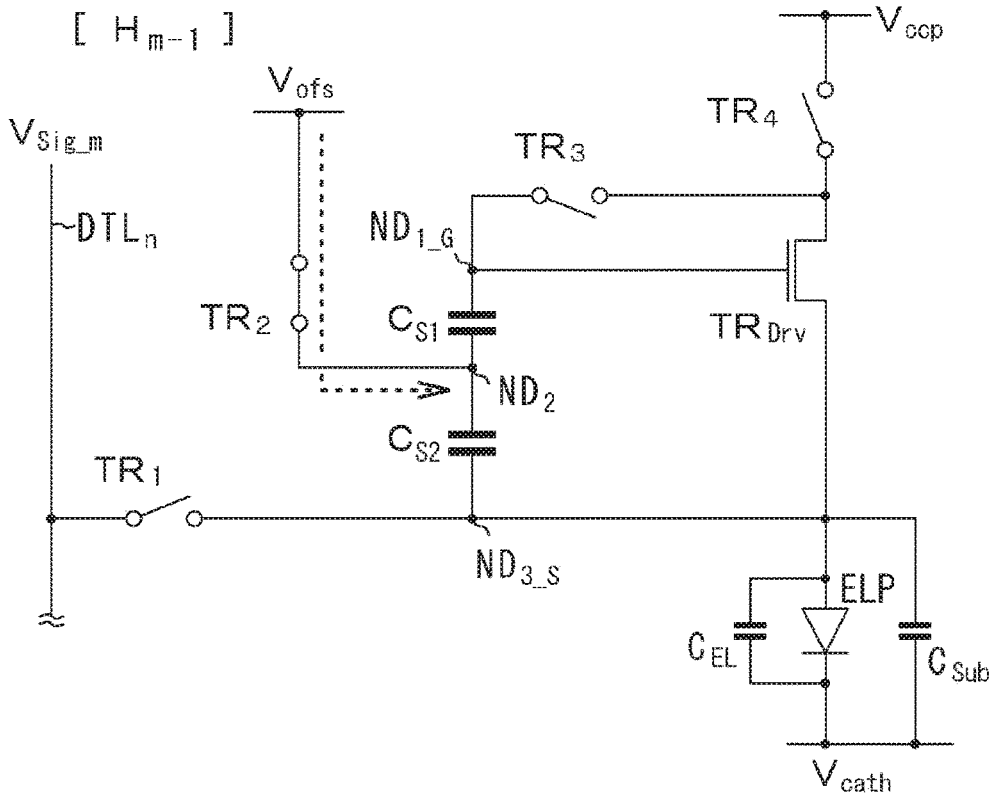

Following FIGS. 45B, 46A, and 46B are drawings each schematically illustrating conducting state/non-conducting state and the like of each transistor that is included in the driving circuit of the display element of the display device according to the eighth embodiment.

Figure 47A:
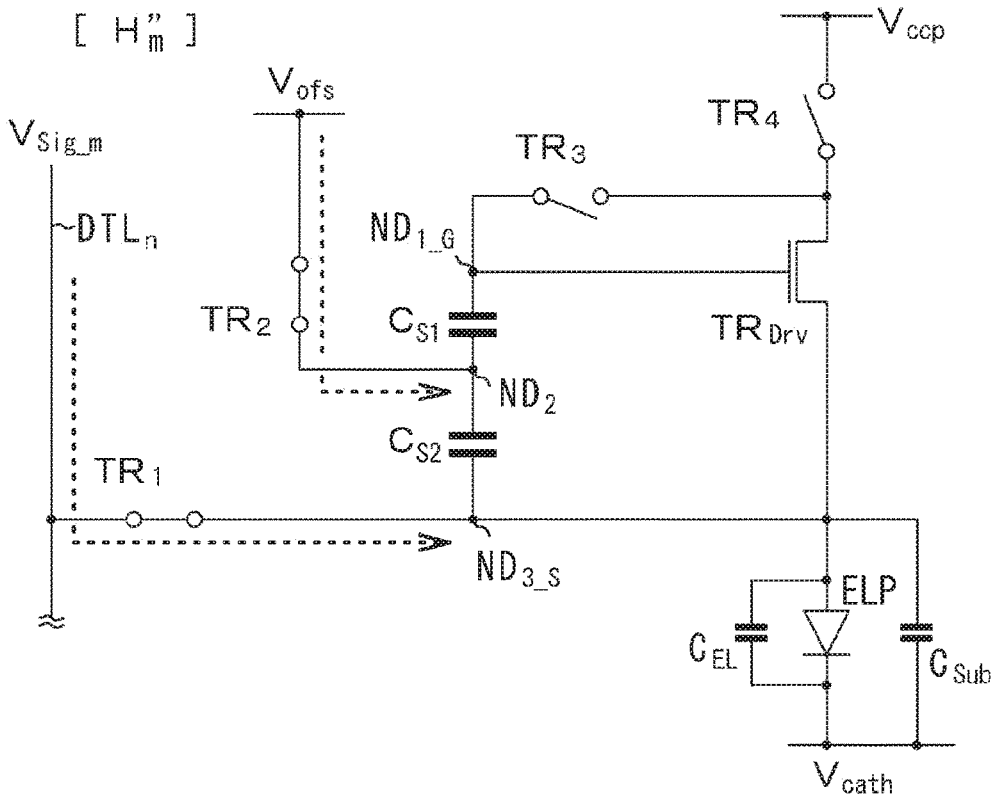
Figure 47B:
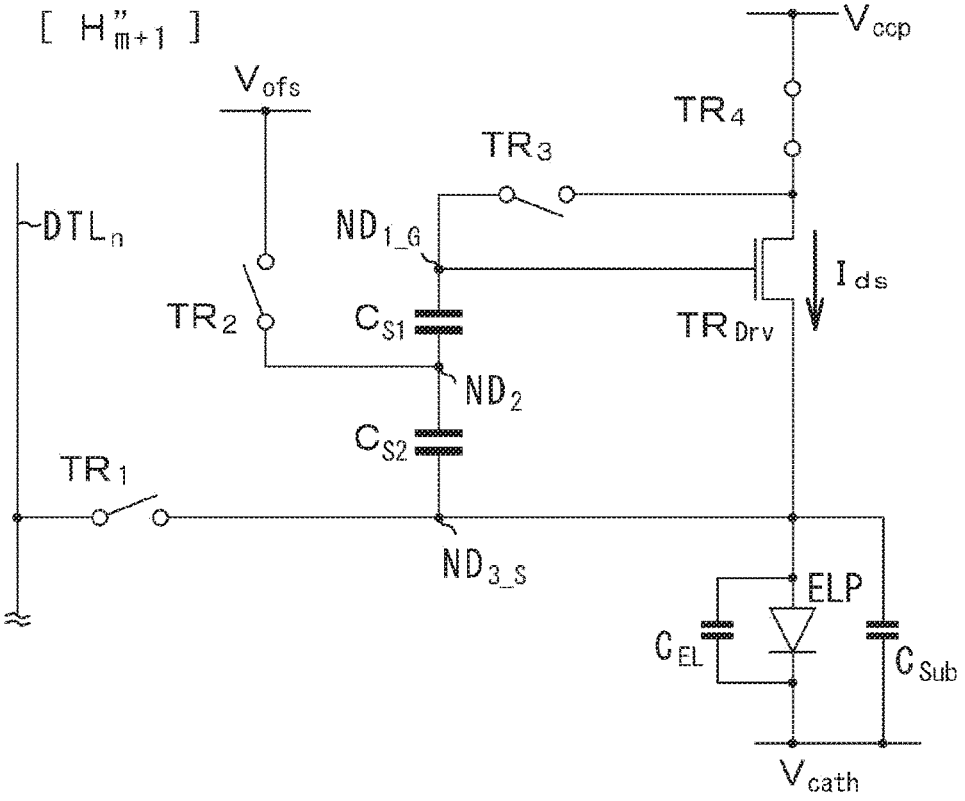

Following FIGS. 46B, 47A, and 47B are drawings each schematically illustrating conducting state/non-conducting state and the like of each transistor that is included in the driving circuit of the display element of the display device according to the eighth embodiment.

Figure 48:
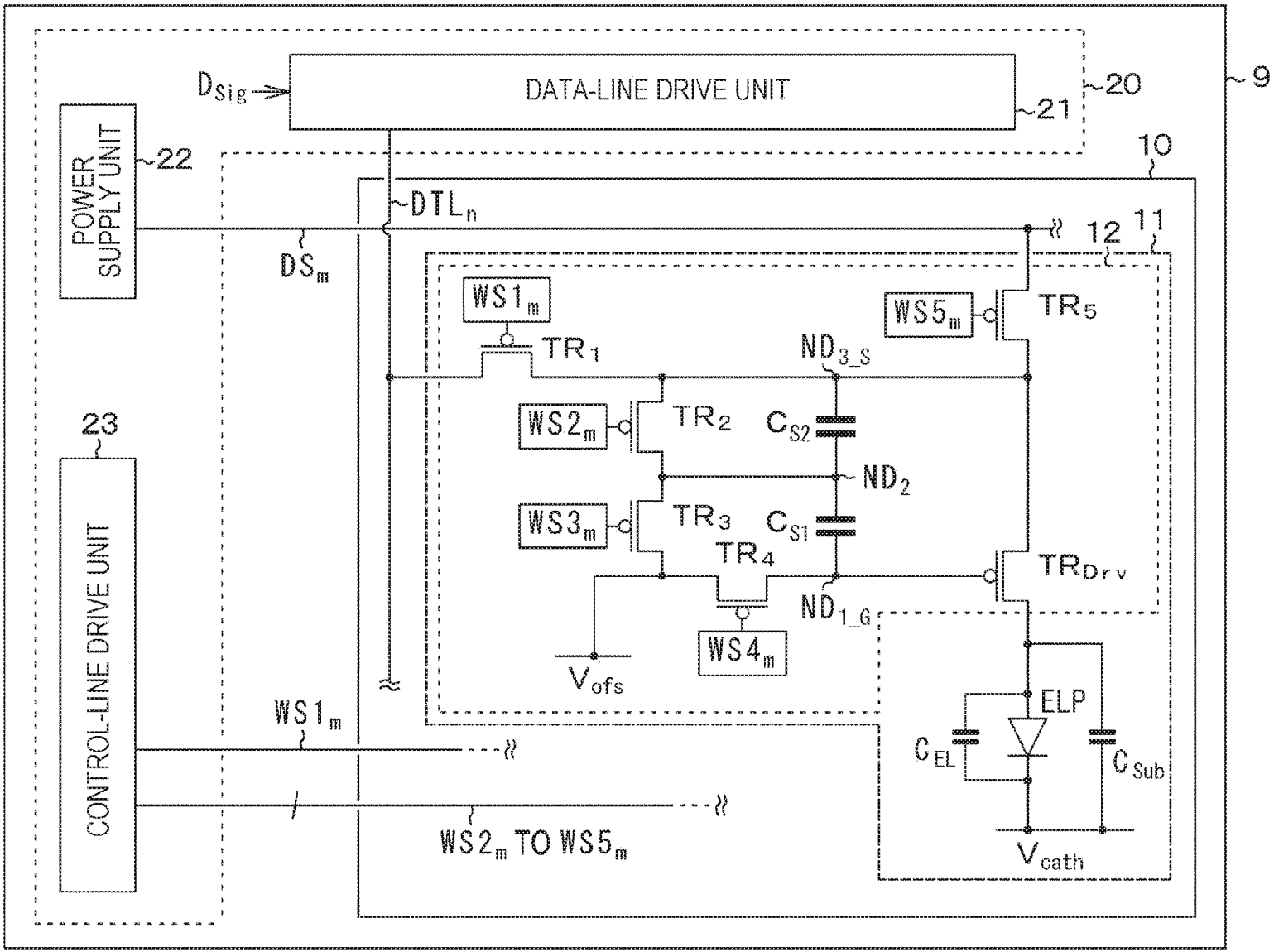

FIG. 48 is a conceptual diagram illustrating a display device according to a first modified example.

Figure 49:
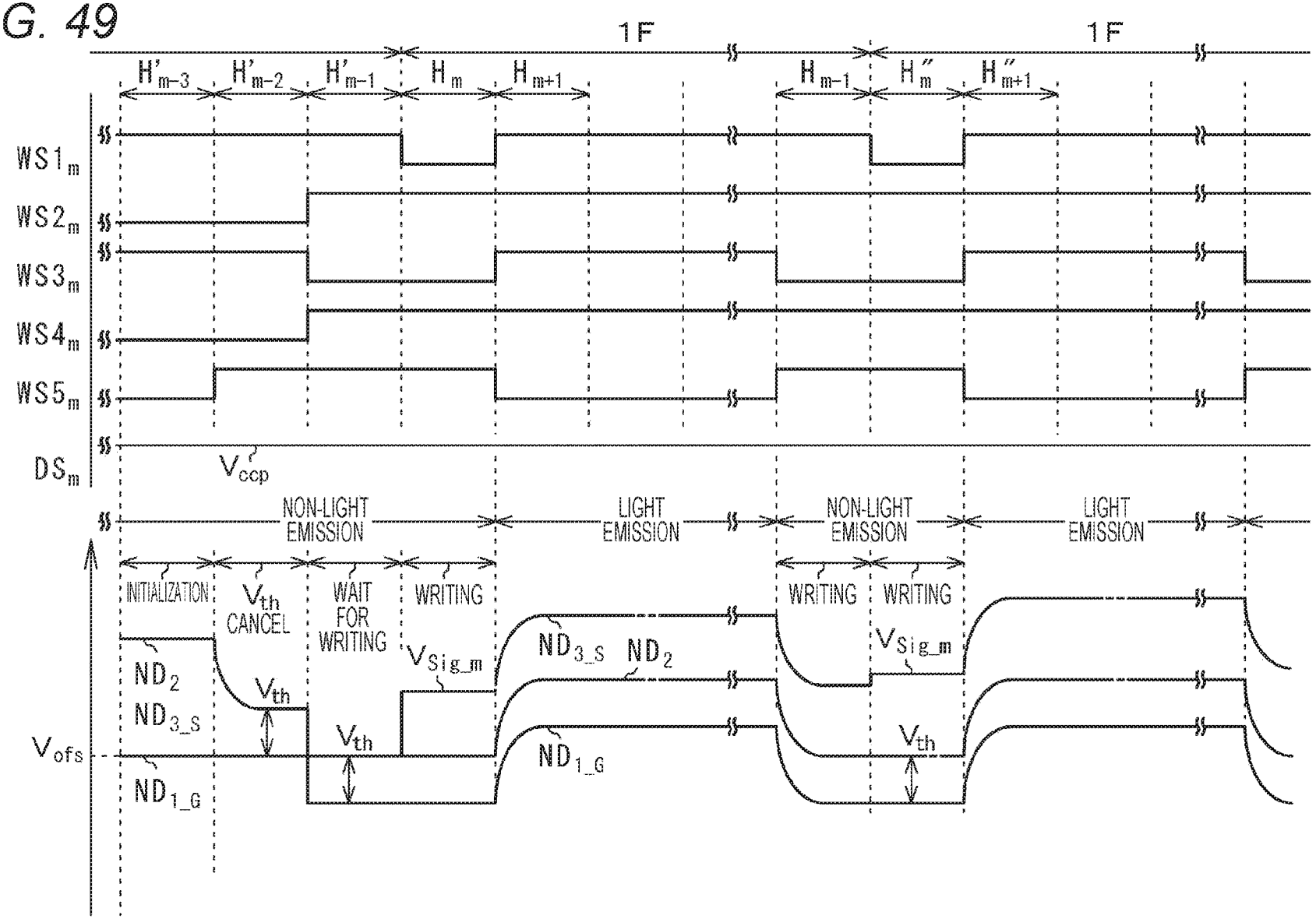

FIG. 49 is a schematic timing chart illustrating the operation of the display device according to the first modified example, more specifically, the operation of the (n, m)th display element of the display device.

Figure 50:
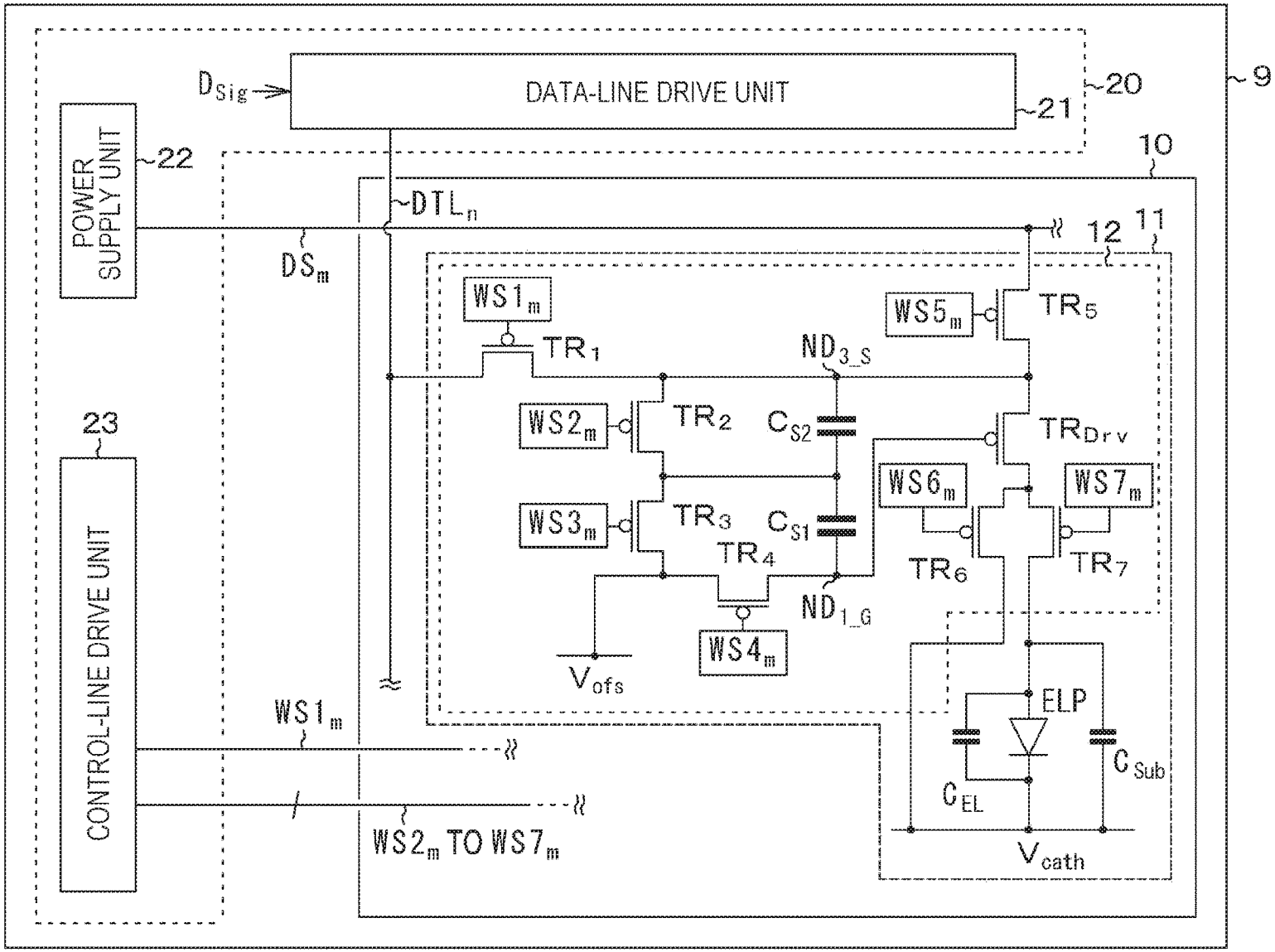

FIG. 50 is a conceptual diagram illustrating a display device according to a second modified example.

Figure 51A:
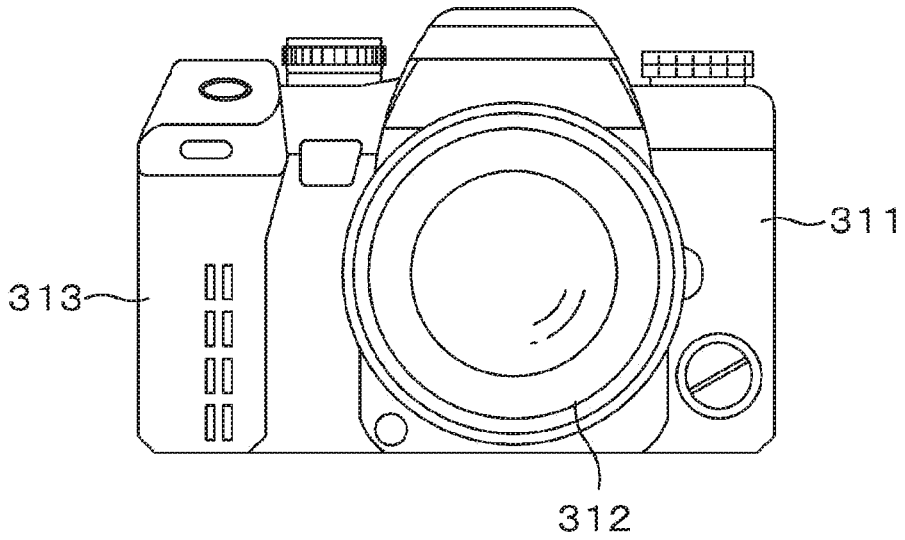
Figure 51B:
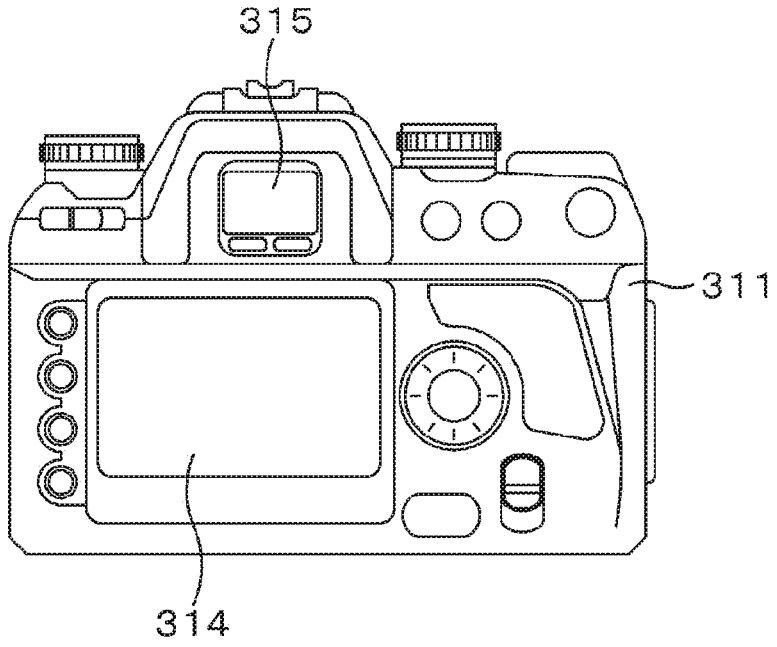

FIGS. 51A and 51B show outside drawings of a lens-interchangeable single-lens reflex type digital still camera, FIG. 51A is a front view thereof, and FIG. 51B is a rear view thereof.

Figure 52:
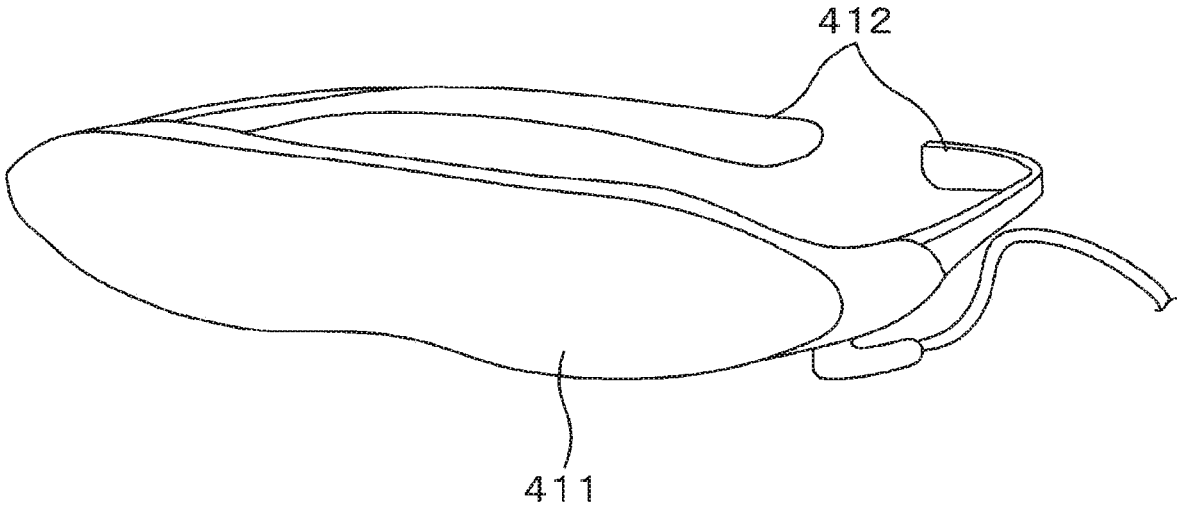

FIG. 52 is an outside drawing of a head mounted display.

Figure 53:
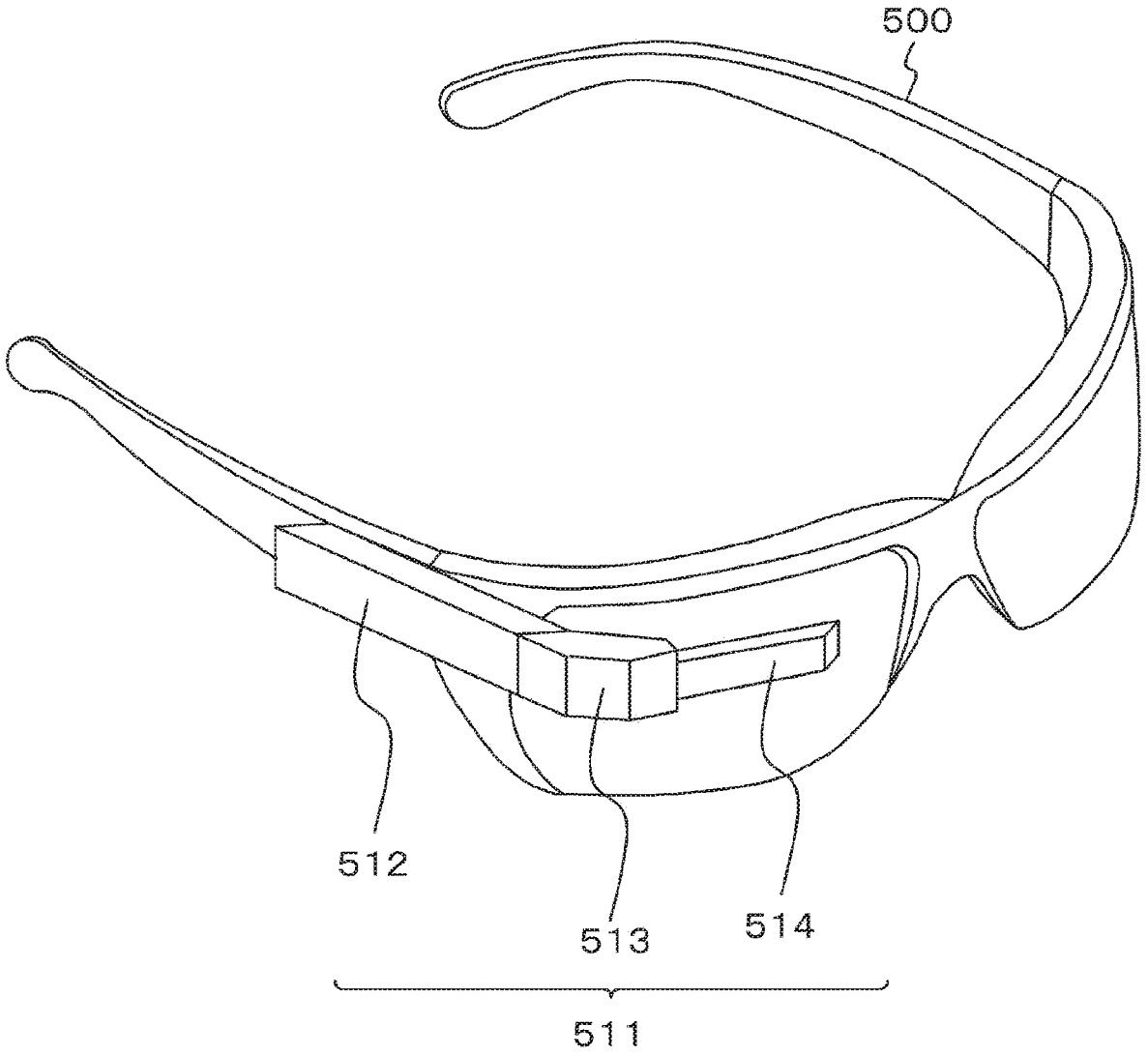

FIG. 53 is an outside drawing illustrating a see-through head mounted display.

MODE FOR CARRYING OUT THE INVENTION

The present disclosure will be described below on the basis of embodiments with reference to the accompanying drawings. The present disclosure is not limited to the embodiments, and various numerical values and materials in the embodiments are merely examples. In the following explanations, the same element, or an element having the same function, uses the same reference numeral, and overlapping explanation will be omitted. It should be noted that explanations are made in the following order.

1. Overall explanation about a display device, a display device driving method, a display element, and an electronic apparatus according to the present disclosure
2. First Embodiment
3. Second Embodiment
4. Third Embodiment
5. Fourth Embodiment
6. Fifth Embodiment
7. Sixth Embodiment
8. Seventh Embodiment
9. Eighth Embodiment
10. Display device according to modified examples
11. Explanation of electronic apparatus, and others Overall explanation about a display device, a display device driving method, a display element, and an electronic apparatus according to the present disclosure In a display device, a display device driving method, and an electronic apparatus according to the present disclosure, a drive unit can be configured to scan display elements of a display unit consecutively, and to perform the operation of holding, in a first capacitor, a voltage corresponding to a threshold voltage of a driving transistor in a part of a plurality of consecutive frames.

The above-described operation may be performed, for example, once every two frames, or once every five or ten frames. From the viewpoint of reducing the power consumption, it is preferable to reduce a frequency of frames in which the operation of holding a voltage corresponding to the threshold voltage of the driving transistor in the first capacitor is performed. Meanwhile, the voltage held in the first capacitor changes due to leakage or the like. Therefore, from the viewpoint of, for example, reducing uneven brightness, it is preferable to maintain a certain level of frequency. A level of frequency may be set as appropriate according to, for example, specifications of the display device.

The operation of holding a voltage corresponding to the threshold voltage of the driving transistor in the first capacitor, and the operation of writing a video signal may be performed in some specific frame.

Alternatively, the following operation may be performed: in some specific frame, for all display elements, performing only the operation of holding a voltage corresponding to the threshold voltage of the driving transistor in the first capacitor; and in the subsequent frame, performing the operation of writing a video signal.

There is also a possibility that the voltage held by the first capacitor will change due to leakage or the like after the operation of holding the voltage corresponding to the threshold voltage of the driving transistor in the first capacitor has been performed until similar operation is performed next time. In such a case, a video signal voltage that has been corrected to compensate for a change in voltage of the first capacitor may be written to a second capacitor, for example.

In the present disclosure including the above-described preferable configuration, the drive unit applies a reference voltage to the first node, and applies an initialization voltage to the second node and the third node, to set a voltage held by the capacitor unit so as to exceed the threshold voltage of the driving transistor, and subsequently applies the reference voltage to the first node, and applies the driving voltage to one source/drain region of the driving transistor in a state in which the second node and the third node electrically conduct with each other, so as to cause electric potentials of the second node and the third node to get close to a voltage obtained by subtracting the threshold voltage of the driving transistor from the reference voltage, consequently causing a voltage corresponding to the threshold voltage of the driving transistor to be held in the first capacitor.

In this case, the display elements each further include a second switching transistor, a third switching transistor, and a fourth switching transistor; in the second switching transistor, the reference voltage is applied to one source/drain region, and the other source/drain region is connected to the second node;

in the third switching transistor, one source/drain region is connected to the second node, and the other source/drain region is connected to the third node;

in the fourth switching transistor, the reference voltage is applied to one source/drain region, and the other source/drain region is connected to the first node;

the reference voltage is applied to the first node by bringing the fourth switching transistor into the conducting state; and the second node and the third node are brought into the conducting state by bringing the third switching transistor into the conducting state.

The initialization voltage is supplied from the data line through the first switching transistor. Alternatively, the initialization voltage may be supplied from the electric supply line through the driving transistor.

The display elements each further include a fifth switching transistor, and the other source/drain region of the driving transistor may be connected to one end of the light-emitting unit through the fifth switching transistor.

Alternatively, the display elements each further include a second switching transistor, a third switching transistor, and a fourth switching transistor; in the second switching transistor, the initialization voltage is applied to one source/drain region, and the other source/drain region is connected to the second node;

in the third switching transistor, the reference voltage is applied to one source/drain region, and the other source/drain region is connected to the first node;

the other source/drain region of the driving transistor is connected to one end of the light-emitting unit through the fourth switching transistor;

the reference voltage is applied to the first node by bringing the third switching transistor into the conducting state;

the initialization voltage is applied to the first node by bringing the second switching transistor into the conducting state; and a conducting state/a non-conducting state of the second switching transistor are controlled by a control line in common with the first switching transistor.

In the present disclosure including the above-described preferable configuration, the drive unit applies a reference voltage to the first node, and applies an initialization voltage to the second node and the third node, to set a voltage held by the capacitor unit so as to exceed the threshold voltage of the driving transistor, and subsequently applies the reference voltage to the first node, and applies the driving voltage to one source/drain region of the driving transistor in a state in which the second node and the third node electrically conduct with each other, so as to cause electric potentials of the second node and the third node to get close to a voltage obtained by subtracting the threshold voltage of the driving transistor from the reference voltage, consequently causing a voltage corresponding to the threshold voltage of the driving transistor to be held in the first capacitor.

In this case, the display elements each further include a second switching transistor, a third switching transistor, and a fourth switching transistor; in the second switching transistor, the initialization voltage is applied to one source/drain region, and the other source/drain region is connected to the second node;

in the third switching transistor, the reference voltage is applied to one source/drain region, and the other source/drain region is connected to the first node;

the other source/drain region of the driving transistor is connected to one end of the light-emitting unit through the fourth switching transistor;

the reference voltage is applied to the first node by bringing the third switching transistor into the conducting state;

the initialization voltage is applied to the second node by bringing the second switching transistor into the conducting state; and a conducting state/a non-conducting state of the second switching transistor are controlled by a control line in common with the first switching transistor.

Alternatively, in the present disclosure including the above-described preferable configuration, the drive unit applies a reference voltage to the second node and the third node, and supplies a driving voltage from the electric supply line in a state in which the first node and one source/drain region of the driving transistor electrically conduct with each other, to set a voltage held by the capacitor unit so as to exceed a threshold voltage of the driving transistor, and subsequently interrupts a connection between the electric supply line and the driving transistor in a state in which the reference voltage is applied to the second node and the third node, so as to cause an electric potential of the first node to get close to an electric potential obtained by adding the threshold voltage of the driving transistor to the reference voltage, consequently causing a voltage corresponding to the threshold voltage of the driving transistor to be held in the first capacitor.

In this case, the display elements each further include a second switching transistor, a third switching transistor, a fourth switching transistor, and a fifth switching transistor;

in the second switching transistor, the reference voltage is applied to one source/drain region, and the other source/drain region is connected to the second node;

in the third switching transistor, one source/drain region is connected to the second node, and the other source/drain region is connected to the third node;

a connection between the first node and one source/drain region of the driving transistor is made through the fourth switching transistor;

a connection between the electric supply line and one source/drain region of the driving transistor is made through the fifth switching transistor;

the reference voltage is applied to the second node and the third node by bringing the second switching transistor and the third switching transistor into the conducting state; the first node and one source/drain region of the driving transistor are brought into the conducting state by bringing the fourth switching transistor into the conducting state; and the connection between the electric supply line and the driving transistor is interrupted by bringing the fifth switching transistor into the non-conducting state.

In this case, the display elements each further include a sixth switching transistor; and the other source/drain region of the driving transistor is connected to one end of the light-emitting unit through the sixth switching transistor.

Alternatively, the display elements each further include a second switching transistor, a third switching transistor, and a fourth switching transistor;

in the second switching transistor, the reference voltage is applied to one source/drain region, and the other source/drain region is connected to the second node;

a connection between the first node and one source/drain region of the driving transistor is made through the third switching transistor;

a connection between the electric supply line and one source/drain region of the driving transistor is made through the fourth switching transistor;

the reference voltage is supplied from the data line through the first switching transistor, and is applied to the first node, and the reference voltage is applied to the second node by bringing the second switching transistor into the conducting state;

the first node and one source/drain region of the driving transistor are brought into the conducting state by bringing the third switching transistor into the conducting state; and the connection between the electric supply line and the driving transistor is interrupted by bringing the fourth switching transistor into the non-conducting state.

In the above-described various preferable configurations, a voltage in which the threshold voltage of the driving transistor is reflected suffices as the voltage held in the first capacitor. Therefore, it is not always required that the voltage held in the first capacitor agrees with the threshold voltage.

In the display device, the display device driving method, the display element, and the electronic apparatus according to the present disclosure including the above-described various preferable configurations (hereinafter, may be merely referred to as "the present disclosure"), the light-emitting unit may include a current-driven electro-optic element, the light emission brightness of which changes according to a value of a flowing current. An organic electroluminescent light-emitting unit, an LED light-emitting unit, a semiconductor laser light-emitting unit, and the like can be mentioned as the current-driven light-emitting unit. These light-emitting units can be configured by using a well-known material or method. From the viewpoint of configuring a flat-type display device, it is preferable that the light-emitting unit includes, above all, an organic electroluminescent light-emitting unit.

The drive unit used in the present disclosure including the above-described various preferable configurations includes, for example, a circuit such as a data-line drive unit, a power supply unit, and a control-line drive unit. These can be configured by using a well-known circuit element or the like.

The display device may be a so-called monochrome display configuration, or a color display configuration. In the case of the color display configuration, one pixel may include a plurality of sub-pixels. More specifically, one pixel may include three sub-pixels that are a red light-emitting sub-pixel, a green light-emitting sub-pixel, and a blue light-emitting sub-pixel. Moreover, one pixel may include a set of sub-pixels obtained by further adding one kind of or two or more kinds of sub-pixels to the above three kinds of sub-pixels (for example, a set of sub-pixels obtained by adding a sub-pixel that emits white light for improving brightness, a set of sub-pixels obtained by adding a sub-pixel that emits a complementary color for magnifying a color reproduction range, a set of sub-pixels obtained by adding a sub-pixel that emits yellow for magnifying a color reproduction range, and a set of sub-pixels obtained by adding sub-pixels that emit yellow and cyan for magnifying a color reproduction range).

As values of pixels (pixels) of the display device, other than VGA (640, 480), S-VGA (800, 600), XGA (1024, 768), APRC (1152, 900), S-XGA (1280, 1024), U-XGA (1600, 1200), HD-TV (1920, 1080), and Q-XGA (2048, 1536), some image display resolutions such as (1920, 1035), (720, 480) and (1280, 960) can be presented. However, image display resolutions are not limited to these values.

The display element that is included in the display unit is formed in a certain plane (for example, the display element is formed on a support base). For example, through the interlayer insulating layer, the light-emitting unit is formed above the driving circuit that drives the light-emitting unit.

The driving circuit that drives the light-emitting unit can be configured as a circuit that includes a transistor and a capacitor unit. As the transistor that is included in the driving circuit, for example, a thin film transistor (TFT) can be mentioned. The transistor may be an enhancement type transistor or a depletion type transistor. An n-channel transistor may be formed with a Lightly Doped Drain (LDD) structure. In some cases, the LDD structure may be unsymmetrically formed. For example, a large current flows through the driving transistor when the display element emits light. Therefore, the LDD structure may be formed only in one source/drain region that becomes a drain region at the time of light emission.

With respect to two source/drain regions of one transistor, there is a case where the term "one source/drain region" is used to mean a source/drain region connected to the power supply side. In addition, when a transistor is in a conducting state, this means a state in which a channel is formed between the source/drain regions. It does not matter whether or not a current flows from one source/drain region of the transistor to the other source/drain region. Meanwhile, when the transistor is in a non-conducting state, this means a state in which a channel is not formed between the source/drain regions. Moreover, the source/drain regions can be configured not only from a conductive material such as polysilicon and amorphous silicon containing impurities, but also from a layer that includes metal, alloy, conductive particles, a layered structure thereof, and an organic material (conductive polymer).

Each capacitor that is included in the capacitor unit can be configured from a pair of electrodes, and a dielectric layer that is put between these electrodes. The transistor and the capacitor unit that are included in the driving circuit are formed in a certain plane (for example, the transistor and the capacitor unit are formed on the support base). For example, through the interlayer insulating layer, the light-emitting unit is formed above the transistor and the capacitor unit that are included in the driving circuit. It should be noted that a configuration in which a transistor is formed on a semiconductor substrate or the like may be employed.

Various kinds of wiring lines such as a control line and a data line or an electric supply line are formed on a certain plane (for example, on the support base). These wiring lines can be regarded as a well-known configuration or structure.

As a constituent material of the support base or a constituent material of a substrate as described later, other than a glass material such as high-strain point glass, soda glass ($Na_2O.CaO.SiO_2$), borosilicate glass ($Na_2O.B_2O_3.SiO_2$), forsterite ($2MgO.SiO_2$), and lead glass ($Na_2O.PbO.SiO_2$), it is possible to present a flexible polymeric material, for example, a polymeric material, typified by polyether sulfone (PES), polyimide, polycarbonate (PC), and polyethylene terephthalate (PET). It should be noted that a surface of the support base or a surface of the substrate may be provided with various coatings. The constituent material of the support base and the constituent material of the substrate may be the same, or may differ. If the support base and the substrate each including a flexible polymeric material are used, a flexible display device can be configured.

Conditions represented by various equations in the present description are fulfilled not only in a case where the equations mathematically and strictly hold, but also in a case where the equations substantially hold. With respect to whether or not the equations hold, various dispersions that occur while designing or producing a display element and a display device are allowed.

In timing charts used in the explanations below, a length (time length) of the horizontal axis indicating each time period is merely schematic, and thus does not indicate a ratio of the time length of each time period. The same applies to the vertical axis. In addition, waveform shapes in the timing chart are also schematic.

First Embodiment

The first embodiment relates to a display device, a display device driving method, and a display element according to the present disclosure.

Figure 1:
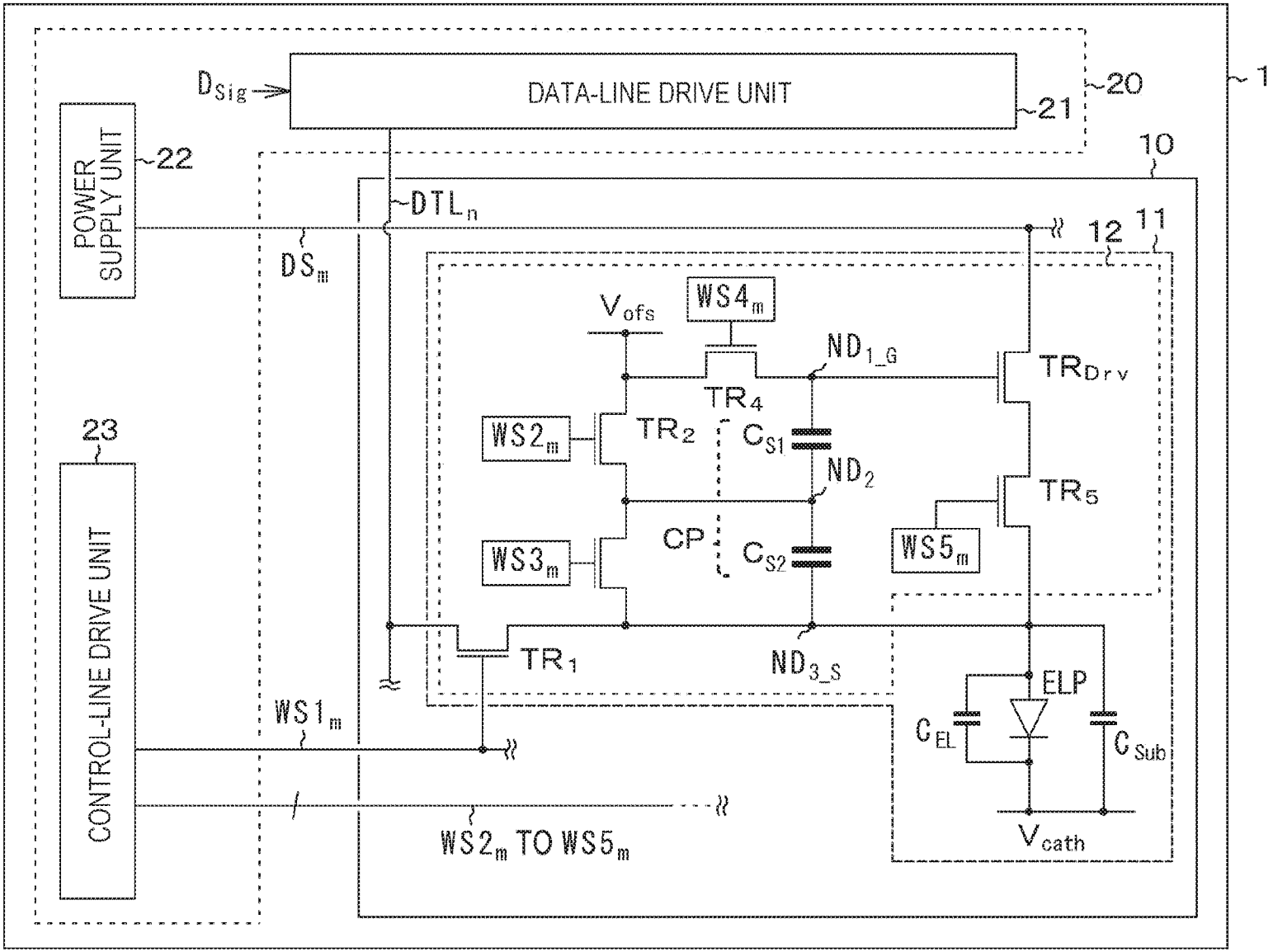
FIG. 1 is a conceptual diagram illustrating a display device according to a first embodiment.

FIG. 1 is a conceptual diagram illustrating a display device according to the first embodiment. A display device 1 is provided with: a display unit 10 in which display elements 11 are arranged; and a drive unit 20 for driving the display unit 10.

In the display unit 10, the display elements 11 are arranged in a two-dimensional matrix form in a state in which the display elements 11 are connected to first to fifth control lines WS1 to WS5 each extending in a row direction (X direction in FIG. 1), and are connected to data lines DTL each extending in a column direction (Y direction in FIG. 1).

For convenience of illustration, FIG. 1 shows a connection line relationship for one of the display elements 11, more specifically, for a (n, m)th display element 11 as described later.

The display device 1 is provided with a data-line drive unit 21, a power supply unit 22, and a control-line drive unit 23. The data-line drive unit 21, the power supply unit 22, and the control-line drive unit 23 constitute the drive unit 20 for driving the display unit 10.

Various signals are supplied from the control-line drive unit 23 to the first to fifth control lines WS1 to WS5. For example, a video signal voltage corresponding to the brightness of an image to be displayed is supplied to the data lines DTL. A driving voltage or the like is supplied from the power supply unit 22 to electric supply lines DS. Incidentally, there is a case where the first to fifth control lines WS1 to WS5 are merely collectively referred to as "control lines".

Although not illustrated in FIG. 1, a region (display region) in which the display unit 10 displays an image is constituted of the display elements 11 that are arranged in a two-dimensional matrix form formed by N pieces in the row direction, and M pieces in the column direction, that is to say, N×M pieces in total. The number of rows of the display elements 11 in the display region is M, and the number of the display elements 11 that constitute each row is N.

The numbers of the first to fifth control lines WS1 to WS5, and the number of the electric supply lines DS, are each M. The display elements 11 in the m-th row (where m=1, 2, . . . , M) are each connected to the first to fifth control lines $WS1_m$ to $WS5_m$ corresponding to the m-th, and are each connected to the m-th electric supply line $DS_m$, thereby constituting one display element row. It should be noted that FIG. 1 illustrates only the first to fifth control lines $WS1_m$ to $WS5_m$, and the electric supply line $DS_m$.

In addition, the number of data lines DTL is N. The display elements 11 in the n-th column (where n=1, 2, . . . , N) are each connected to the n-th data line $DTL_n$. It should be noted that FIG. 1 illustrates only the data line $DTL_n$.

The display element 11 includes: a current-driven light-emitting unit ELP; a capacitor unit CP including a first capacitor $C_{S1}$ and a second capacitor $C_{S2}$; an n-channel driving transistor $TR_{Drv}$ that causes a current corresponding to a voltage held by the capacitor unit CP to flow through the light-emitting unit ELP; and a first switching transistor $TR_1$ that writes a video signal voltage to the capacitor unit CP. The driving transistor $TR_{Drv}$ includes an n-channel TFT. The same applies to the other transistors.

In the capacitor unit CP, one end of the first capacitor $C_{S1}$ is connected to a gate electrode of the driving transistor $TR_{Drv}$ to form a first node $ND_{1_G}$, the other end of the first capacitor $C_{S1}$ is connected to one end of the second capacitor $C_{S2}$ to form a second node $ND_2$, and the other end of the second capacitor $C_{S2}$ is connected to one end (anode electrode with which the light-emitting unit is provided) of the light-emitting unit ELP, and to the other source/drain region of the driving transistor $TR_{Drv}$ to form a third node $ND_{3_S}$. In the driving transistor $TR_{Drv}$, one source/drain region is connected to the electric supply line DS, and the other source/drain region is connected to the light-emitting unit ELP through a fifth switching transistor $TR_5$ as described later. In the first switching transistor TIM, one source/drain region is connected to the data line DTL, and the other source/drain region is connected to the third node $ND_{3_S}$.

The display elements 11 are each further provided with a second switching transistor $TR_2$, a third switching transistor $TR_3$, and a fourth switching transistor $TR_4$. In the second switching transistor $TR_2$, a reference voltage $V_{ofs}$ is applied to one source/drain region, and the other source/drain region is connected to the second node $ND_2$. In the third switching transistor $TR_3$, one source/drain region is connected to the second node $ND_2$, and the other source/drain region is connected to the third node $ND_{3_S}$. In the fourth switching transistor $TR_4$, the reference voltage $V_{ofs}$ is applied to one source/drain region, and the other source/drain region is connected to the first node $ND_{1_G}$.

The display elements 11 are each further provided with a fifth switching transistor $TR_5$. The other source/drain region of the driving transistor $TR_{Drv}$ is connected to one end of the light-emitting unit ELP through the fifth switching transistor $TR_5$.

The driving transistor $TR_{Drv}$, the capacitor unit CP, and the first to fifth switching transistors $TR_1$ to $TR_5$ described above constitute a driving circuit 12 for driving the light-emitting unit ELP.

Gate electrodes of the first to fifth switching transistors $TR_1$ to $TR_5$ are connected to the first to fifth control lines WS1 to WS5 respectively. Conducting state/non-conducting state of the first to fifth switching transistors $TR_1$ to $TR_5$ are controlled by a signal from the control-line drive unit 23.

The capacitor unit CP is used to hold a voltage of the gate electrode (so-called a voltage between a gate and a source) with respect to a source region of the driving transistor $TR_{Drv}$. In this case, the "source region" means a source/drain region on the side that functions as a "source region" when the light-emitting unit ELP emits light. In a light emitting state of the display element 11, one source/drain region (the side connected to the electric supply line DS in FIG. 1) of the driving transistor $TR_{Drv}$ functions as a drain region, and the other source/drain region (the one end side of the light-emitting unit ELP) functions as a source region.

The display device 1 is, for example, a monochrome display device, and one display element 11 forms one pixel. The display device 1 is line-sequentially scanned on a row basis by a control signal from the control-line drive unit 23. Hereinafter, the display element 11 located at the m-th row and the n-th column is referred to as the (n, m)th display element 11 or the (n, m)th pixel. In addition, a scanning period (horizontal scanning period) that is assigned to the display elements 11 in the m-th row is represented by reference numeral $H_m$. Moreover, when considering a frame with reference to the scanning period $H_m$, a scanning period in a frame immediately before a frame to which the scanning period $H_m$ belongs is represented by reference numeral H', and a scanning period in a frame immediately after a frame to which the scanning period $H_m$ belongs is represented by reference numeral H".

In the display device 1, the display elements 11 that form respective N pieces of pixels arranged in the m-th row are concurrently driven. In other words, with respect to the N pieces of the display elements 11 arranged along a row direction, the timing of light-emission/non-light emission is controlled for each row to which the display elements 11 belong. If a display frame rate of the display device 1 is represented as FR (times/sec), a scanning period per row (so-called a horizontal scanning period) obtained when the display device 1 is line-sequentially scanned on a row basis is less than (1/FR)×(1/M) seconds.

A video signal $D_{Sig}$ representing gradation, and corresponding to an image to be displayed, is input into the display device 1 from, for example, a device that is not illustrated. The video signal $D_{Sig}$ is a digital signal based on the number of gradation bits such as 8 bits, 16 bits and 24 bits. There is a case where among the video signals $D_{Sig}$ that are input, a video signal corresponding to the (n, m)th display element 11 is represented as $D_{Sig(n, m)}$.

The data-line drive unit 21 generates a voltage corresponding to a value of the video signal $D_{Sig}$, and supplies the voltage to the data line DTL. A video signal voltage corresponding to the video signal $D_{Sig}$ is represented as $V_{Sig}$. In addition, in a case where the video signal voltage $V_{Sig}$ indicates corresponding to, for example, the (n, m)th display element 11, there is a case where the video signal voltage $V_{Sig}$ is represented as a video signal voltage $V_{Sig}$(n, m) or a video signal voltage $V_{Sig_m}$.

In the first embodiment, the data-line drive unit 21 supplies an initialization voltage $V_{ini}$ and the video signal voltage $V_{Sig}$ to the data line DTL. The power supply unit 22 supplies a driving voltage $V_{ccp}$ to the electric supply line DS.

The light-emitting unit ELP is a current-driven electro-optic element, the light emission brightness of which changes according to a value of a flowing current. More specifically, the light-emitting unit ELP includes an organic electroluminescent element. The light-emitting unit ELP has a well-known configuration or structure, and includes an anode electrode, a positive hole transport layer, a light-emitting layer, an electron transport layer, a cathode electrode, and the like.

A voltage $V_{cath}$ (for example, 0 [V]) is applied to the other end (more specifically, the cathode electrode) of the light-emitting unit ELP from a common electric supply line. It is assumed that a threshold voltage required for light emission of the light-emitting unit ELP is $V_{th\text{-}EL}$. When a voltage that is higher than or equal to $V_{th\text{-}EL}$ is applied between the anode electrode and the cathode electrode of the light-emitting unit ELP, the light-emitting unit ELP emits light.

Reference numeral $C_{EL}$ represents a capacitance of the light-emitting unit ELP. Incidentally, in a case where the capacitance of the light-emitting unit ELP is small, and consequently, for example, interferes with the driving of the display element 11, an auxiliary capacitor $C_{Sub}$ that is connected to the light-emitting unit ELP in parallel has only to be provided. The explanation below is made on the assumption that the auxiliary capacitor $C_{Sub}$ is provided. However, the explanation is merely an example. The auxiliary capacitor $C_{Sub}$ may be omitted.

Figure 2:
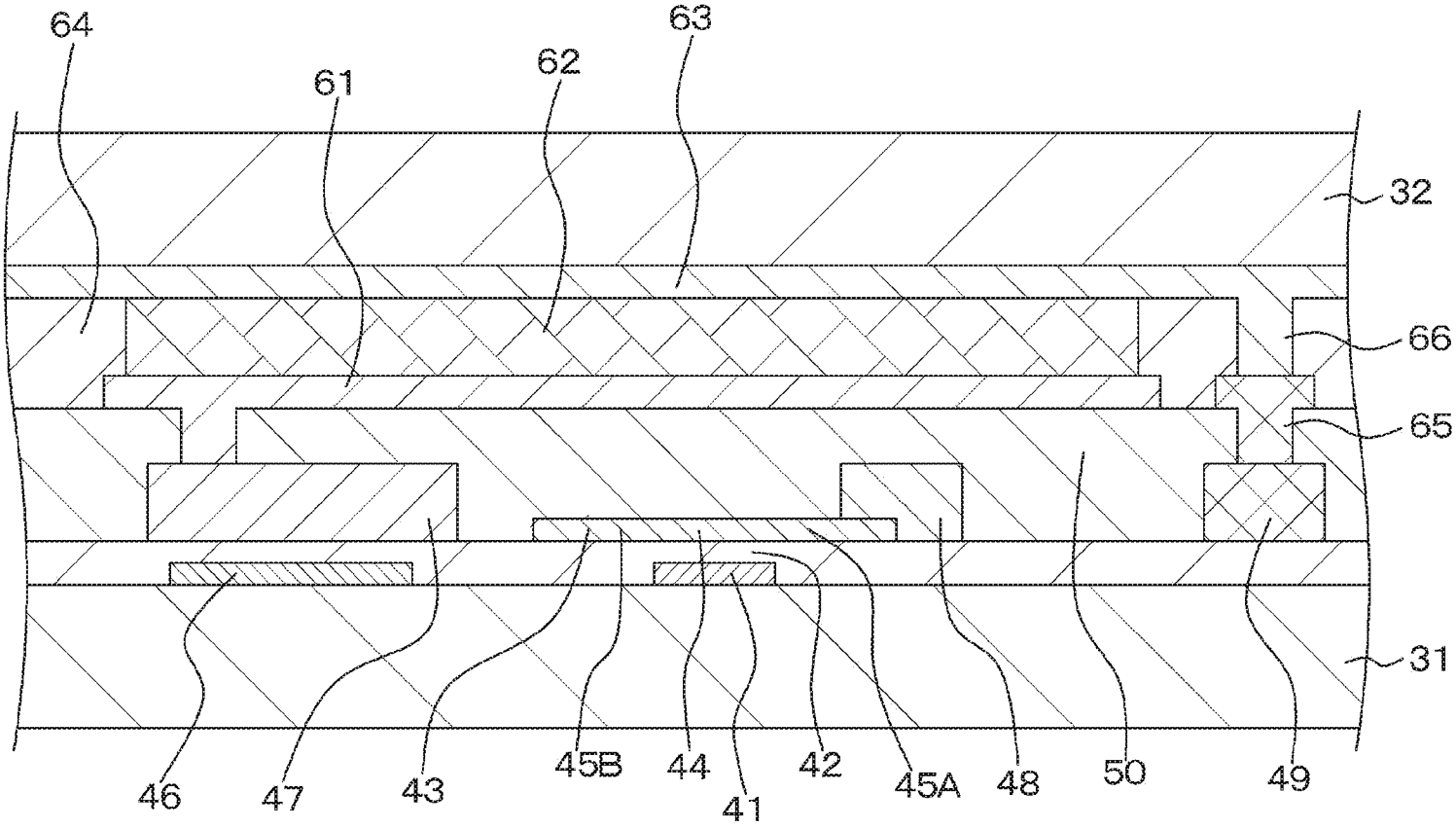
FIG. 2 is a schematic partial cross-sectional view illustrating a part including a display element in the display unit.

Here, an arrangement relationship among the light-emitting unit ELP, the transistors, and the like will be described. FIG. 2 is a schematic partial cross-sectional view illustrating a part including a display element in the display unit.

The transistors and the capacitor units are formed on a support base 31, and the light-emitting unit ELP is formed above the transistors and the capacitor units through, for example, an interlayer insulating layer 50. In addition, through the unillustrated fifth switching transistor $TR_5$ and contact holes, the other source/drain region of the driving transistor $TR_{Drv}$ is connected to the anode electrode with which the light-emitting unit ELP is provided. It should be noted that FIG. 2 Illustrates only the driving transistor $TR_{Drv}$. The other transistors are hidden and do not appear.

The driving transistor $TR_{Drv}$ includes a gate electrode 41, a gate insulating layer 42, one source/drain region 45A that is provided in a semiconductor layer 43, the other source/drain region 45B, and a channel-forming region 44 that corresponds to a part of the semiconductor layer 43 between the one source/drain region 45A and the other source/drain region 45B. Meanwhile, the first capacitor $C_{S1}$ and the second capacitor $C_{S2}$ that constitute the capacitor unit CP each include a pair of electrodes that sandwiches a dielectric layer including an extending part of the gate insulating layer 42. For example, the second capacitor $C_{S2}$ includes one electrode 46, the dielectric layer including the extending part of the gate insulating layer 42, and the other electrode 47. The second capacitor $C_{S2}$ is hidden and does not appear.

The gate electrode 41, a part of the gate insulating layer 42, and the one electrode 46 that constitutes the capacitor unit CP are formed on the support base 31. The one source/drain region 45A of the driving transistor $TR_{Drv}$ is connected to a wiring line 48 (corresponding to the electric supply line DS). The driving transistor $TR_{Drv}$, the capacitor unit CP, and the like are covered with the interlayer insulating layer 50. The light-emitting unit ELP that includes the anode electrode 61, the positive hole transport layer, the light-emitting layer, the electron transport layer, and the cathode electrode 63 is provided on the interlayer insulating layer 50. It should be noted that the positive hole transport layer, the light-emitting layer, and the electron transport layer are illustrated as one layer 62 in the figure. A second interlayer insulating layer 64 is provided on a part of the interlayer insulating layer 50, the part not being provided with the light-emitting unit ELP. A transparent substrate 32 is arranged on the second interlayer insulating layer 64 and on the cathode electrode 63. Light emitted in the light-emitting layer passes through the substrate 32, and is then emitted to the outside. In addition, through contact holes 66 and 65 with which the second interlayer insulating layer 64 and the interlayer insulating layer 50 are provided respectively, the cathode electrode 63 is connected to a wiring line 49 (corresponding to the common electric supply line that supplies the voltage $V_{cath}$) provided on the extending part of the gate insulating layer 42.

A voltage of the driving transistor $TR_{Drv}$ shown in FIG. 1 is set so as to operate in a saturation region in a light emitting state of the display element 11, and is driven so as to cause a drain current $I_{ds}$ to flow according to the following equation (1). As described above, in the light emitting state of the display element 11, one source/drain region of the driving transistor $TR_{Drv}$ functions as a drain region, and the other source/drain region functions as a source region. For convenience of explanation, hereinafter, there is a case where one source/drain region of the driving transistor $TR_{Drv}$ is merely called "drain region", and the other source/drain region is merely called "source region". Incidentally, it is assumed that μ: Effective mobility
L: Channel length
W: Channel width
$V_{gs}$: Gate electrode voltage (voltage between the gate and the source) for the source region
$V_{th}$: Threshold voltage
$C_{ox}$: (Relative permittivity of gate insulating layer)× (vacuum permittivity)/(thickness of gate insulating layer)

$$k \cong (1/2)\cdot(W/L)\cdot C_{ox}$$

$$I_{ds}=k\cdot\mu\cdot(V_{gs}-V_{th})^2 \quad (1)$$

This drain current $I_{ds}$ flows through the light-emitting unit ELP, which causes the light-emitting unit ELP of the display element 11 to emit light. Moreover, light intensity of the light-emitting unit ELP while the drain current $I_{ds}$ flows is controlled on the basis of a value of this drain current $I_{ds}$.

The display device 1 has been outlined as above. The above explanation is basically similar to those of the display devices in the other embodiments as described later. It should be noted that, for example, a difference in circuit configuration between the display elements will be described in detail in the explanation of each embodiment.

Next, the operation of the display device 1 will be described with reference to the accompanying drawings.

Figure 3:
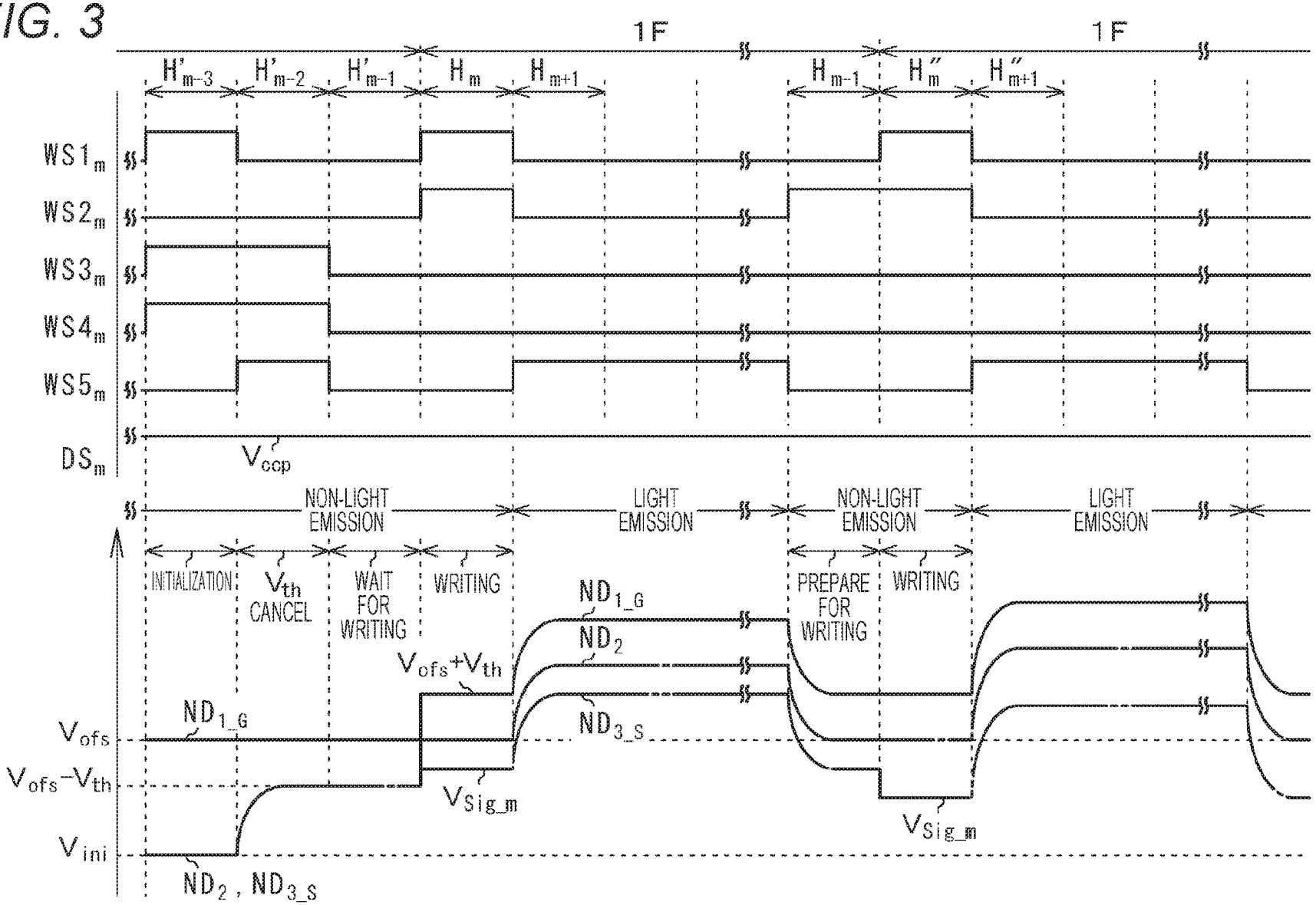
FIG. 3 is a schematic timing chart illustrating the operation of the display device according to the first embodiment, more specifically, the operation of the (n, m)th display element of the display device.
Figure 4A:
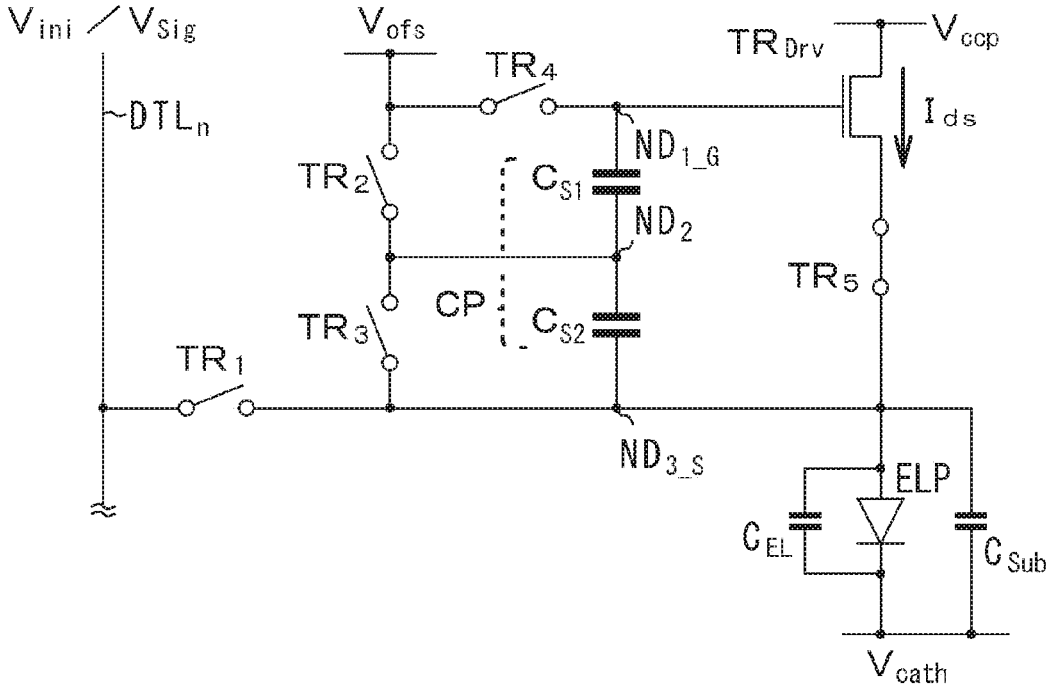
FIGS. 4A and 4B are drawings each schematically illustrating conducting state/non-conducting state and the like of each transistor that is included in a driving circuit of the display element of the display device according to the first embodiment.
Figure 4B:
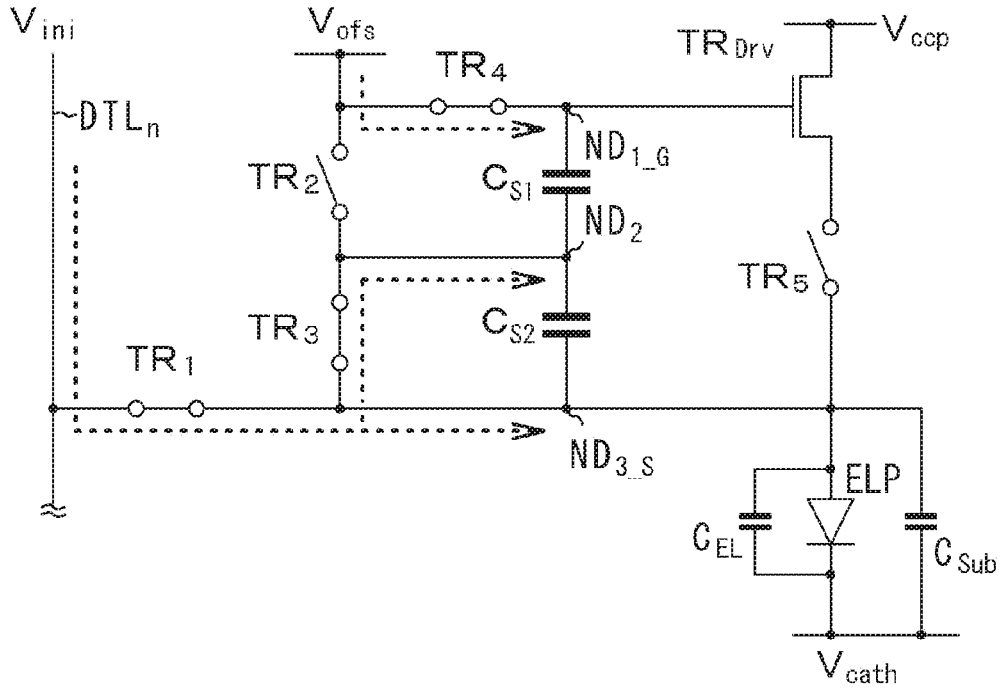

FIG. 3 is a schematic timing chart illustrating the operation of the display device according to the first embodiment, more specifically, the operation of the (n, m)th display element of the display device. FIGS. 4A, 4B, 5A, 5B, 6A, 6B, 7A, 7B, 8A, and 8B are drawings each schematically illustrating conducting state/non-conducting state and the like of each transistor that is included in a driving circuit of the display element of the display device according to the first embodiment.

The operation of the display device 1 will be outlined as below. In the present disclosure, in a state in which a voltage corresponding to the threshold voltage $V_{th}$ of the driving transistor $TR_{Drv}$ is held by the first capacitor $C_{S1}$, the drive unit 20 writes the video signal voltage $V_{Sig}$ to the second capacitor $C_{S2}$ through the first switching transistor $TR_1$ in a conducting state. The drive unit 20 successively scans the display elements 11 of the display unit 10, and in a part of a plurality of consecutive frames, performs the operation of causing a voltage corresponding to the threshold voltage $V_{th}$ of the driving transistor $TR_{Drv}$ to be held in the first capacitor $C_{S1}$.

In the first embodiment, the drive unit 20 applies the reference voltage $V_{ofs}$ to the first node $ND_{1_G}$, and applies the initialization voltage $V_{ini}$ to the second node $ND_2$ and the third node $ND_{3_S}$, thereby setting the voltage held by the capacitor unit CP so as to exceed the threshold voltage $V_{th}$ of the driving transistor $TR_{Drv}$. Subsequently, the drive unit 20 applies the reference voltage $V_{ofs}$ to the first node $ND_{1_G}$, and applies the driving voltage $V_{ccp}$ to one source/drain region of the driving transistor $TR_{Drv}$ in a state in which the second node $ND_2$ and the third node $ND_{3_S}$ electrically conduct with each other, so as to cause electric potentials of the second node $ND_2$ and the third node $ND_{3_S}$ to get close to a voltage obtained by subtracting the threshold voltage $V_{th}$ of the driving transistor $TR_{Drv}$ from the reference voltage $V_{ofs}$, thereby causing a voltage corresponding to the threshold voltage $V_{th}$ of the driving transistor $TR_{Drv}$ to be held in the first capacitor $C_{S1}$. In the first embodiment, the initialization voltage $V_{ini}$ is supplied from the data line DTL through the first switching transistor $TR_1$.

In the following explanations, voltage values or electric potential values are given as follows. However, the values are strictly given for the purpose of explanation, and voltages or electric potentials are not limited to these values.

$V_{ini}$: Initialization voltage . . . −3 V
$V_{ofs}$: Reference voltage . . . 0 V
$V_{ccp}$: Driving voltage for causing a current to flow through the light-emitting unit ELP . . . 15 V
$V_{Sig}$: Video signal voltage . . . −2 V to 0 V
$V_{th}$: Threshold voltage of the driving transistor $TR_{Drv}$ . . . 1 V
$V_{cath}$: Voltage applied to the cathode electrode of the light-emitting unit ELP 0 V
$V_{th\text{-}EL}$: Threshold voltage of the light-emitting unit ELP . . . 2 V

[Time period: Before $H'_{m-4}$] (refer to FIG. 4A)

This time period is before the [time period $H'_{m-3}$] shown in FIG. 3, and is a time period during which the (n, m)th display element 11 continues light emission after the completion of various processings last time. The fifth switching transistor $TR_5$ is in a conducting state, and the first to fourth switching transistors $TR_1$ to $TR_4$ are in a non-conducting state. Although not illustrated in FIG. 3, the first to fourth control lines $WS1_m$ to $WS4_m$ are at a low level, and the fifth control line $WS5_m$ is at a high level. The drain current $I_{ds}$ represented by the above-described equation (1) flows through the light-emitting unit ELP, and thus the light-emitting unit ELP is in a light emitting state.

[Time period: $H'_{m-3}$] (refer to FIGS. 3 and 4B)

Initialization processing is performed during this time period. In other words, by applying the reference voltage $V_{ofs}$ to the first node $ND_{1_G}$, and by applying the initialization voltage $V_{ini}$ to the second node $ND_2$ and the third node $ND_{3_S}$, the voltage held by the capacitor unit CP is set so as to exceed the threshold voltage $V_{th}$ of the driving transistor $TR_{Drv}$.

More specifically, the fifth control line $WS5_m$ is switched to a low level. The fifth switching transistor $TR_5$ is in a non-conducting state. The driving transistor $TR_{Drv}$ and the light-emitting unit ELP are electrically separated from each other, and therefore the light-emitting unit ELP switches off the light. In addition, the first control line $WS1_m$, the third control line $WS3_m$, and the fourth control line $WS4_m$ are switched to a high level. The first switching transistor $TR_1$, the third switching transistor $TR_3$, and the fourth switching transistor $TR_4$ are in a conducting state. The second control line $WS2_m$ maintains a previous state, and therefore the second switching transistor $TR_2$ is in a non-conducting state.

The reference voltage $V_{ofs}$ is applied to the first node $ND_{1_G}$ through the fourth switching transistor $TR_4$ in the conducting state. In addition, the initialization voltage $V_{ini}$ is applied to the third node $ND_{3_S}$ from the data line DTL through the first switching transistor $TR_1$ in the conducting state. The third switching transistor $TR_3$ is in the conducting state, and therefore the initialization voltage $V_{ini}$ is also applied to the second node $ND_2$ from the data line DTL. The voltage held by the capacitor unit CP becomes $(V_{ofs}-V_{ini})$, and exceeds the threshold voltage $V_{th}$ of the driving transistor $TR_{Drv}$.

[Time period: $H'_{m-2}$] (refer to FIGS. 3, 5A, and 5B)

Threshold voltage cancel processing is performed during this time period. In other words, by applying the reference voltage $V_{ofs}$ to the first node $ND_{1_G}$, and by applying the driving voltage $V_{ccp}$ to one source/drain region of the driving transistor $TR_{Drv}$ in a state in which the second node $ND_2$ and the third node $ND_{3_S}$ electrically conduct with each other, electric potentials of the second node $ND_2$ and the third node $ND_{3_S}$ are caused to get close to a voltage obtained by subtracting the threshold voltage $V_{th}$ of the driving transistor $TR_{Drv}$ from the reference voltage $V_{ofs}$.

More specifically, the first control line $WS1_m$ is switched to a low level, and the fifth control line $WS5_m$ is switched to a high level. The other control lines maintain the previous state. The reference voltage $V_{ofs}$ is applied to the first node $ND_{1_G}$ through the fourth switching transistor $TR_4$. In addition, the second node $ND_2$ and the third node $ND_{3_S}$ are in a conducting state through the third switching transistor $TR_3$.

The voltage held by the capacitor unit CP exceeds the threshold voltage $V_{th}$ of the driving transistor $TR_{Drv}$, and therefore, through the driving transistor $TR_{Drv}$, a current from the electric supply line DS flows through the third node $ND_{3_S}$. As the result, the electric potential of the third node $ND_{3_S}$ increases toward an electric potential obtained by subtracting the threshold voltage $V_{th}$ of the driving transistor $TR_{Drv}$ from the reference voltage $V_{ofs}$. The electric potential of the second node $ND_2$ that is in a conducting state with the third node $ND_{3_S}$ also similarly increases (refer to FIG. 5A).

Figure 5A:
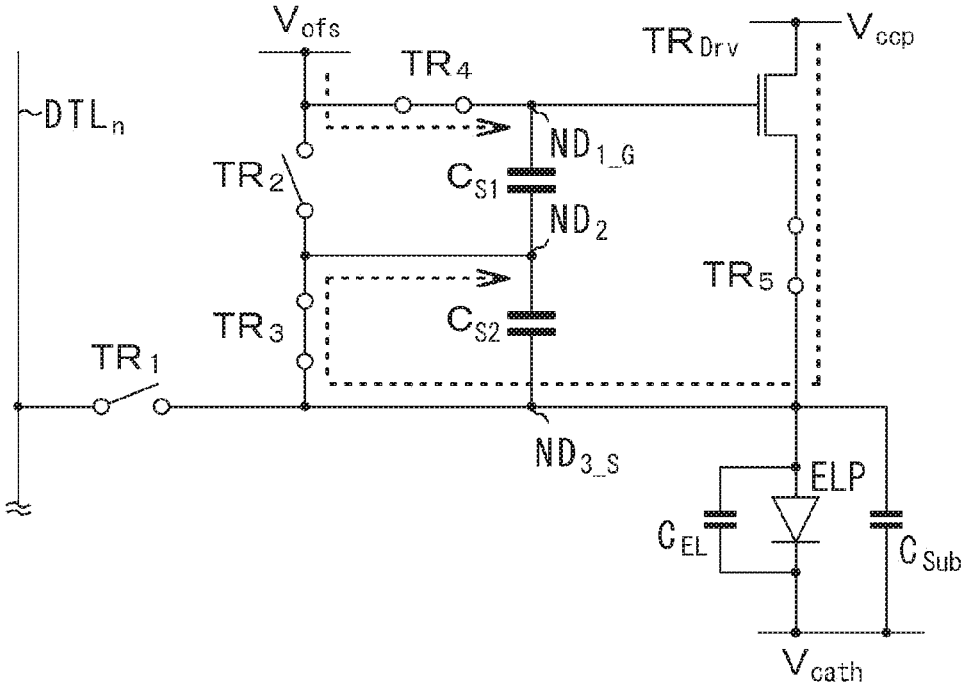
Figure 5B:
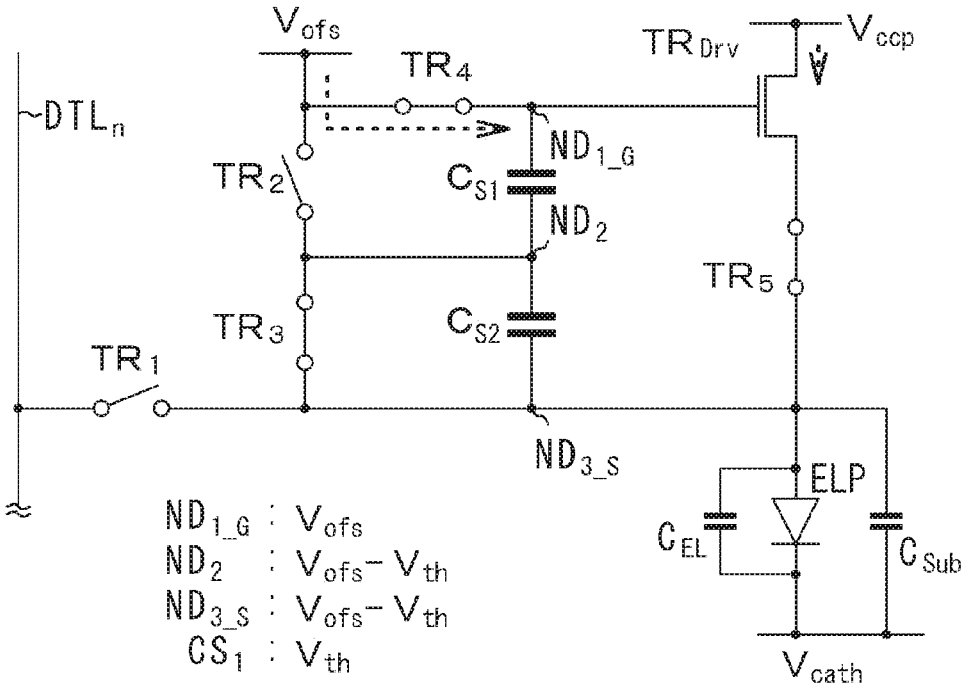
Figure 6A:
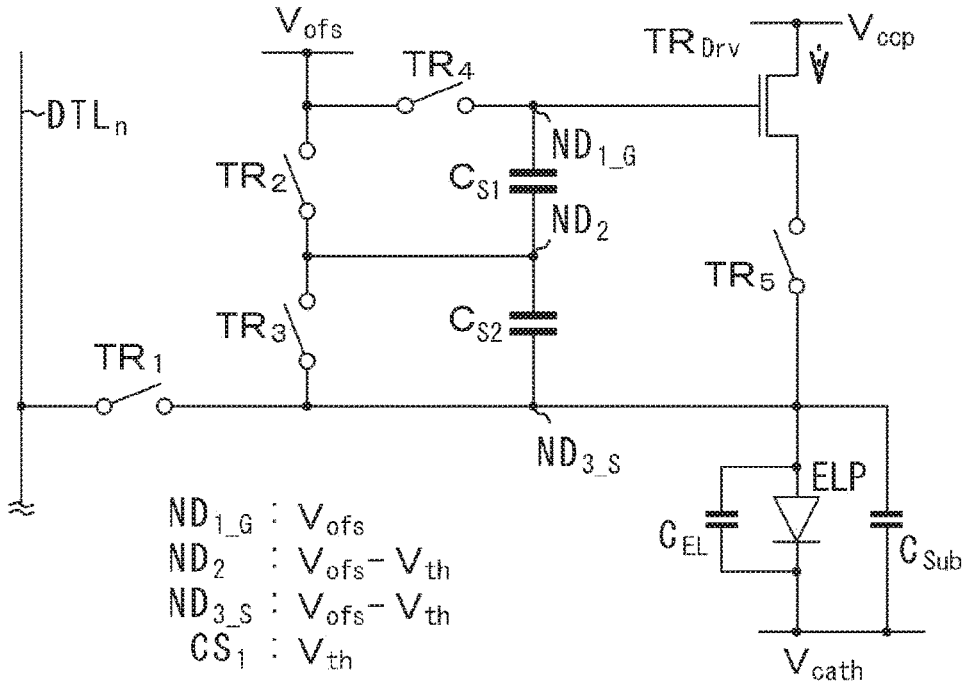
Figure 6B:
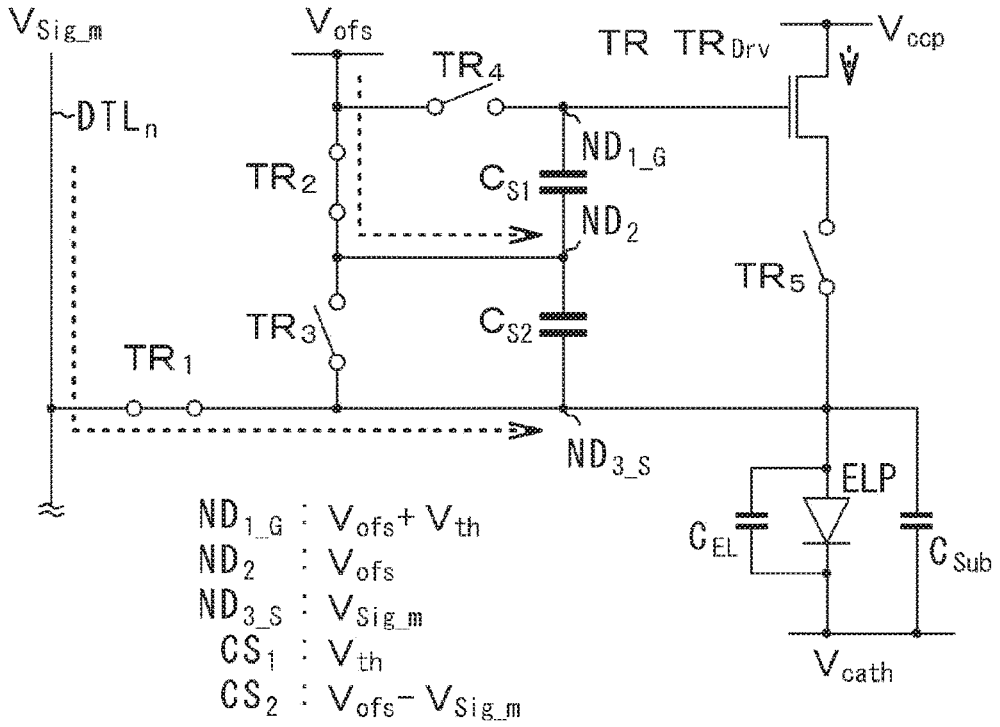
Figure 7A:
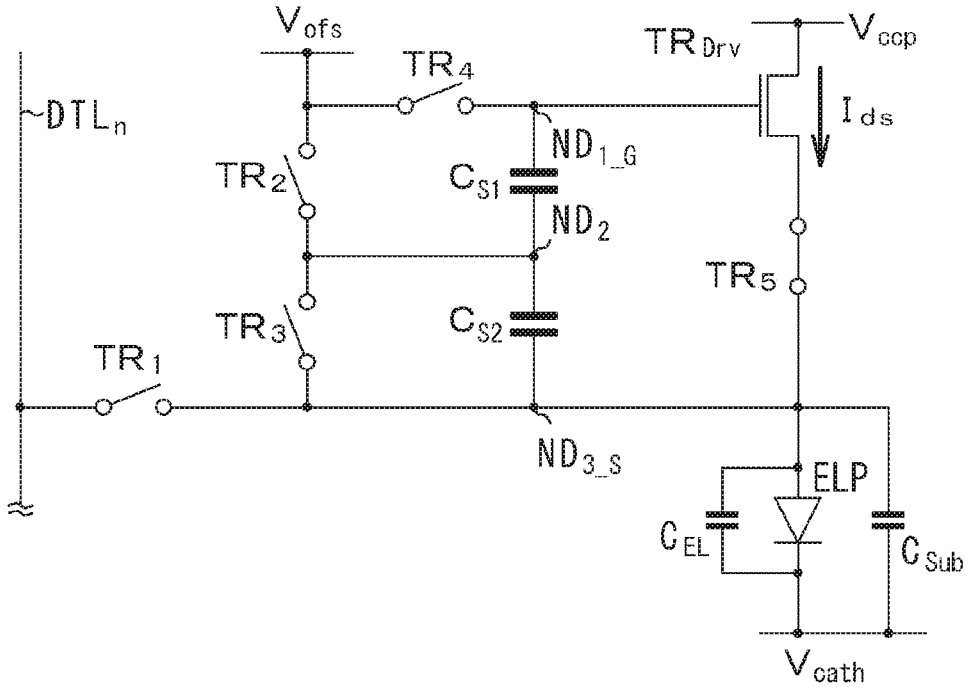
Figure 7B:
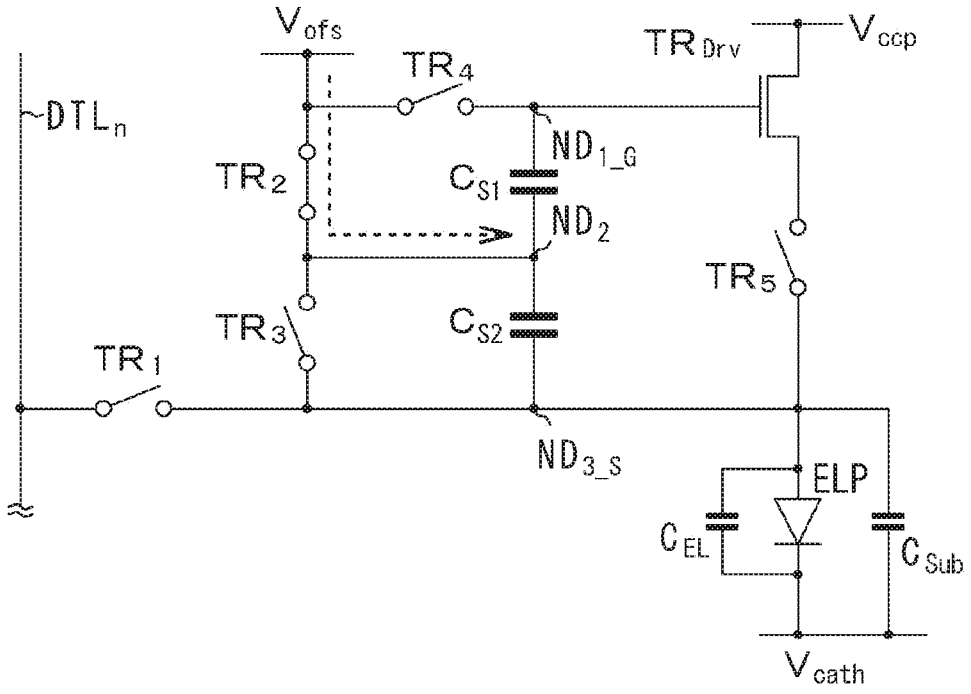
Figure 8A:
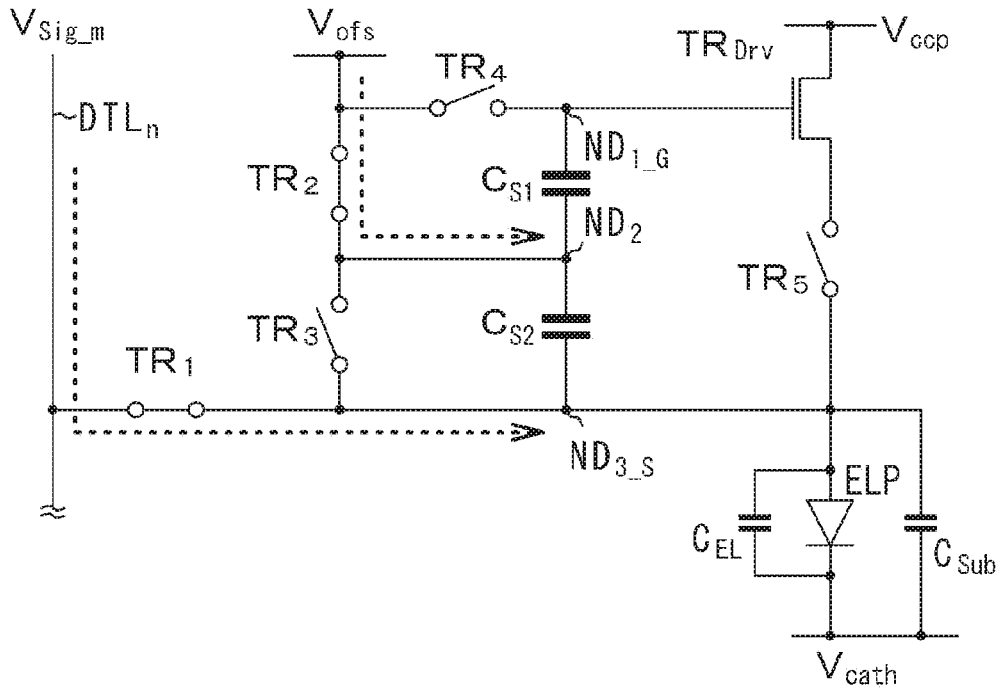
Figure 8B:
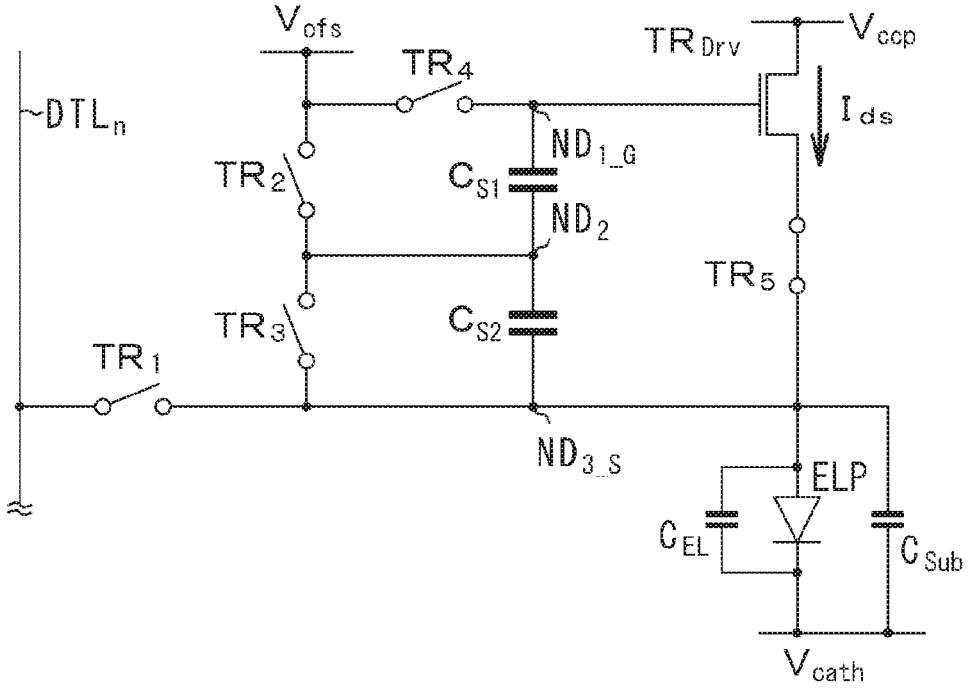

If this time period is sufficiently long, an electric potential difference between the gate electrode of the driving transistor $TR_{Drv}$ and the other source/drain region reaches $V_{th}$, and the driving transistor $TR_{Drv}$ enters the non-conducting state (refer to FIG. 5B). At this point of time, an electric potential difference between the first node $ND_{1_G}$ and the third node $ND_{3_S}$ becomes $(V_{ofs}-V_{th})$. The electric potential of the first node $ND_{1_G}$ is $V_{ofs}$, and electric potentials of the second node $ND_2$ and the third node $ND_{3_S}$ are both $(V_{ofs}-V_{th})$. Therefore, the voltage $V_{th}$ is held in the first capacitor $C_{S1}$. Electric potentials at both ends of the second capacitor $C_{S2}$ are the same, and thus the voltage held is 0 V.

Incidentally, for convenience of explanation, the explanation is made on the assumption that the driving transistor $TR_{Drv}$ is already in the non-conducting state during this time period. However, the present disclosure is not limited to this. A mode may be employed in which the time period ends before the electric potential difference between the gate electrode of the driving transistor $TR_{Drv}$ and the other source/drain region reaches $V_{th}$.

[Time period: $H'_{m-1}$] (refer to FIGS. 3 and 6A)

This time period is a time period immediately before performing the next write processing, and a time period for waiting for writing. The third control line $WS3_m$, the fourth control line $WS4_m$, and the fifth control line $WS5_m$ are switched to a low level. The third switching transistor $TR_3$, the fourth switching transistor $TR_4$, and the fifth switching transistor $TR_5$ enter the non-conducting state. In addition, the first control line $WS1_m$ and the second control line $WS2_m$ maintain the previous state. The first to fifth switching transistors $TR_1$ to $TR_5$ are in the non-conducting state. If the driving transistor $TR_{Drv}$ is already in the non-conducting state in the [time period: $H'_{m-2}$], electric potentials of the first node $ND_{1_G}$, the second node $ND_2$ and the third node $ND_{3_S}$ do not substantially change (refer to FIG. 6A). It should be noted that this time period may be omitted.

[Time period: $H_m$] (refer to FIGS. 3 and 6B)

A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ and the second control line $WS2_m$ are switched to a high level. The other control lines maintain the previous state. The first switching transistor $TR_1$ and the second switching transistor $TR_2$ enter the conducting state. The other switching transistors are in the non-conducting state.

In the immediately preceding [time period: $H'_{m-1}$], an electric potential of the first node $ND_{1_G}$ is $V_{ofs}$, an electric potential of the second node $ND_2$ is $(V_{ofs}-V_{th})$, and the voltage $V_{th}$ is held in the first capacitor $C_{S1}$. When the second switching transistor $TR_2$ enters the conducting state, the reference voltage $V_{ofs}$ is applied to the second node $ND_2$. Therefore, the electric potential of the second node $ND_2$ changes from $(V_{ofs}-V_{th})$ to $V_{ofs}$. Here, the fourth switching transistor $TR_4$ is in the non-conducting state. Therefore, if an influence exerted by parasitic capacitance or the like can be ignored, the first capacitor $C_{S1}$ maintains the previous state in which the voltage $V_{th}$ is held. Therefore, the electric potential of the first node $ND_{1_G}$ becomes $(V_{ofs}+V_{th})$ from $V_{ofs}$. In addition, the video signal voltage $V_{Sig_m}$ is applied to the third node $ND_{3_S}$ through the first switching transistor $TR_1$ in the conducting state. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}+V_{ofs}-V_{Sig_m})$.

[Time period: $H_{m+1}$] (refer to FIGS. 3 and 7A)

A light emission period ranges from this time period until the starting period of a scanning period [time period: $H_{m-1}$] immediately before the scanning period $H''_m$ in the m-th row in the next frame.

More specifically, the first control line $WS1_m$ and the second control line $WS2_m$ are switched to a low level, and the fifth control line $WS5_m$ is switched to a high level. The fifth switching transistor $TR_5$ is in the conducting state, and the other switching transistors are in the non-conducting state.

The fifth switching transistor $TR_5$ is in the conducting state, and therefore the voltage $V_{gs}$ between the gate and the source of the driving transistor $TR_{Drv}$ becomes a voltage $(V_{th}+V_{ofs}-V_{Sig_m})$ held by the capacitor unit CP. In addition, the driving voltage $V_{ccp}$ is applied to the source/drain region of one end of the driving transistor $TR_{Drv}$, and therefore a current flows towards the light-emitting unit ELP through the driving transistor $TR_{Drv}$ and the fifth switching transistor $TR_5$, which causes an electric potential of the third node $ND_{3_S}$ to increase. At this point of time, a phenomenon similar to that of so-called a bootstrap circuit occurs in the gate electrode of the driving transistor $TR_{Drv}$. Basically, the electric potential of the first node $ND_{1_G}$ increases so as to maintain the voltage $V_{gs}$ between the gate and the source.

In addition, the electric potential of the third node $ND_{3_S}$ increases, and exceeds $(V_{th\text{-}EL}+V_{cath})$, and therefore the light-emitting unit ELP starts light emission. At this point of time, a current flowing through the light-emitting unit ELP is the drain current $I_{ds}$ that flows from the drain region of the driving transistor $TR_{Drv}$ to the source region, and thus can be represented by equation (1). Here, $V_{gs}$ is $(V_{th}+V_{ofs}-V_{Sig_m})$, and therefore the drain current $I_{ds}$ can be represented as the following equation (2).

$$I_{ds}=k\cdot\mu\cdot(V_{ofs}-V_{Sig_m})^2 \quad (2)$$

Therefore, the current $I_{ds}$ flowing through the light-emitting unit ELP does not depend on the threshold voltage $V_{th}$ of the driving transistor $TR_{Drv}$. In other words, since the influence exerted by the dispersion in threshold voltage $V_{th}$ of the driving transistor $TR_{Drv}$ of the display element 11 is canceled, the uneven brightness is reduced.

[Time period: $H_{m-1}$] (refer to FIGS. 3 and 7B)

This time period is a time period immediately before performing the next write processing. The voltage $V_{th}$ is already held in the first capacitor $C_{S1}$, and thus the operation corresponding to the above-described [time period: $H'_{m-3}$] and [time period: $H'_{m-2}$] is omitted.

More specifically, the second control line $WS2_m$ is switched to a high level, and the fifth control line $WS5_m$ is switched to a low level. The second switching transistor $TR_2$ is in the conducting state, and the other switching transistors are in the non-conducting state.

The fifth switching transistor $TR_5$ is in the non-conducting state, and therefore a current does not flow through the light-emitting unit ELP. Therefore, the light-emitting unit ELP switches off the light. In addition, the reference voltage $V_{ofs}$ is applied to the second node $ND_2$, and therefore the electric potential of the second node $ND_2$ decreases to become $V_{ofs}$. The first node $ND_{1_G}$ is in a floating state, and therefore the electric potential of the first node $ND_{1_G}$ decreases according to the change in potential of the second node $ND_2$. The first capacitor $C_{S1}$ maintains a state in which the voltage $V_{th}$ is held. Incidentally, the electric potential of the third node $ND_{3_S}$ further decreases from $(V_{th\text{-}EL}+V_{cath})$ to some extent.

[Time period: $H''_m$] (refer to FIGS. 3 and 8A)

The next frame starts from this time period. A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ is switched to the high level. The other control lines maintain the previous state. The first switching transistor $TR_1$ and the second switching transistor $TR_2$ enter the conducting state. The other switching transistors are in the non-conducting state.

In the immediately preceding [time period: $H'_{m-1}$], the voltage $V_{th}$ is held in the first capacitor $C_{S1}$ in a state in which the electric potential of the second node $ND_2$ is $V_{ofs}$. Further, the video signal voltage $V_{Sig_m}$ is applied to the third node $ND_{3_S}$ through the first switching transistor $TR_1$ in the conducting state. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}+V_{ofs}-V_{Sig_m})$.

[Time period: $H''_{m+1}$] (refer to FIGS. 3 and 8B)

The next frame light emission period starts from this time period. More specifically, the first control line $WS1_m$ and the second control line $WS2_m$ are switched to a low level, and the fifth control line $WS5_m$ is switched to a high level. The fifth switching transistor $TR_5$ is in the conducting state, and the other switching transistors are in the non-conducting state. The specific operation is similar to the operation described in the above-described [time period: $H_{m+1}$], and therefore the description thereof will be omitted.

As described above, if the operation of holding the threshold voltage $V_{th}$ in the first capacitor $C_{S1}$ is performed in a certain frame, this operation can be omitted in a subsequent frame. Therefore, the power consumption can be further reduced while canceling the influence exerted by the dispersion in threshold voltage $V_{th}$ of the driving transistor $TR_{Drv}$.

It should be noted that the operation described in the [time period: $H'_{m-3}$] to the [time period: $H'_{m-1}$] may be performed, for example, once every two frames, or once every five to ten frames. From the viewpoint of reducing the power consumption, it is preferable to reduce a frequency of frames in which the operation of holding a voltage corresponding to the threshold voltage $V_{th}$ of the driving transistor $TR_{Drv}$ in the first capacitor $C_{S1}$ is performed. Meanwhile, the voltage held in the first capacitor $C_{S1}$ changes due to leakage or the like. Therefore, from the viewpoint of, for example, reducing uneven brightness, it is preferable to maintain a certain level of frequency. A level of frequency may be set as appropriate according to, for example, specifications of the display device. The same applies to the other embodiments as described later.

Second Embodiment

The second embodiment also relates to the display device, the display device driving method, and the display element according to the present disclosure.

In the first embodiment, the initialization voltage $V_{ini}$ is supplied from the data line $DTL_n$ through the first switching transistor $TR_1$. In contrast to this, in the second embodiment, the initialization voltage $V_{ini}$ is supplied from the electric supply line DS through the driving transistor $TR_{Drv}$. The second embodiment mainly differs from the first embodiment in the above point.

With respect to a schematic diagram of a display device 2 according to the second embodiment, the display device 1 has only to be replaced with the display device 2 in FIG. 1. It should be noted that although the operation of the drive unit differs from the operation in the first embodiment, a configuration thereof does not largely differ, and therefore the same reference numerals are used to denote components of the drive unit. The same applies to the other embodiments as described later.

In the second embodiment, the data-line drive unit 21 supplies the video signal voltage $V_{Sig}$ to the data line $DTL_n$. The power supply unit 22 supplies the initialization voltage $V_{ini}$ and the driving voltage $V_{ccp}$ to the electric supply line DS.

Figure 9:
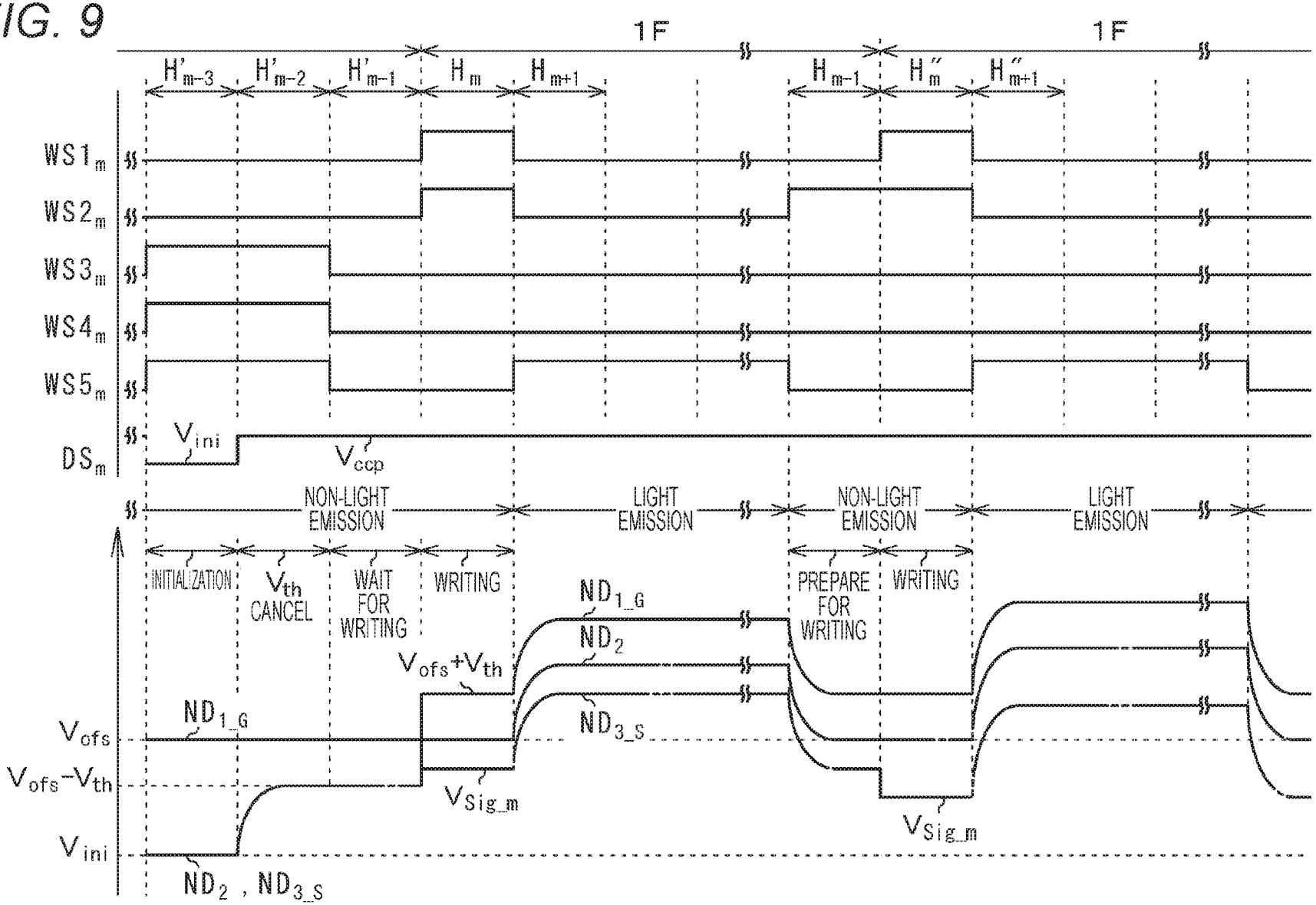
FIG. 9 is a schematic timing chart illustrating the operation of a display device according to a second embodiment, more specifically, the operation of the (n, m)th display element of the display device.
Figure 10A:
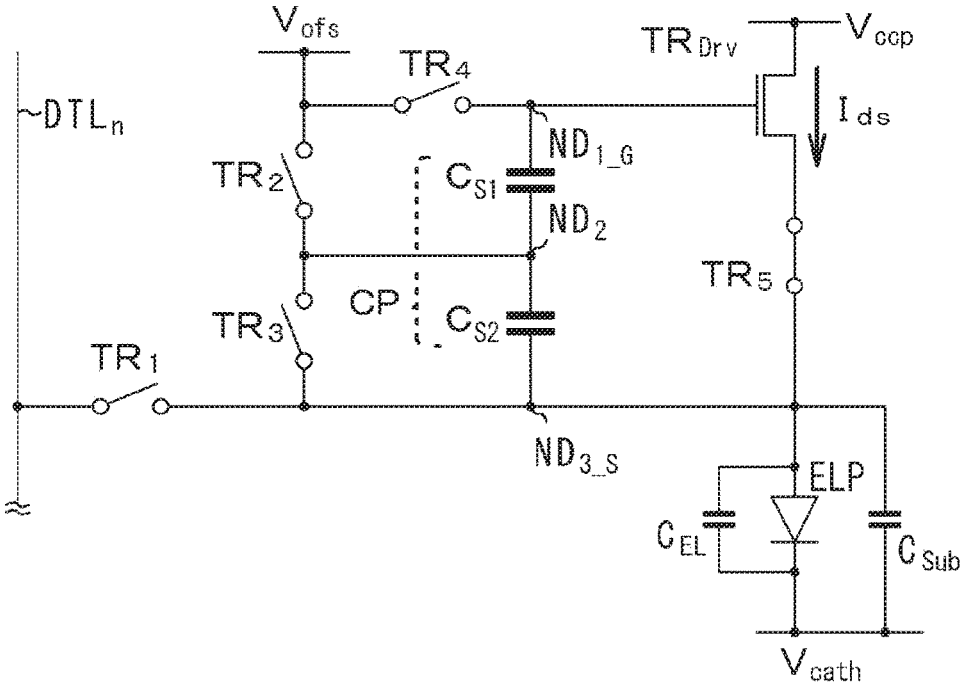
FIGS. 10A and 10B are drawings each schematically illustrating conducting state/non-conducting state and the like of each transistor that is included in a driving circuit of the display element of the display device according to the second embodiment.
Figure 10B:
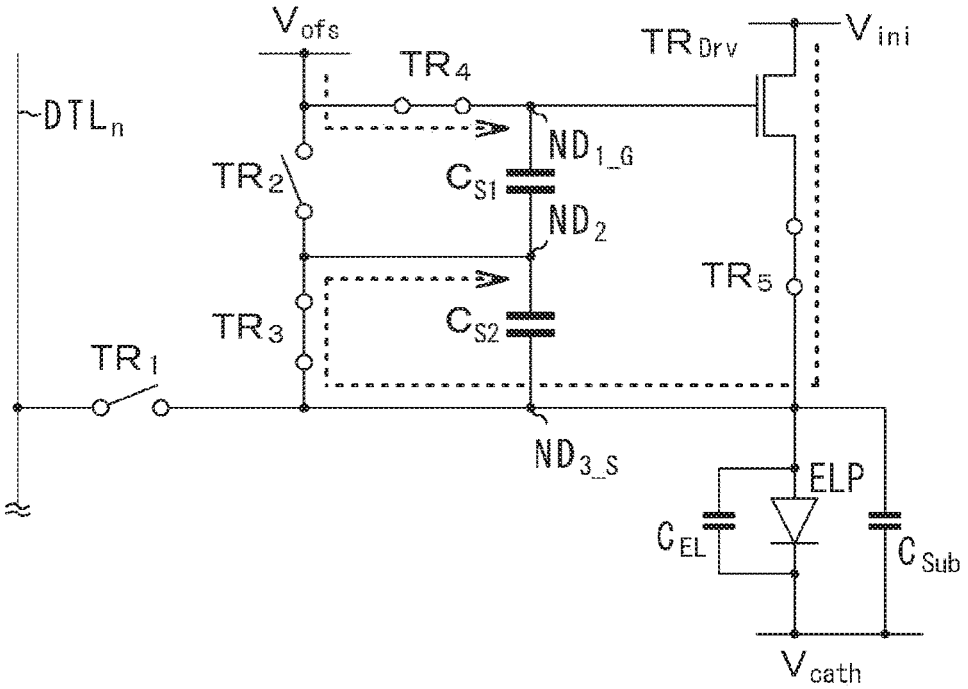

FIG. 9 is a schematic timing chart illustrating the operation of the display device according to the second embodiment, more specifically, the operation of the (n, m)th display element of the display device. FIGS. 10A and 10B show drawings each schematically illustrating conducting state/non-conducting state and the like of each transistor that is included in a driving circuit of the display element of the display device according to the second embodiment.

[Time period: Before $H'_{m-4}$] (refer to FIG. 10A)

This time period is before the [time period $H'_{m-3}$] shown in FIG. 9, and is a time period during which the (n, m)th display element 11 continues light emission after the completion of various processings last time. The driving voltage $V_{ccp}$ is supplied to the electric supply line $DS_m$. The first to fourth switching transistors $TR_1$ to $TR_4$ are in the non-conducting state, and the fifth switching transistor $TR_5$ is in the conducting state. Although not illustrated in FIG. 9, the first to fourth control lines $WS1_m$ to $WS4_m$ are at a low level, and the fifth control line $WS5_m$ is at a high level. The drain current $I_{ds}$ represented by the above-described equation (1) flows through the light-emitting unit ELP, and thus the light-emitting unit ELP is in a light emitting state.

[Time period: $H'_{m-3}$] (refer to FIGS. 9, and 10B)

Initialization processing is performed during this time period. In other words, by applying the reference voltage $V_{ofs}$ to the first node $ND_{1_G}$, and by applying the initialization voltage $V_{ini}$ to the second node $ND_2$ and the third node $ND_{3_S}$, the voltage held by the capacitor unit CP is set so as to exceed the threshold voltage $V_{th}$ of the driving transistor $TR_{Drv}$.

More specifically, the voltage supplied to the electric supply line $DS_m$ is switched to the initialization voltage $V_{ini}$. In addition, the third control line $WS3_m$ and the fourth control line $WS4_m$ are switched to a high level. The other control lines maintain the previous state. The third to fifth switching transistors $TR_3$ to $TR_5$ are in the conducting state. The first switching transistor $TR_1$ and the second switching transistor $TR_2$ are in the non-conducting state.

The second node $ND_2$ and the third node $ND_{3_S}$ are in the conducting state through the third switching transistor $TR_3$. The reference voltage $V_{ofs}$ is applied to the first node $ND_{1_G}$ through the fourth switching transistor $TR_4$. The fifth switching transistor $TR_5$ is in the conducting state.

The voltage $V_{gs}$ between the gate and the source of the driving transistor $TR_{Drv}$ exceeds the threshold voltage $V_{th}$. Therefore, the initialization voltage $V_{ini}$ is applied from the electric supply line $DS_m$ to the third node $ND_{3_S}$, and to the second node $ND_2$ that is in the conducting state with the third node $ND_{3_S}$, through the driving transistor $TR_{Drv}$ and the fifth switching transistor $TR_5$. The voltage held by the capacitor unit CP becomes $(V_{ofs}-V_{ini})$, and exceeds the threshold voltage $V_{th}$ of the driving transistor $TR_{Drv}$. In addition, the electric potential of the third node $ND_{3_S}$ does not exceed $(V_{th\text{-}EL}+V_{cath})$, and therefore the light-emitting unit ELP switches off the light.

The operation after the [time period: $H'_{m-2}$] shown in FIG. 9 is similar to the operation described in the first embodiment, and therefore the description thereof will be omitted.

Third Embodiment

The third embodiment also relates to the display device, the display device driving method, and the display element according to the present disclosure.

In the first and second embodiments described above, the driving transistor $TR_{Drv}$ and the light-emitting unit ELP are connected through the switching transistor. The electric power is also consumed by a current flowing through the switching transistor, and therefore, from the viewpoint of attempting to achieve the electric power saving of the display device, it is preferable to directly connect the driving transistor $TR_{Drv}$ to the light-emitting unit ELP. In the third embodiment, the driving transistor $TR_{Drv}$ and the light-emitting unit ELP are configured to be directly connected to each other.

FIG. 11 is a conceptual diagram illustrating a display device according to the third embodiment.

A display device 3 is also provided with: the display unit 10 in which the display elements 11 are arranged; and the drive unit 20 for driving the display unit 10. In the second embodiment, the data-line drive unit 21 supplies the video signal voltage $V_{Sig}$ to the data line DTL. The power supply unit 22 supplies the initialization voltage $V_{ini}$ and the driving voltage $V_{ccp}$ to the electric supply line DS.

The capacitor unit CP, the driving transistor $TR_{Drv}$, and the first switching transistor $TR_1$ in the display element 11 are configured in a similar manner to that described in the first embodiment, and therefore the description thereof will be omitted. In the third embodiment as well, the drive unit 20 applies the reference voltage $V_{ofs}$ to the first node $ND_{1_G}$, and applies the initialization voltage $V_{ini}$ to the second node $ND_2$ and the third node $ND_{3_S}$, thereby setting the voltage held by the capacitor unit CP so as to exceed the threshold voltage $V_{th}$ of the driving transistor $TR_{Drv}$. Subsequently, the drive unit 20 applies the reference voltage $V_{ofs}$ to the first node $ND_{1_G}$, and applies the driving voltage $V_{ccp}$ to one source/drain region of the driving transistor $TR_{Drv}$ in a state in which the second node $ND_2$ and the third node $ND_{3_S}$ electrically conduct with each other, so as to cause electric potentials of the second node $ND_2$ and the third node $ND_{3_S}$ to get close to a voltage obtained by subtracting the threshold voltage $V_{th}$ of the driving transistor $TR_{Drv}$ from the reference voltage $V_{ofs}$, thereby causing a voltage corresponding to the threshold voltage $V_{th}$ of the driving transistor $TR_{Drv}$ to be held in the first capacitor $C_{S1}$.

In the third embodiment, the display element 11 is further provided with the second switching transistor $TR_2$, the third switching transistor $TR_3$, the fourth switching transistor $TR_4$, and the fifth switching transistor $TR_5$. In the second switching transistor $TR_2$, a reference voltage $V_{ofs}$ is applied to one source/drain region, and the other source/drain region is connected to the second node $ND_2$. In the third switching transistor $TR_3$, the reference voltage $V_{ofs}$ is applied to one source/drain region, and the other source/drain region is connected to the first node $ND_{1_G}$. The second node $ND_2$ is connected to the other source/drain region of the driving transistor $TR_{Drv}$ and one end of the light-emitting unit ELP through the fourth switching transistor $TR_4$. The third node $ND_{3_S}$ is connected to the other source/drain region of the driving transistor $TR_{Drv}$ and one end of the light-emitting unit ELP through the fifth switching transistor $TR_5$. The third switching transistor $TR_3$ is brought into the conducting state, which causes the reference voltage $V_{ofs}$ to be applied to the first node $ND_{1_G}$. The initialization voltage $V_{ini}$ is supplied from the electric supply line DS, and is applied to the second node $ND_2$ and the third node $ND_{3_S}$ through the fourth switching transistor $TR_4$ and the fifth switching transistor $TR_5$ that are in the conducting state.

Next, the operation of the display device 3 will be described with reference to the accompanying drawings.

Figure 12:
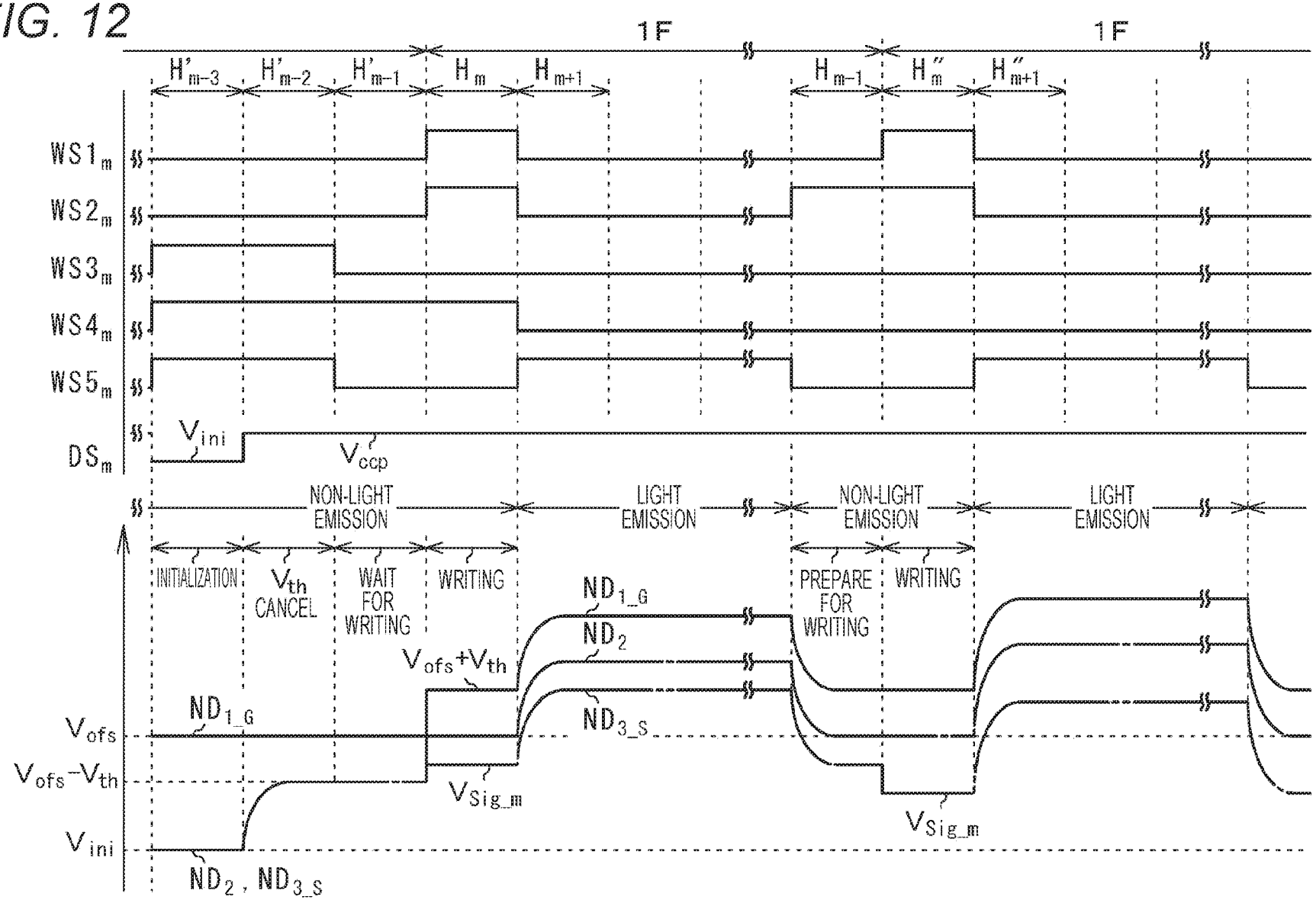
FIG. 12 is a schematic timing chart illustrating the operation of the display device according to the third embodiment, more specifically, the operation of the (n, m)th display element of the display device.
Figure 13A:
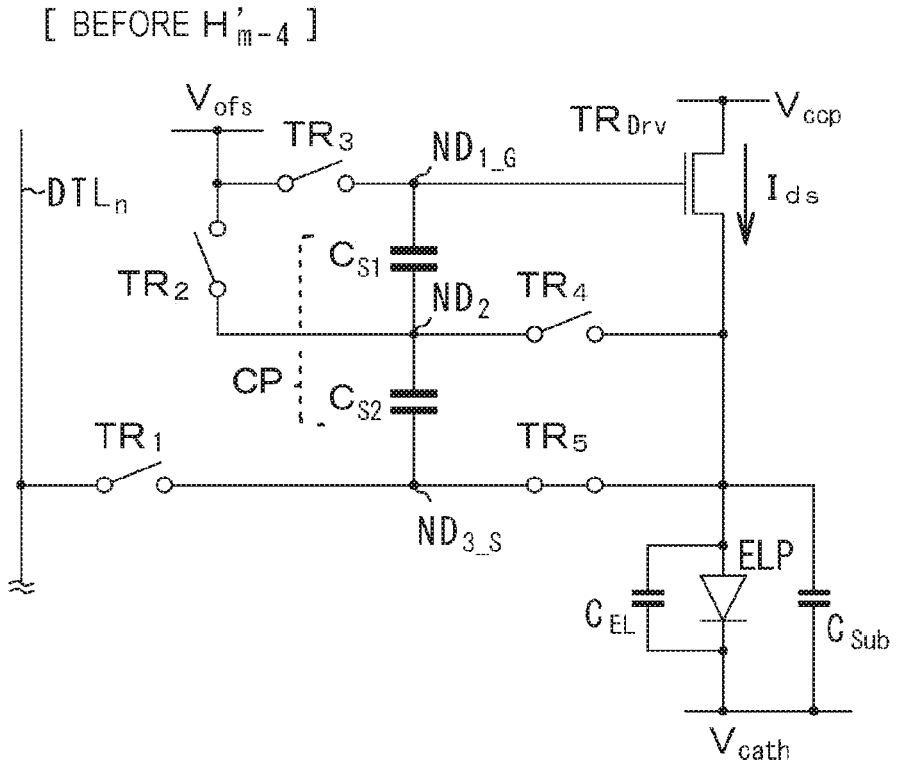
FIGS. 13A and 13B are drawings each schematically illustrating conducting state/non-conducting state and the like of each transistor that is included in a driving circuit of the display element of the display device according to the third embodiment.
Figure 13B:
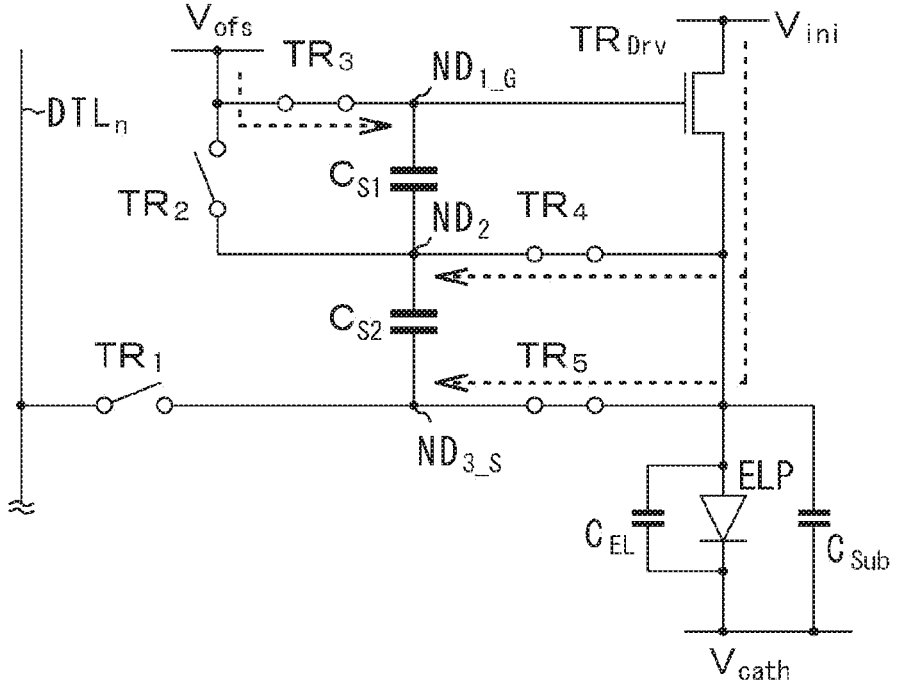

FIG. 12 is a schematic timing chart illustrating the operation of the display device according to the third embodiment, more specifically, the operation of the (n, m)th display element of the display device. FIGS. 13A, 13B, 14A, 14B, 15A, 15B, 16A, 16B, 17A, and 17B are drawings each schematically illustrating conducting state/non-conducting state and the like of each transistor that is included in a driving circuit of the display element of the display device according to the third embodiment.

[Time period: Before $H'_{m-4}$] (refer to FIG. 13A)

This time period is before the [time period $H'_{m-3}$] shown in FIG. 12, and is a time period during which the (n, m)th display element 11 continues light emission after the completion of various processings last time. The driving voltage $V_{ccp}$ is supplied to the electric supply line $DS_m$. The fifth switching transistor $TR_5$ is in the conducting state, and the other switching transistors are in the non-conducting state. Although not illustrated in FIG. 12, the first to fourth control lines $WS1_m$ to $WS4_m$ are at a low level, and the fifth control line $WS5_m$ is at a high level. The drain current $I_{ds}$ represented by the above-described equation (1) flows through the light-emitting unit ELP, and thus the light-emitting unit ELP is in a light emitting state.

[Time period: $H'_{m-3}$] (refer to FIGS. 12 and 13B)

Initialization processing is performed during this time period. In other words, by applying the reference voltage $V_{ofs}$ to the first node $ND_{1_G}$, and by applying the initialization voltage $V_{ini}$ to the second node $ND_2$ and the third node $ND_{3_S}$, the voltage held by the capacitor unit CP is set so as to exceed the threshold voltage $V_{th}$ of the driving transistor $TR_{Drv}$.

More specifically, the voltage supplied to the electric supply line $DS_m$ is switched to the initialization voltage $V_{ini}$. In addition, the third to fourth control lines $WS3_m$ to $WS4_m$ are switched to a high level. The other control lines maintain the previous state. The third to fifth switching transistors $TR_3$ to $TR_5$ are in the conducting state. The first switching transistor $TR_1$ and the second switching transistor $TR_2$ are in the non-conducting state.

The reference voltage $V_{ofs}$ is applied to the first node $ND_{1_G}$ through the third switching transistor $TR_3$. The voltage $V_{gs}$ between the gate and the source of the driving transistor $TR_{Drv}$ exceeds the threshold voltage $V_{th}$. Therefore, the initialization voltage $V_{ini}$ is applied from the electric supply line $DS_m$ to the second node $ND_2$ through the fourth switching transistor $TR_4$. Similarly, the initialization voltage $V_{ini}$ is applied from the electric supply line $DS_m$ to the third node $ND_{3_S}$ through the fifth switching transistor $TR_5$. The voltage held by the capacitor unit CP becomes $(V_{ofs}-V_{ini})$, and exceeds the threshold voltage $V_{th}$ of the driving transistor $TR_{Drv}$. In addition, the electric potential of the third node $ND_{3_S}$ does not exceed $(V_{th\text{-}EL}+V_{cath})$, and therefore the light-emitting unit ELP switches off the light.

[Time period: $H'_{m-2}$] (refer to FIGS. 12, 14A, and 14B)

Threshold voltage cancel processing is performed during this time period. In other words, by applying the reference voltage $V_{ofs}$ to the first node $ND_{1_G}$, and by applying the driving voltage $V_{ccp}$ to one source/drain region of the driving transistor $TR_{Drv}$ in a state in which the second node $ND_2$ and the third node $ND_{3_S}$ electrically conduct with each other, electric potentials of the second node $ND_2$ and the third node $ND_{3_S}$ are caused to get close to a voltage obtained by subtracting the threshold voltage $V_{th}$ of the driving transistor $TR_{Drv}$ from the reference voltage $V_{ofs}$.

More specifically, the voltage supplied to the electric supply line $DS_m$ is switched to the driving voltage V. The control lines maintain the previous state.

The reference voltage $V_{ofs}$ is applied to the first node $ND_{1_G}$ through the third switching transistor $TR_3$. The voltage held by the capacitor unit CP exceeds the threshold voltage $V_{th}$ of the driving transistor $TR_{Drv}$, and therefore, through the driving transistor $TR_{Drv}$, a current from the electric supply line $DS_m$ flows through the third node $ND_{3_S}$. As the result, the electric potential of the third node $ND_{3_S}$ increases toward an electric potential obtained by subtracting the threshold voltage $V_{th}$ of the driving transistor $TR_{Drv}$ from the reference voltage $V_{ofs}$. The electric potential of the second node $ND_2$ that is in the conducting state with the third node $ND_{3_S}$ also similarly increases (refer to FIG. 14A).

Figure 14A:
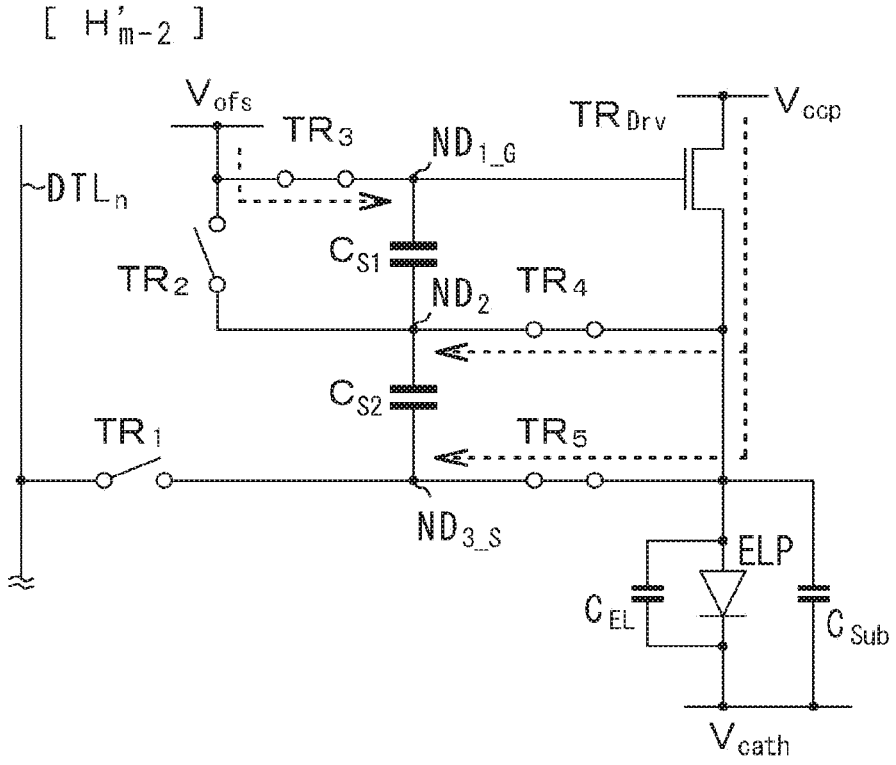
Figure 14B:
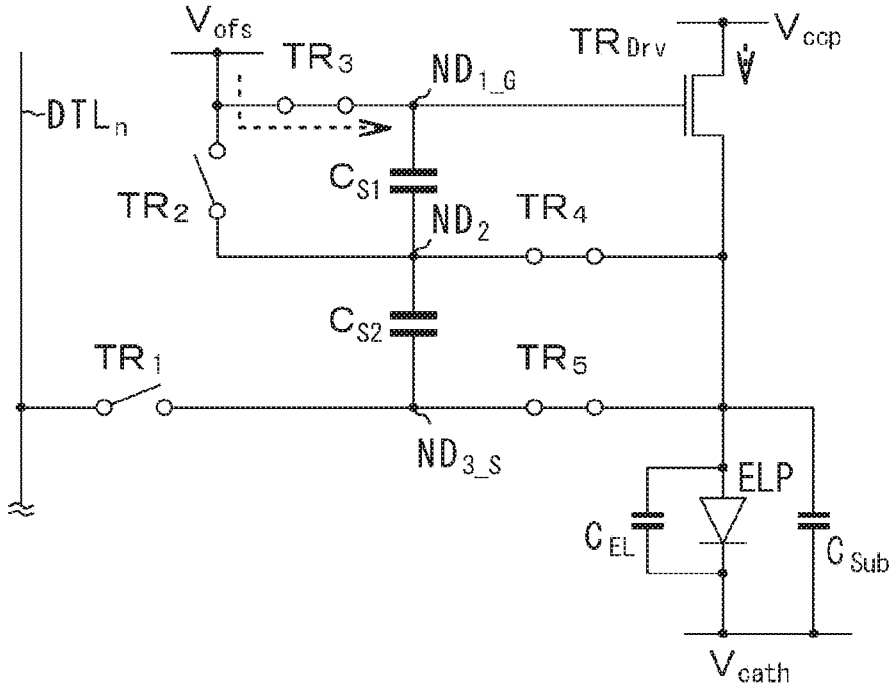
Figure 15A:
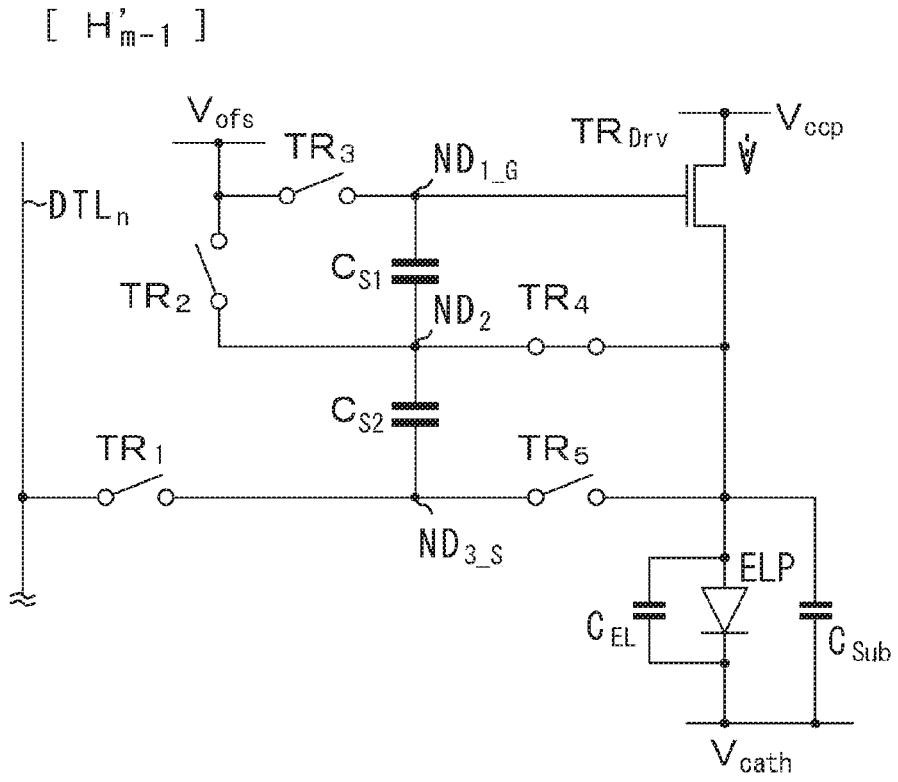
Figure 15B:
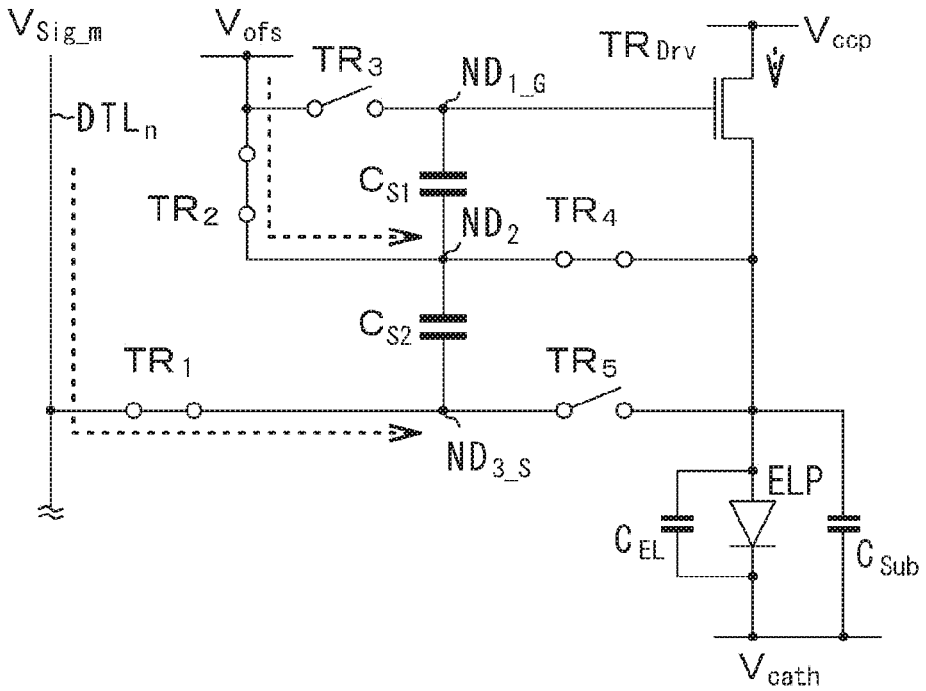
Figure 16A:
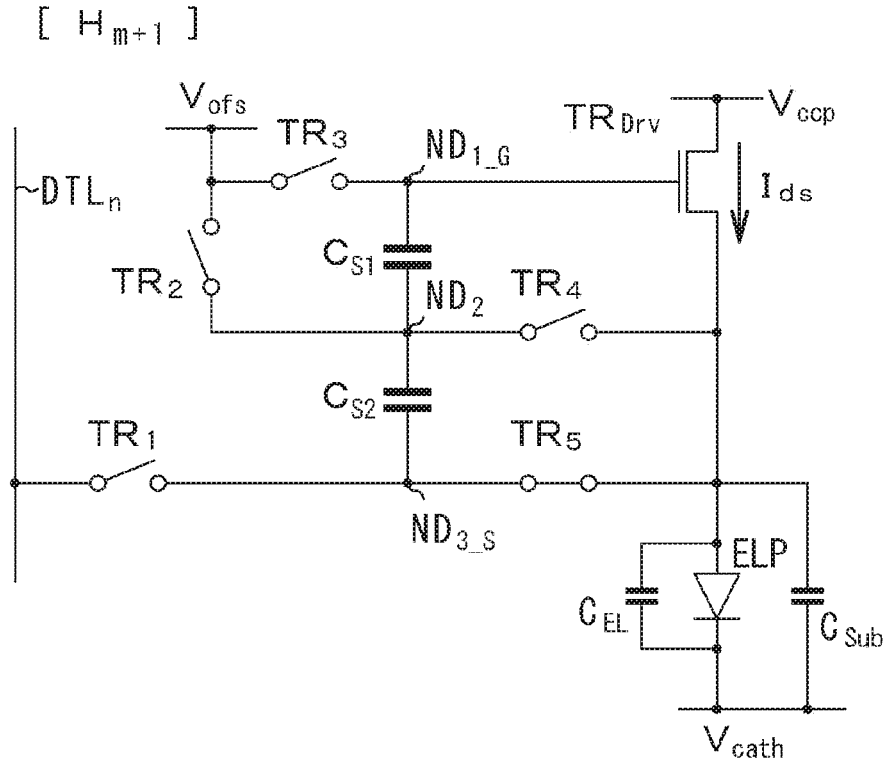
Figure 16B:
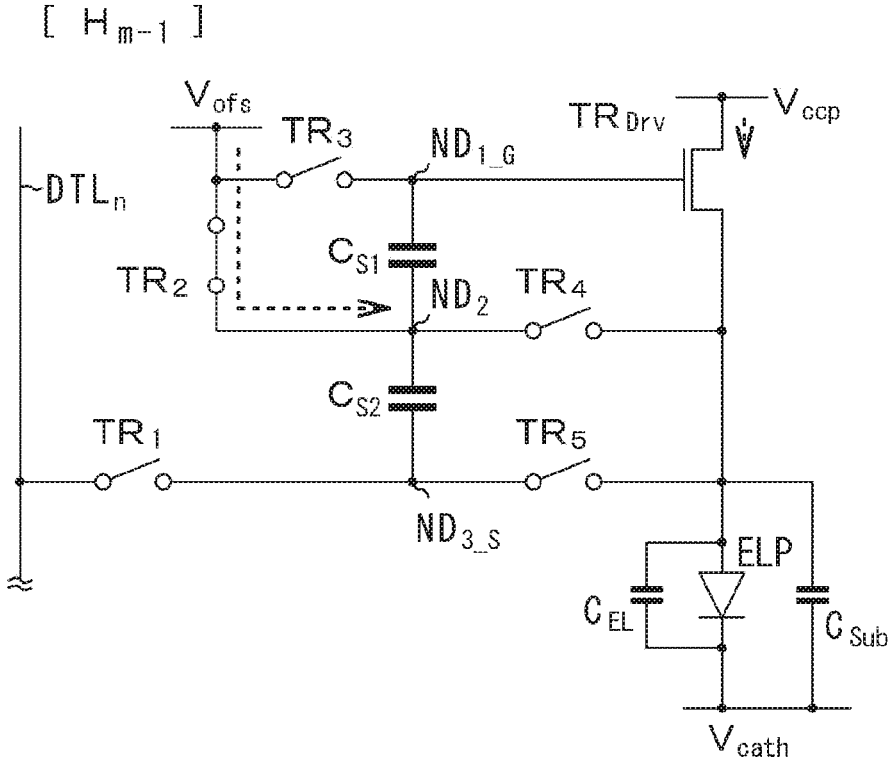
Figure 17A:
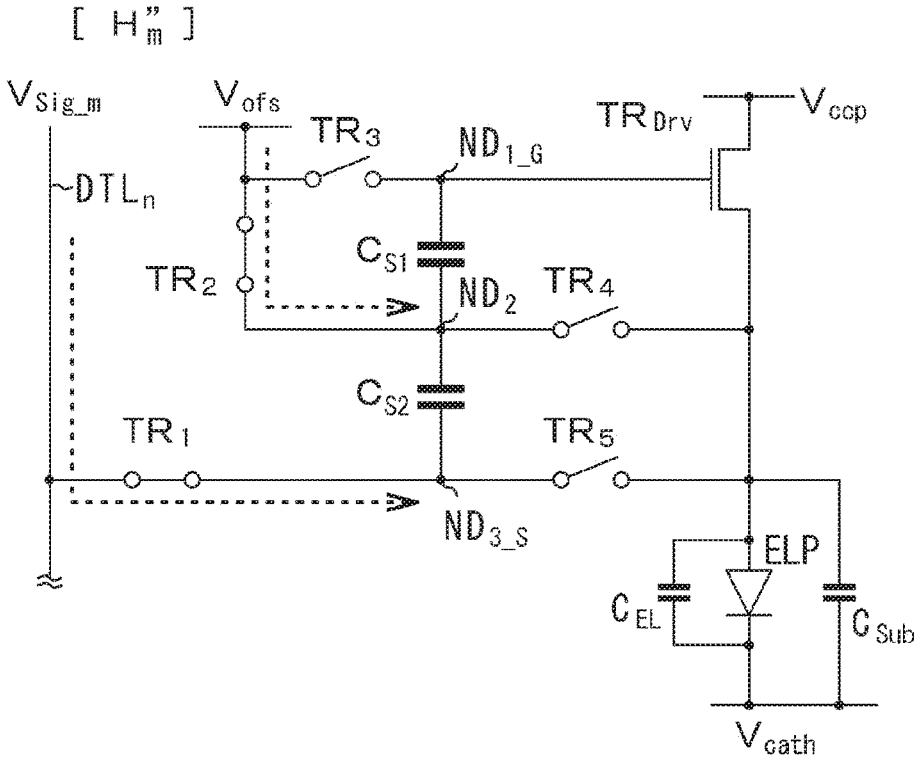
Figure 17B:
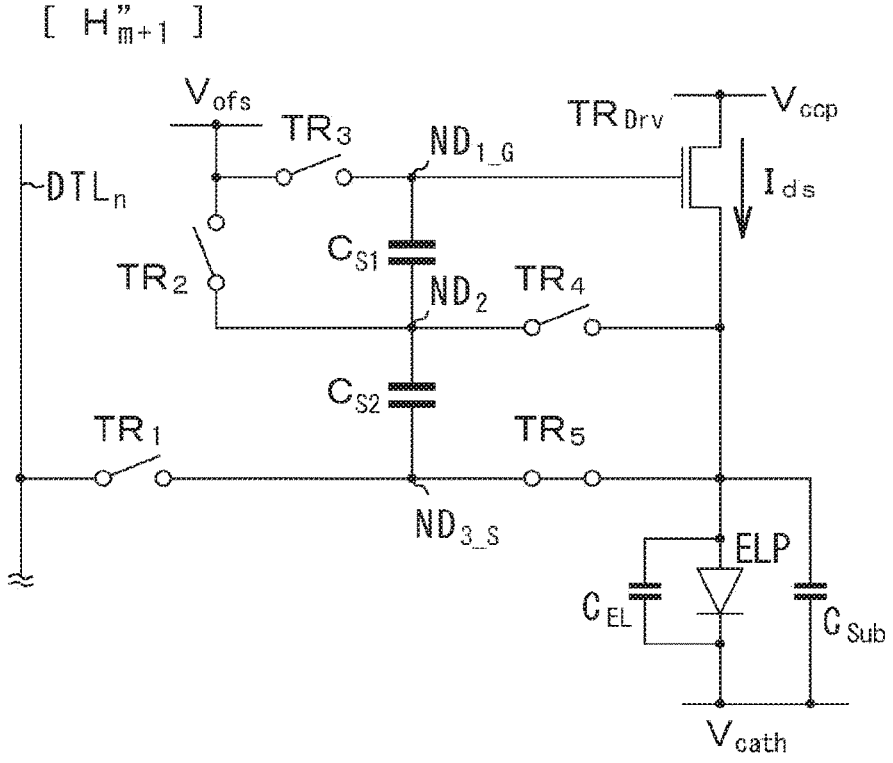

If this time period is sufficiently long, an electric potential difference between the gate electrode of the driving transistor $TR_{Drv}$ and the other source/drain region reaches $V_{th}$, and the driving transistor $TR_{Drv}$ enters the non-conducting state (refer to FIG. 14B). At this point of time, an electric potential difference between the first node $ND_{1_G}$ and the third node $ND_{3_S}$ becomes $(V_{ofs}-V_{th})$. The electric potential of the first node $ND_{1_G}$ is $V_{ofs}$, and electric potentials of the second node $ND_2$ and the third node $ND_{3_S}$ are both $(V_{ofs}-V_{th})$. Therefore, the voltage $V_{th}$ is held in the first capacitor $C_{S1}$. Electric potentials at both ends of the second capacitor $C_{S2}$ are the same, and thus the voltage held is 0 V.

Incidentally, for convenience of explanation, the explanation is made on the assumption that the driving transistor $TR_{Drv}$ is already in the non-conducting state during this time period. However, the present disclosure is not limited to this. A mode may be employed in which the time period ends before the electric potential difference between the gate electrode of the driving transistor $TR_{Drv}$ and the other source/drain region reaches $V_{th}$.

[Time period: $H'_{m-1}$] (refer to FIGS. 12 and 15A)

This time period is a time period immediately before performing the next write processing, and a time period for waiting for writing. The third control line $WS3_m$ and the fifth control line $WS5_m$ are switched to a low level. The other control lines maintain the previous state. The fourth switching transistor $TR_4$ is in the conducting state, and the other switching transistors are in the non-conducting state. If the driving transistor $TR_{Drv}$ is already in the non-conducting state in the [time period: $H'_{m-2}$], electric potentials of the first node $ND_{1_G}$, the second node $ND_2$ and the third node $ND_{3_S}$ do not substantially change (refer to FIG. 14B). It should be noted that this time period may be omitted.

[Time period: $H_m$] (refer to FIGS. 12 and 15B)

A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ and the second control line $WS2_m$ are switched to a high level. The other control lines maintain the previous state. The first switching transistor $TR_1$ and the second switching transistor $TR_2$ enter the conducting state. The other switching transistors are in the non-conducting state.

In the immediately preceding [time period: $H'_{m-1}$], an electric potential of the first node $ND_{1_G}$ is $V_{ofs}$, an electric potential of the second node $ND_2$ is $(V_{ofs}-V_{th})$, and the voltage $V_{th}$ is held in the first capacitor $C_{S1}$. When the second switching transistor $TR_2$ enters the conducting state, the reference voltage $V_{ofs}$ is applied to the second node $ND_2$. Therefore, the electric potential of the second node $ND_2$ changes from $(V_{ofs}-V_{th})$ to $V_{ofs}$. Here, the third switching transistor $TR_3$ is in the non-conducting state. Therefore, if an influence exerted by parasitic capacitance or the like can be ignored, the first capacitor $C_{S1}$ maintains the previous state in which the voltage $V_{th}$ is held. Therefore, the electric potential of the first node $ND_{1_G}$ becomes $(V_{ofs}+V_{th})$ from $V_{ofs}$. In addition, the video signal voltage $V_{Sig_m}$ is applied to the third node $ND_{3_S}$ through the first switching transistor $TR_1$ in the conducting state. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}+V_{ofs}-V_{Sig_m})$.

[Time period: $H_{m+1}$] (refer to FIGS. 12 and 16A)

A light emission period ranges from this time period until the starting period of a scanning period [time period: $H_{m-1}$] immediately before the scanning period $H''_m$ in the m-th row in the next frame.

More specifically, the first control line $WS1_m$, the second control line $WS2_m$, and the fourth control line $WS4_m$ are switched to a low level, and the fifth control line $WS5_m$ is switched to a high level. The third control line $WS3_m$ maintains the previous state. The fifth switching transistor $TR_5$ is in the conducting state, and the other switching transistors are in the non-conducting state.

The fifth switching transistor $TR_5$ is in the conducting state, and therefore the voltage $V_{gs}$ between the gate and the source of the driving transistor $TR_{Drv}$ becomes a voltage $(V_{th}+V_{ofs}-V_{Sig_m})$ held by the capacitor unit CP. In addition, the driving voltage $V_{ccp}$ is applied to the source/drain region of one end of the driving transistor $TR_{Drv}$, and therefore a current flows towards the light-emitting unit ELP through the driving transistor $TR_{Drv}$, which causes an electric potential of the third node $ND_{3_S}$ to increase. At this point of time, a phenomenon similar to that of so-called a bootstrap circuit occurs in the gate electrode of the driving transistor $TR_{Drv}$. Basically, the electric potential of the first node $ND_{1_G}$ increases so as to maintain the voltage $V_{gs}$ between the gate and the source.

In addition, the electric potential of the third node $ND_{3_S}$ increases, and exceeds $(V_{th\text{-}EL}+V_{cath})$, and therefore the light-emitting unit ELP starts light emission. As described in the first embodiment, the current $I_{ds}$ flowing through the light-emitting unit ELP is represented by the above-described equation (2), and therefore does not depend on the threshold voltage $V_{th}$ of the driving transistor $TR_{Drv}$. In other words, since the influence exerted by the dispersion in threshold voltage $V_{th}$ of the driving transistor $TR_{Drv}$ of the display element 11 is canceled, the uneven brightness is reduced.

[Time period: $H_{m-1}$] (refer to FIGS. 12 and 16B)

This time period is a time period immediately before performing the next write processing. The voltage $V_{th}$ is already held in the first capacitor $C_{S1}$, and thus the operation corresponding to the above-described [time period: $H'_{m-3}$] and [time period: $H'_{m-2}$] is omitted.

More specifically, the second control line $WS2_m$ is switched to a high level, and the fifth control line $WS5_m$ is switched to a low level. The second switching transistor $TR_2$ is in the conducting state, and the other switching transistors are in the non-conducting state.

The reference voltage $V_{ofs}$ is applied to the second node $ND_2$, and therefore the electric potential of the second node $ND_2$ decreases to become $V_{ofs}$. The first node $ND_{1_G}$ and the third node $ND_{3_S}$ are in the floating state, and therefore these electric potentials also decrease according to the change in potential of the second node $ND_2$. The first capacitor $C_{S1}$ maintains a state in which the voltage $V_{th}$ is held.

[Time period: $H''_m$] (refer to FIGS. 12 and 17A)

The next frame starts from this time period. A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ is switched to the high level. The other control lines maintain the previous state. The first switching transistor $TR_1$ and the second switching transistor $TR_2$ are in the conducting state. The other switching transistors are in the non-conducting state.

In the immediately preceding [time period: $H'_{m-1}$], the voltage $V_{th}$ is held in the first capacitor $C_{S1}$ in a state in which the electric potential of the second node $ND_2$ is $V_{ofs}$. Further, the video signal voltage $V_{Sig_m}$ is applied to the third node $ND_{3_S}$ through the first switching transistor $TR_1$ in the conducting state. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}+V_{ofs}-V_{Sig_m})$.

[Time period: $H''_{m+1}$] (refer to FIGS. 12, and 17B)

The next frame light emission period starts from this time period. More specifically, the first control line $WS1_m$ and the second control line $WS2_m$ are switched to a low level, and the fifth control line $WS5_m$ is switched to a high level. The fifth switching transistor $TR_5$ is in the conducting state, and the other switching transistors are in the non-conducting state. The specific operation is similar to the operation described in the above-described [time period: $H_{m+1}$], and therefore the description thereof will be omitted.

As described above, in the third embodiment as well, if the operation of holding the threshold voltage $V_{th}$ in the first capacitor $C_{S1}$ is performed in a certain frame, this operation can be omitted in a subsequent frame. Therefore, the power consumption can be further reduced while canceling the influence exerted by the dispersion in threshold voltage $V_{th}$ of the driving transistor $TR_{Drv}$.

Fourth Embodiment

The fourth embodiment also relates to the display device, the display device driving method, and the display element according to the present disclosure.

The configuration of the display device becomes more complicated with the increase in the number of transistors that constitute the display element, and in the number of control lines. From the viewpoint of the electric power saving, cost reduction, or the like, it is preferable to reduce the number of transistors that constitute the display element. In addition, it is preferable to commonalize the control lines for controlling the transistors. In the fourth embodiment, the number of transistors and the number of control lines decrease in comparison with the first to third embodiments. In particular, the control lines are partially commonalized, and the second control line WS2 is omitted.

Figure 18:
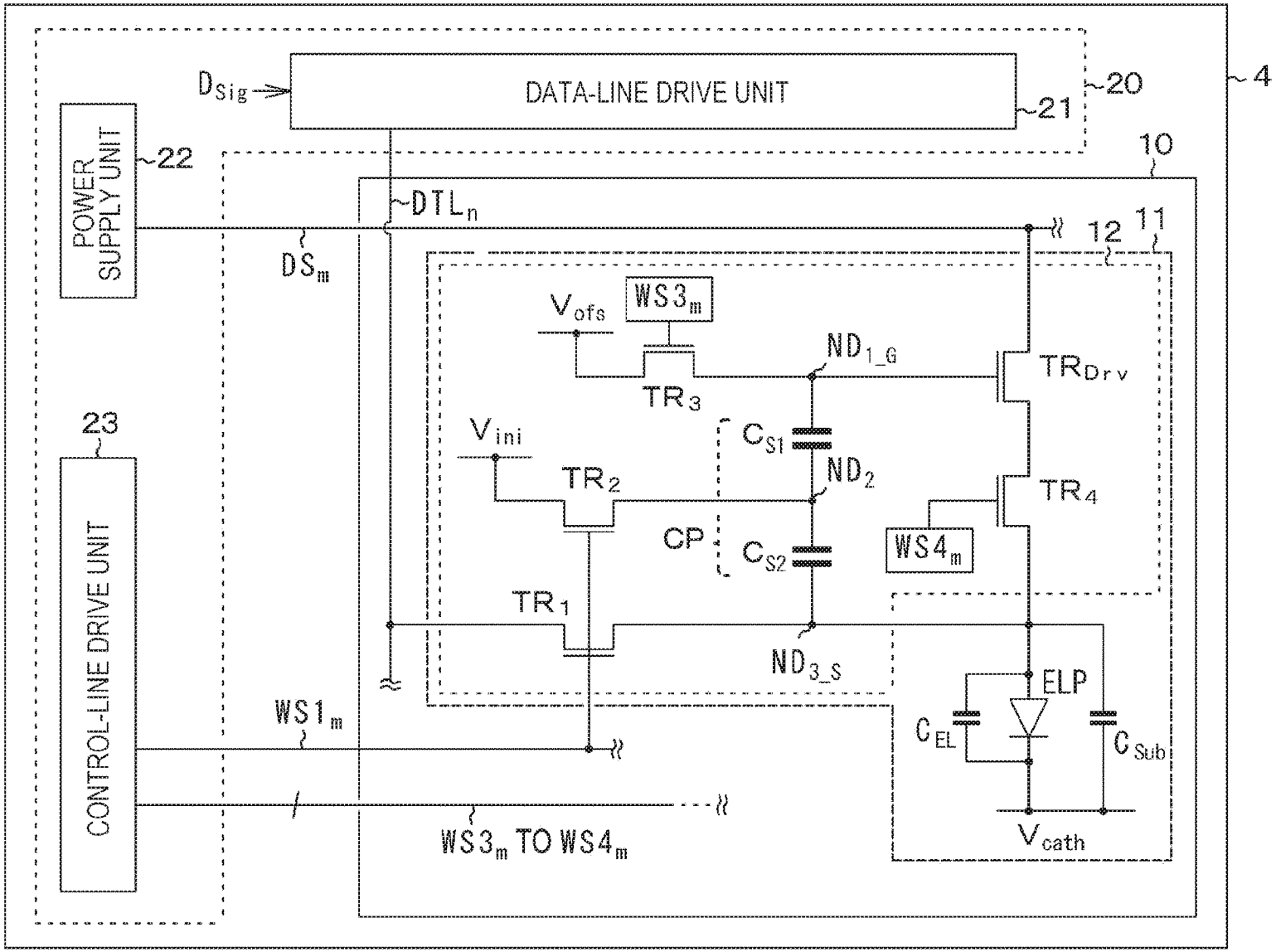
FIG. 18 is a conceptual diagram illustrating a display device according to a fourth embodiment.

FIG. 18 is a conceptual diagram illustrating a display device according to the fourth embodiment.

A display device 4 is also provided with: the display unit 10 in which the display elements 11 are arranged; and the drive unit 20 for driving the display unit 10. In the fourth embodiment, the data-line drive unit 21 supplies the video signal voltage $V_{Sig}$ and the initialization voltage $V_{ini}$ to the data line DTL. The power supply unit 22 supplies a driving voltage $V_{ccp}$ to the electric supply line DS.

The capacitor unit CP, the driving transistor $TR_{Drv}$, and the first switching transistor $TR_1$ in the display element 11 are configured in a similar manner to that described in the first embodiment, and therefore the description thereof will be omitted. In the fourth embodiment, the drive unit 20 applies the reference voltage $V_{ofs}$ to the first node $ND_{1_G}$, and applies the initialization voltage $V_{ini}$ to the second node $ND_2$ and the third node $ND_{3_S}$, thereby setting the voltage held by the capacitor unit CP so as to exceed the threshold voltage $V_{th}$ of the driving transistor $TR_{Drv}$. Subsequently, the drive unit 20 applies the driving voltage $V_{ccp}$ to one source/drain region of the driving transistor $TR_{Drv}$ in a state in which the reference voltage $V_{ofs}$ is applied to the first node $ND_{1_G}$, so as to cause the electric potential of the third node $ND_{3_S}$ to get close to a voltage obtained by subtracting the threshold voltage $V_{th}$ of the driving transistor $TR_{Drv}$ from the reference voltage $V_{ofs}$, thereby causing a voltage corresponding to the threshold voltage $V_{th}$ of the driving transistor $TR_{Drv}$ to be held in the first capacitor $C_{S1}$.

In the fourth embodiment, the display elements 11 are each further provided with the second switching transistor $TR_2$, the third switching transistor $TR_3$, and the fourth switching transistor $TR_4$. In the second switching transistor $TR_2$, the initialization voltage $V_{ini}$ is applied to one source/drain region, and the other source/drain region is connected to the second node $ND_2$. In the third switching transistor $TR_3$, the reference voltage $V_{ofs}$ is applied to one source/drain region, and the other source/drain region is connected to the first node $ND_{1_G}$. The other source/drain region of the driving transistor $TR_{Drv}$ is connected to one end of the light-emitting unit ELP through the fourth switching transistor $TR_4$. The third switching transistor $TR_3$ is brought into the conducting state, which causes the reference voltage $V_{ofs}$ to be applied to the first node $ND_{1_G}$. The second switching transistor $TR_2$ is brought into the conducting state, which causes the initialization voltage $V_{ini}$ to be applied to the second node $ND_2$_G. The conducting state/non-conducting state of the second switching transistor $TR_2$ is controlled by a control line in common with the first switching transistor $TR_1$, that is to say, the first control line WS1.

Next, the operation of the display device 4 will be described with reference to the accompanying drawings.

Figure 19:
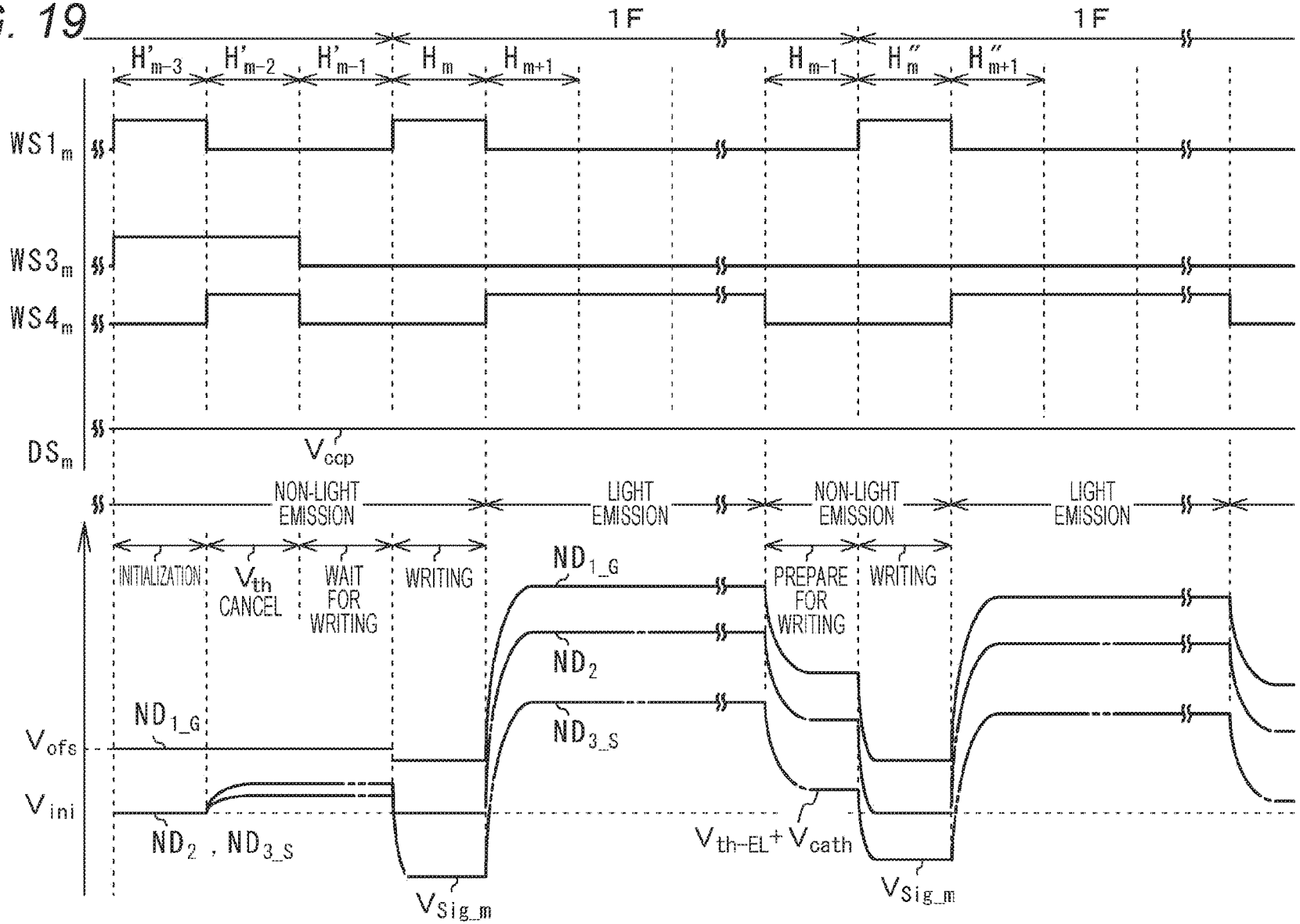
FIG. 19 is a schematic timing chart illustrating the operation of the display device according to the fourth embodiment, more specifically, the operation of the (n, m)th display element of the display device.
Figure 20A:
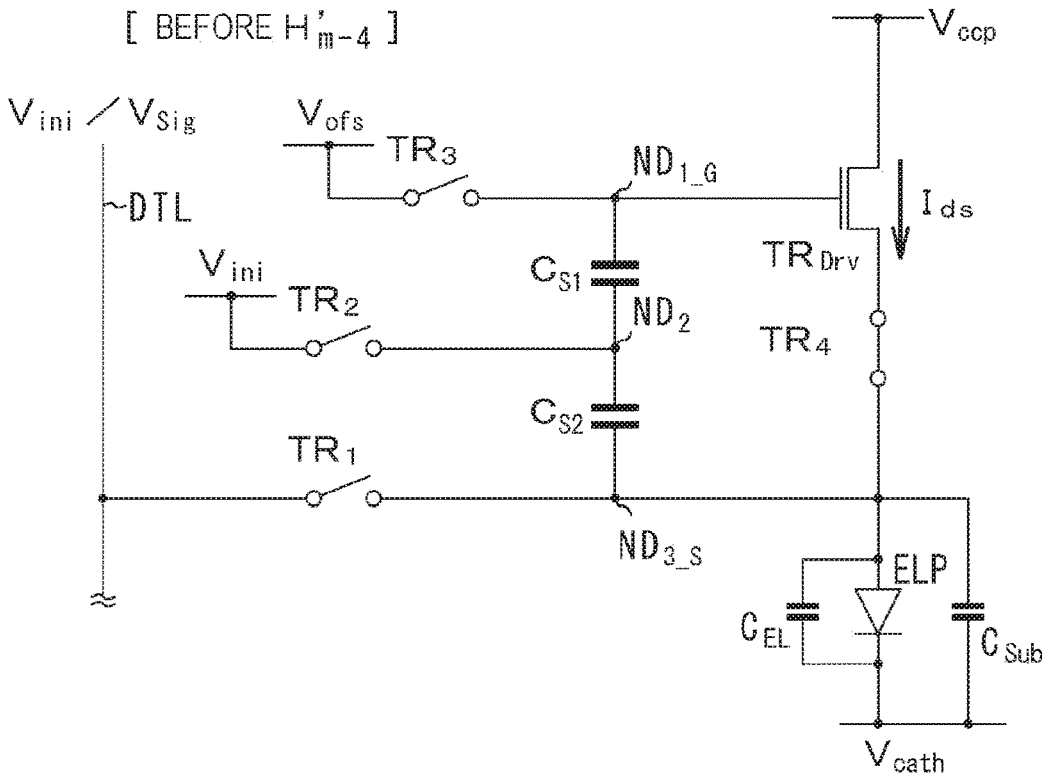
FIGS. 20A and 20B are drawings each schematically illustrating conducting state/non-conducting state and the like of each transistor that is included in a driving circuit of the display element of the display device according to the fourth embodiment.
Figure 20B:
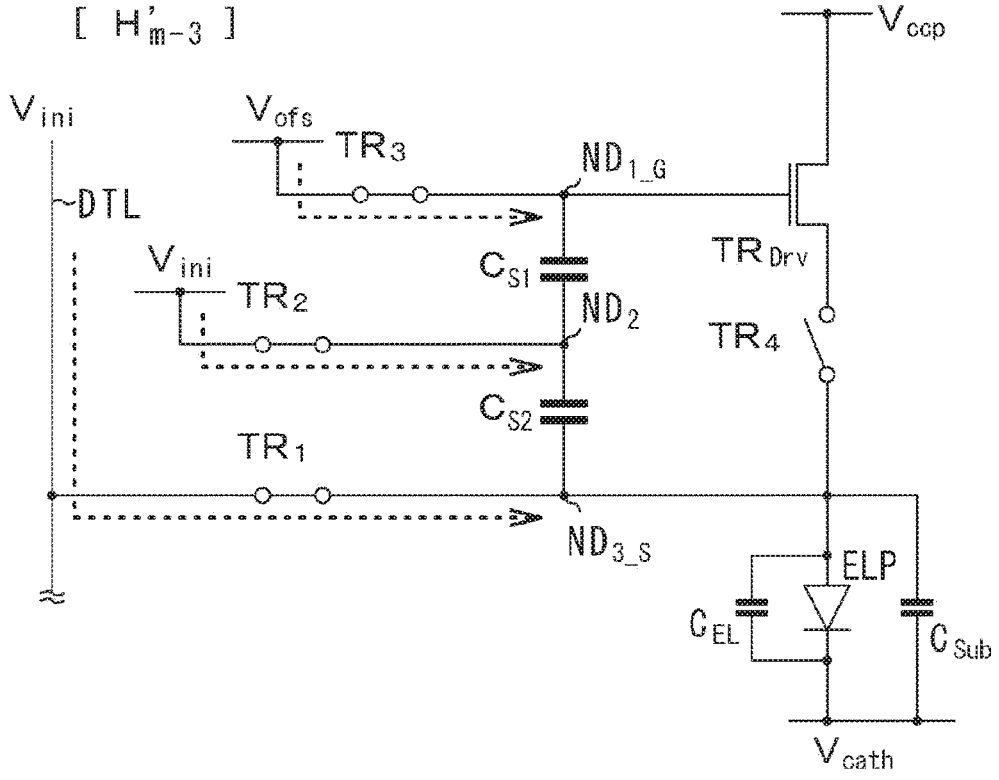

FIG. 19 is a schematic timing chart illustrating the operation of the display device according to the fourth embodiment, more specifically, the operation of the (n, m)th display element of the display device. FIGS. 20A, 20B, 21A, 21B, 22A, 22B, 23A, 23B, 24A, and 24B are drawings each schematically illustrating conducting state/non-conducting state and the like of each transistor that is included in a driving circuit of the display element of the display device according to the fourth embodiment.

[Time period: Before $H'_{m-4}$] (refer to FIG. 20A)

This time period is before the [time period $H'_{m-3}$] shown in FIG. 19, and is a time period during which the (n, m)th display element 11 continues light emission after the completion of various processings last time. The driving voltage $V_{ccp}$ is supplied to the electric supply line $DS_m$. The first to third switching transistors $TR_1$ to $TR_3$ are in the non-conducting state. The fourth switching transistor $TR_4$ is in the conducting state. Although not illustrated in FIG. 19, the first control line WS1$_m$ and the third control line WS3$_m$ are at a low level. The fourth control line WS4$_m$ is at a high level. The drain current $I_{ds}$ represented by the above-described equation (1) flows through the light-emitting unit ELP, and thus the light-emitting unit ELP is in a light emitting state.

[Time period: $H'_{m-3}$] (refer to FIGS. 19 and 20B)

Initialization processing is performed during this time period. In other words, by applying the reference voltage $V_{ofs}$ to the first node $ND_{1_G}$, and by applying the initialization voltage $V_{ini}$ to the second node $ND_2$ and the third node $ND_{3_S}$, the voltage held by the capacitor unit CP is set so as to exceed the threshold voltage $V_{th}$ of the driving transistor $TR_{Drv}$.

More specifically, the initialization voltage $V_{ini}$ is supplied to the data line $DTL_n$. In addition, the first control line WS1$_m$ and the third control line WS3$_m$ are switched to a high level, and the fourth control line WS4$_m$ is switched to a low level. The first to third switching transistors $TR_1$ to $TR_3$ are in the conducting state. The fourth switching transistor $TR_4$ is in the non-conducting state.

The fourth switching transistor $TR_4$ is in the non-conducting state, and therefore a current flowing through the driving transistor $TR_{Drv}$ does not flow through the light-emitting unit ELP. The reference voltage $V_{ofs}$ is applied to the first node $ND_{1_G}$ through the third switching transistor $TR_3$. The initialization voltage $V_{ini}$ is applied to the second node $ND_2$ through the second switching transistor $TR_2$. The initialization voltage $V_{ini}$ is applied from the data line $DTL_n$ to the third node $ND_{3_S}$ through the first switching transistor $TR_1$. The voltage held by the capacitor unit CP becomes ($V_{ofs}-V_{ini}$), and exceeds the threshold voltage $V_{th}$ of the driving transistor $TR_{Drv}$. In addition, the electric potential of the third node $ND_{3_S}$ does not exceed ($V_{th\text{-}EL}+V_{cath}$), and therefore the light-emitting unit ELP maintains a non-lighting state.

[Time period: $H'_{m-2}$] (refer to FIGS. 19, 21A, and 21B)

Threshold voltage cancel processing is performed during this time period. In other words, the driving voltage $V_{ccp}$ is applied to one source/drain region of the driving transistor $TR_{Drv}$ in a state in which the reference voltage $V_{ofs}$ is applied to the first node $ND_{1_G}$, so as to cause the electric potential of the third node $ND_{3_S}$ to get close to a voltage obtained by subtracting the threshold voltage $V_{th}$ of the driving transistor $TR_{Drv}$ from the reference voltage $V_{ofs}$, thereby causing a voltage corresponding to the threshold voltage $V_{th}$ of the driving transistor $TR_{Drv}$ to be held in the first capacitor $C_{S1}$.

More specifically, the first control line WS1$_m$ is switched to a low level, and the fourth control line WS4$_m$ is switched to a high level. The third control line WS3$_m$ maintains the previous state. The third switching transistor $TR_3$ and the fourth switching transistor $TR_4$ are in the conducting state. The first switching transistor $TR_1$ and the second switching transistor $TR_2$ are in the non-conducting state.

The reference voltage $V_{ofs}$ is applied to the first node $ND_{1_G}$ through the third switching transistor $TR_3$. The voltage held by the capacitor unit CP exceeds the threshold voltage $V_{th}$ of the driving transistor $TR_{Drv}$, and therefore, through the driving transistor $TR_{Drv}$, a current from the electric supply line $DS_m$ flows through the third node $ND_{3_S}$. As the result, the electric potential of the third node $ND_{3_S}$ increases toward an electric potential obtained by subtracting the threshold voltage $V_{th}$ of the driving transistor $TR_{Drv}$ from the reference voltage $V_{ofs}$. (Refer to FIG. 21A).

Figure 21A:
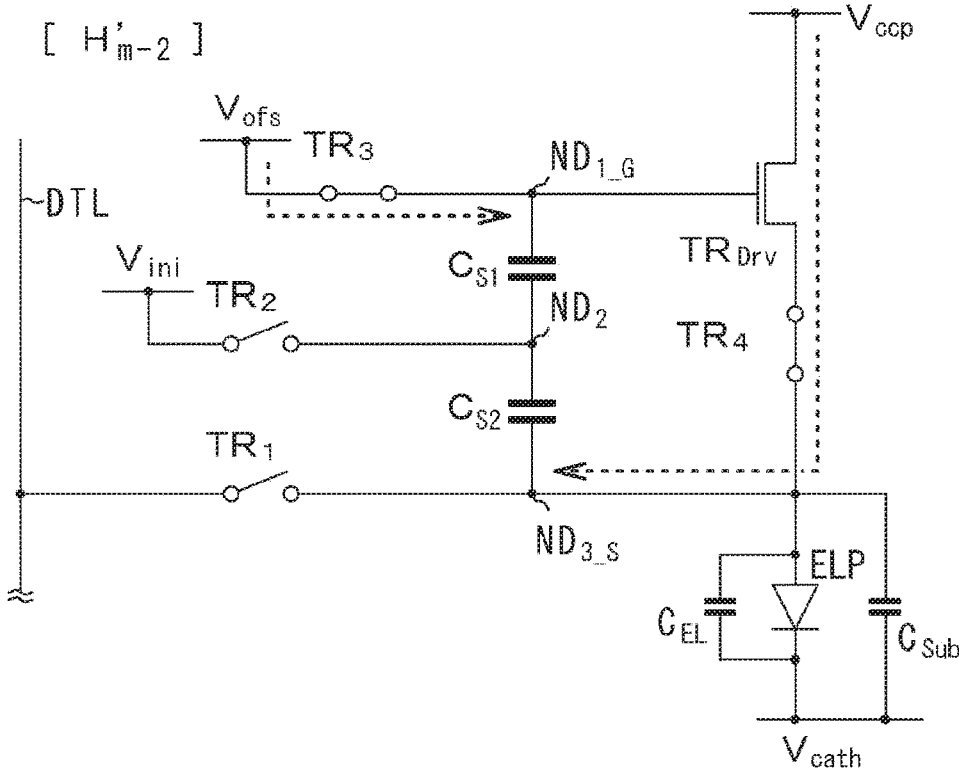
Figure 21B:
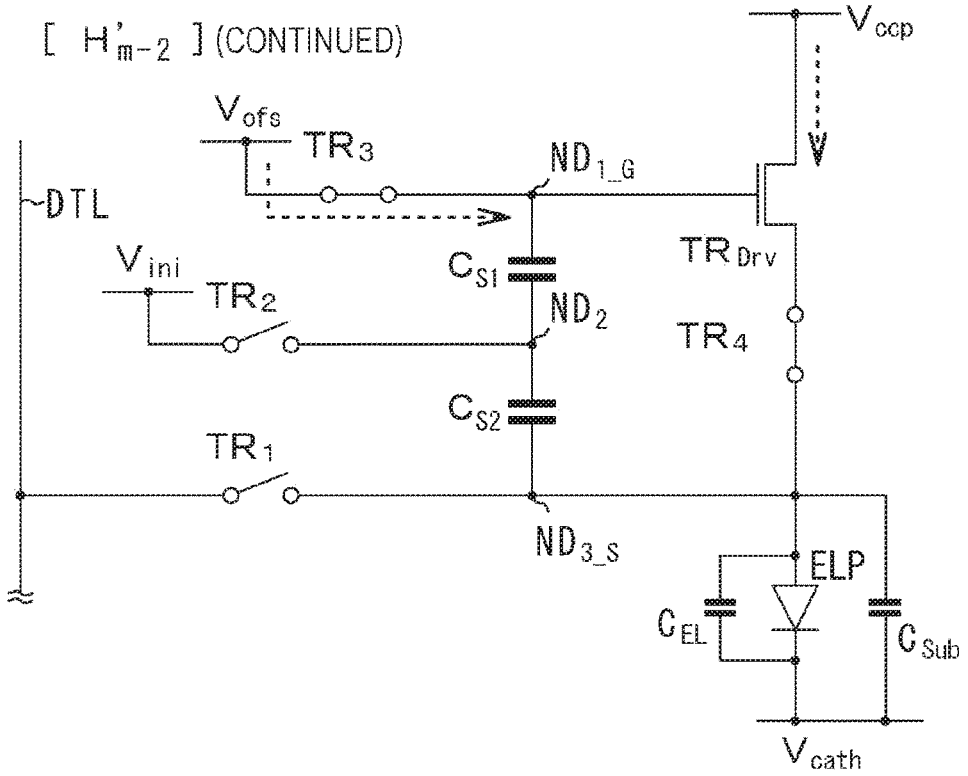
Figure 22A:
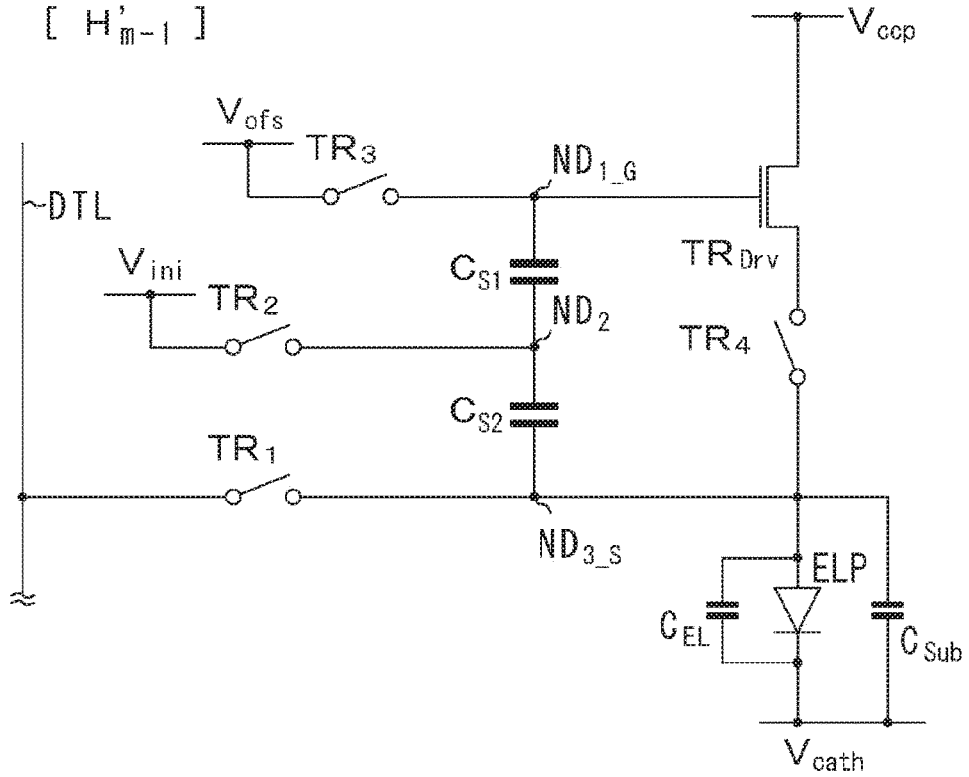
Figure 22B:
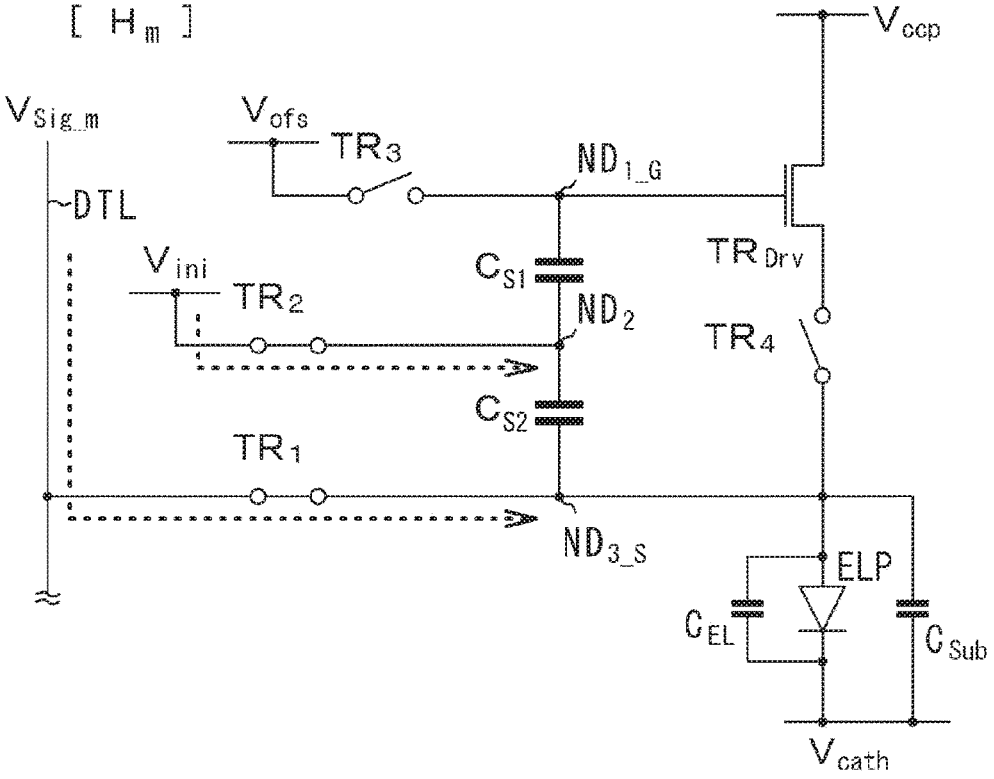
Figure 23A:
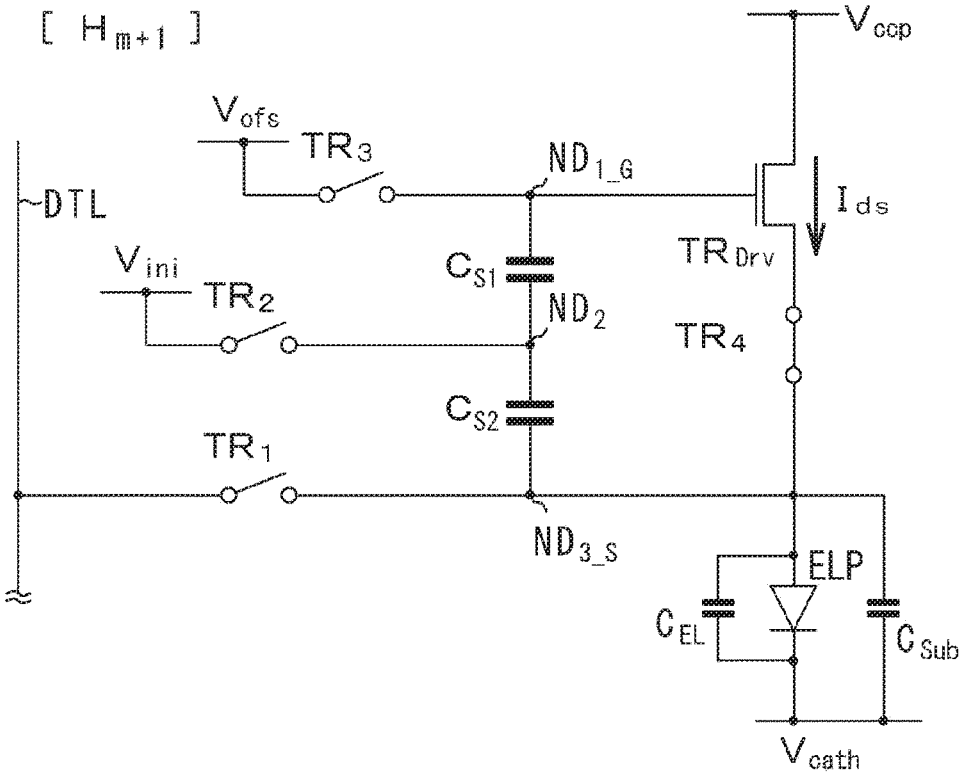
Figure 23B:
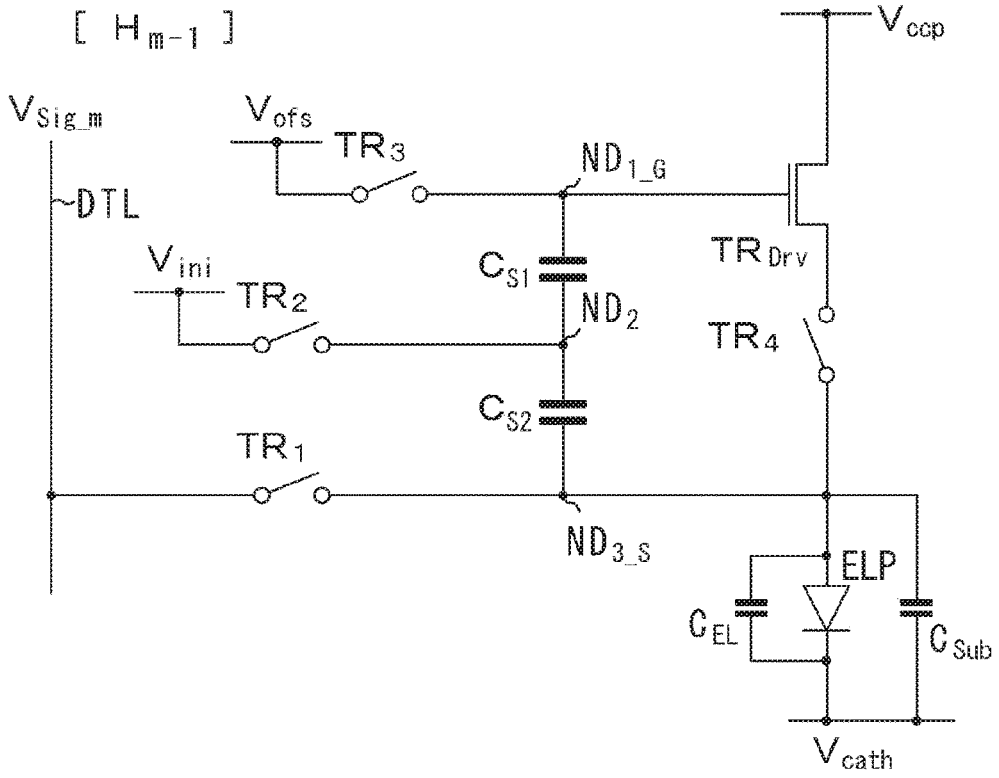
Figure 24A:
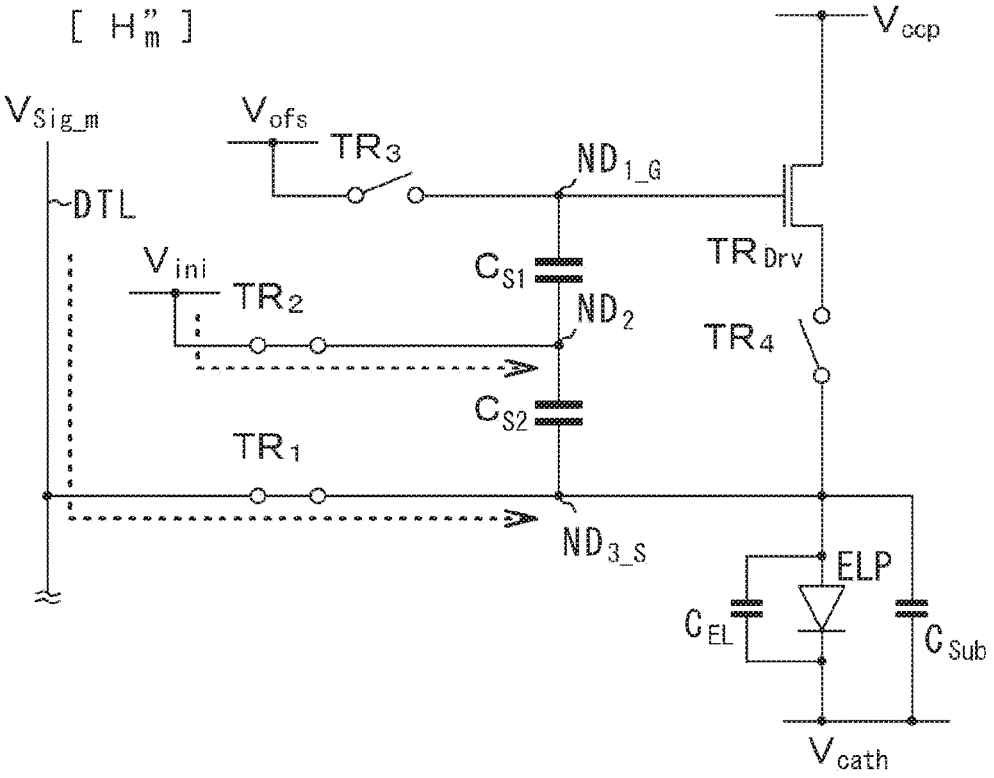
Figure 24B:
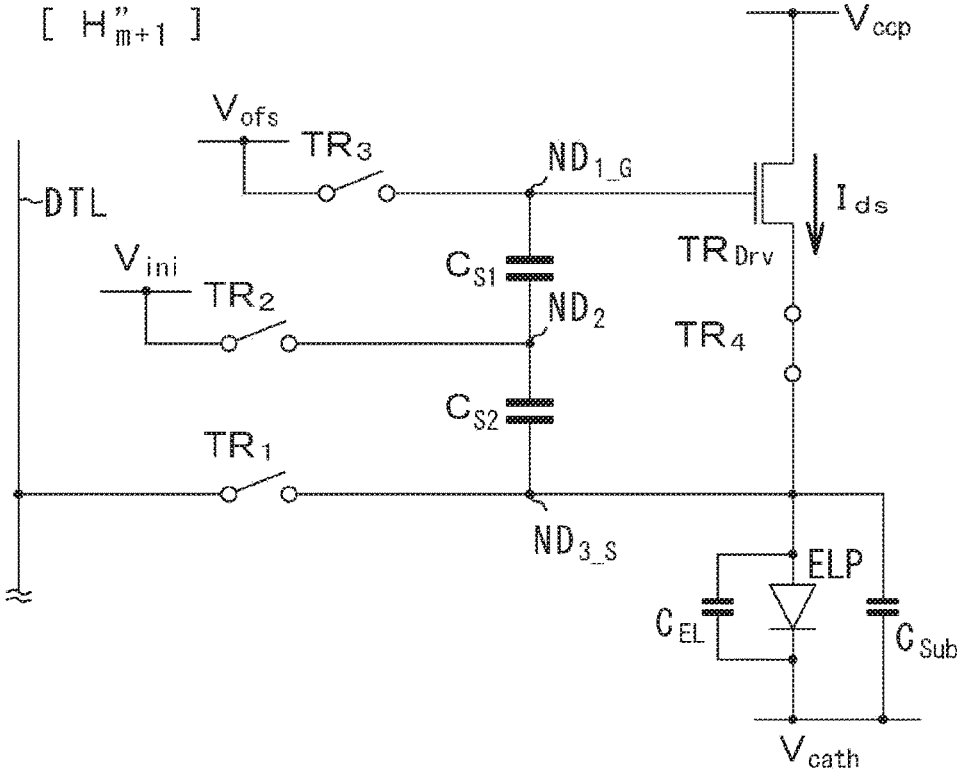

If this time period is sufficiently long, an electric potential difference between the gate electrode of the driving transistor $TR_{Drv}$ and the other source/drain region reaches $V_{th}$, and the driving transistor $TR_{Drv}$ enters the non-conducting state (refer to FIG. 21B). At this point of time, an electric potential difference between the first node $ND_{1_G}$ and the third node $ND_{3_S}$ becomes ($V_{ofs}-V_{th}$). The electric potential of the first node $ND_{1_G}$ is $V_{ofs}$, and the electric potential of the third node $ND_{3_S}$ is ($V_{ofs}-V_{th}$).

Incidentally, for convenience of explanation, the explanation is made on the assumption that the driving transistor $TR_{Drv}$ is already in the non-conducting state during this time period. However, the present disclosure is not limited to this. A mode may be employed in which the time period ends before the electric potential difference between the gate electrode of the driving transistor $TR_{Drv}$ and the other source/drain region reaches $V_{th}$.

If the change in potential of the third node $ND_{3_S}$ from the [time period: $H'_{m-3}$] to the [time period: $H'_{m-2}$] is represented as $\Delta V_{ND3_S}$, the relationship among $\Delta V_s$, $V_{th}$, $V_{ofs}$, and $V_{ofs}$ is represented by the following equation (3). In addition, if the change in potential of the second node $ND_2$ during the same period is represented as $\Delta V_{ND2}$, $\Delta V_{ND2}$ is represented by the following equation (4).

$$V_{th}=V_{ofs}-V_{ini}-\Delta V_s \tag{3}$$

$$\Delta V_{ND2}=\Delta V_s \cdot C_{S1}/(C_{S1}+C_{S2}) \tag{4}$$

Further, if the voltage held by the second capacitor $C_{S2}$ is represented as $V_{th}'$, $V_{th}'$ is represented by the following equation (5).

$$V_{th}'=V_{ofs}-V_{ini}-\Delta V_{ND2} \quad (5)$$

As understood from the equation (3) and the equation (4), $\Delta V_{ND2}$ is a voltage determined according to $V_{th}$. Therefore, a voltage corresponding to the threshold voltage $V_{th}$ is held in the second capacitor $C_{S2}$.

[Time period: $H'_{m-1}$] (refer to FIGS. 19, and 22A)

This time period is a time period immediately before performing the next write processing, and a time period for waiting for writing. The third control line $WS3_m$ and the fourth control line $WS4_m$ are switched to a low level, and the first control line $WS1_m$ maintains the previous state. The first to fourth switching transistors $TR_1$ to $TR_4$ are in the non-conducting state. If the driving transistor $TR_{Drv}$ is already in the non-conducting state in the [time period: $H'_{m-2}$], electric potentials of the first node $ND_{1_G}$, the second node $ND_2$, and the third node $ND_{3_S}$ do not substantially change. It should be noted that this time period may be omitted.

[Time period: $H_m$] (refer to FIGS. 19 and 22B

A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ is switched to the high level. The other control lines maintain the previous state. The first switching transistor $TR_1$ and the second switching transistor $TR_2$ are in the conducting state. The other switching transistors are in the non-conducting state.

In the immediately preceding [time period: $H'_{m-1}$], the electric potential of the first node $ND_{1_G}$ is $V_{ofs}$, the electric potential of the third node $ND_{3_S}$ is $(V_{ofs}-V_{th})$, and the voltage $V_{th}'$ is held by the first capacitor $C_{S1}$. When the second switching transistor $TR_2$ enters the conducting state, the reference voltage $V_{ofs}$ is applied to the second node $ND_2$. Therefore, the electric potential of the second node $ND_2$ changes from $(V_{ofs}-V_{th}')$ to $V_{ofs}$. Here, the third switching transistor $TR_3$ is in the non-conducting state. Therefore, if an influence exerted by parasitic capacitance or the like can be ignored, the first capacitor $C_{S1}$ maintains the previous state in which the voltage $V_{th}'$ is held. Therefore, the electric potential of the first node $ND_{1_G}$ becomes $(V_{ofs}+V_{th}')$ from $V_{ofs}$. In addition, the video signal voltage $V_{Sig_m}$ is applied to the third node $ND_{3_S}$ through the first switching transistor $TR_1$ in the conducting state. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}'+V_{ofs}-V_{Sig_m})$.

[Time period: $H_{m+1}$] (refer to FIGS. 19 and 23A)

A light emission period ranges from this time period until the starting period of a scanning period [time period: $H_{m-1}$] immediately before the scanning period $H''_m$ in the m-th row in the next frame.

More specifically, the first control line $WS1_m$ is switched to a low level, and the fourth control line $WS4_m$ is switched to a high level. The third control line $WS3_m$ maintains the previous state. The fourth switching transistor $TR_4$ is in the conducting state, and the other switching transistors are in the non-conducting state.

The voltage $V_{gs}$ between the gate and the source of the driving transistor $TR_{Drv}$ becomes a voltage $(V_{th}'+V_{ofs}-V_{Sig_m})$ held by the capacitor unit CP. In addition, the driving voltage $V_{ccp}$ is applied to the source/drain region of one end of the driving transistor $TR_{Drv}$, and therefore a current flows towards the light-emitting unit ELP through the driving transistor $TR_{Drv}$, which causes an electric potential of the third node $ND_{3_S}$ to increase. At this point of time, a phenomenon similar to that of so-called a bootstrap circuit occurs in the gate electrode of the driving transistor $TR_{Drv}$. Basically, the electric potential of the first node $ND_{1_G}$ increases so as to maintain the voltage $V_{gs}$ between the gate and the source.

In addition, the electric potential of the third node $ND_{3_S}$ increases, and exceeds $(V_{th\text{-}EL}+V_{cath})$, and therefore the light-emitting unit ELP starts light emission. The current $I_{ds}$ flowing through the light-emitting unit ELP is represented by the following equation (6).

$$I_{ds}=k\cdot\mu\cdot(V_{ofs}-V_{Sig_m}-(V_{th}-V_{th}'))^2 \quad (6)$$

Therefore, since the influence exerted by the dispersion in threshold voltage $V_{th}$ of the driving transistor $TR_{Drv}$ of the display element 11 is canceled to some extent, the uneven brightness is reduced.

[Time period: $H_{m-1}$] (refer to FIGS. 19 and 23B)

This time period is a time period immediately before performing the next write processing. The voltage $V_{th}'$ is already held in the first capacitor $C_{S1}$, and thus the operation corresponding to the above-described [time period: $H'_{m-3}$] and [time period: $H'_{m-2}$] is omitted.

More specifically, the fourth control line $WS4_m$ is switched to a low level. The other control lines maintain the previous state. The first to fourth switching transistors $TR_1$ to $TR_4$ are in the non-conducting state.

The fourth switching transistor $TR_4$ is in the non-conducting state, and therefore a current flowing through the driving transistor $TR_{Drv}$ does not flow through the light-emitting unit ELP. Therefore, the light-emitting unit ELP switches off the light. In addition, the electric potential of the third node $ND_{3_S}$ decreases to $(V_{th\text{-}EL}+V_{cath})$. The first node $ND_{1_G}$ and the second node $ND_2$_S are in the floating state, and therefore these electric potentials also decrease according to the change in potential of the third node $ND_{3_S}$. The first capacitor $C_{S1}$ maintains a state in which the voltage $V_{th}'$ is held.

[Time period: $H''_m$] (refer to FIGS. 19 and 24A)

The next frame starts from this time period. A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ is switched to the high level. The other control lines maintain the previous state. The first switching transistor $TR_1$ and the second switching transistor $TR_2$ are in the conducting state. The other switching transistors are in the non-conducting state.

In the immediately preceding [time period: $H_{m-1}$], the voltage $V_{th}'$ is held in the first capacitor $C_{S1}$. Further, the video signal voltage $V_{Sig_m}$ is applied to the third node $ND_{3_S}$ through the first switching transistor $TR_1$ in the conducting state. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}'+V_{ofs}-V_{Sig_m})$.

[Time period: $H''_{m+1}$] (refer to FIGS. 19 and 24B)

The next frame light emission period starts from this time period. More specifically, the first control line $WS1_m$ is switched to a low level, and the fourth control line $WS4_m$ is switched to a high level. The second control line $WS2_m$ maintains the previous state. The fourth switching transistor $TR_4$ is in the conducting state, and the other switching transistors are in the non-conducting state. The specific operation is similar to the operation described in the above-described [time period: $H_{m+1}$], and therefore the description thereof will be omitted.

As described above, in the fourth embodiment as well, if the operation of holding the threshold voltage $V_{th}$ in the first capacitor $C_{S1}$ is performed in a certain frame, this operation can be omitted in a subsequent frame. Therefore, the power consumption can be further reduced while canceling the influence exerted by the dispersion in threshold voltage $V_{th}$ of the driving transistor $TR_{Drv}$.

Moreover, since the number of transistors that constitute the display element, and the number of control lines decrease, the fourth embodiment is also suitable for achieving high definition of the display device.

Fifth Embodiment

The fifth embodiment also relates to the display device, the display device driving method, and the display element according to the present disclosure.

The first to fourth embodiments described above each have the configuration in which when a voltage is held in the first capacitor $C_{S1}$, the electric potential of the third node $ND_{3_S}$ is caused to get close to a voltage obtained by subtracting the threshold voltage $V_{th}$ of the driving transistor $TR_{Drv}$ from the reference voltage $V_{ofs}$. Meanwhile, the fifth embodiment has a configuration in which when a voltage is held in the first capacitor $C_{S1}$, the electric potential of the first node $ND_{1_G}$ is caused to get close to an electric potential obtained by adding the threshold voltage $V_{th}$ of the driving transistor $TR_{Drv}$ to the reference voltage $V_{ofs}$.

Figure 25:
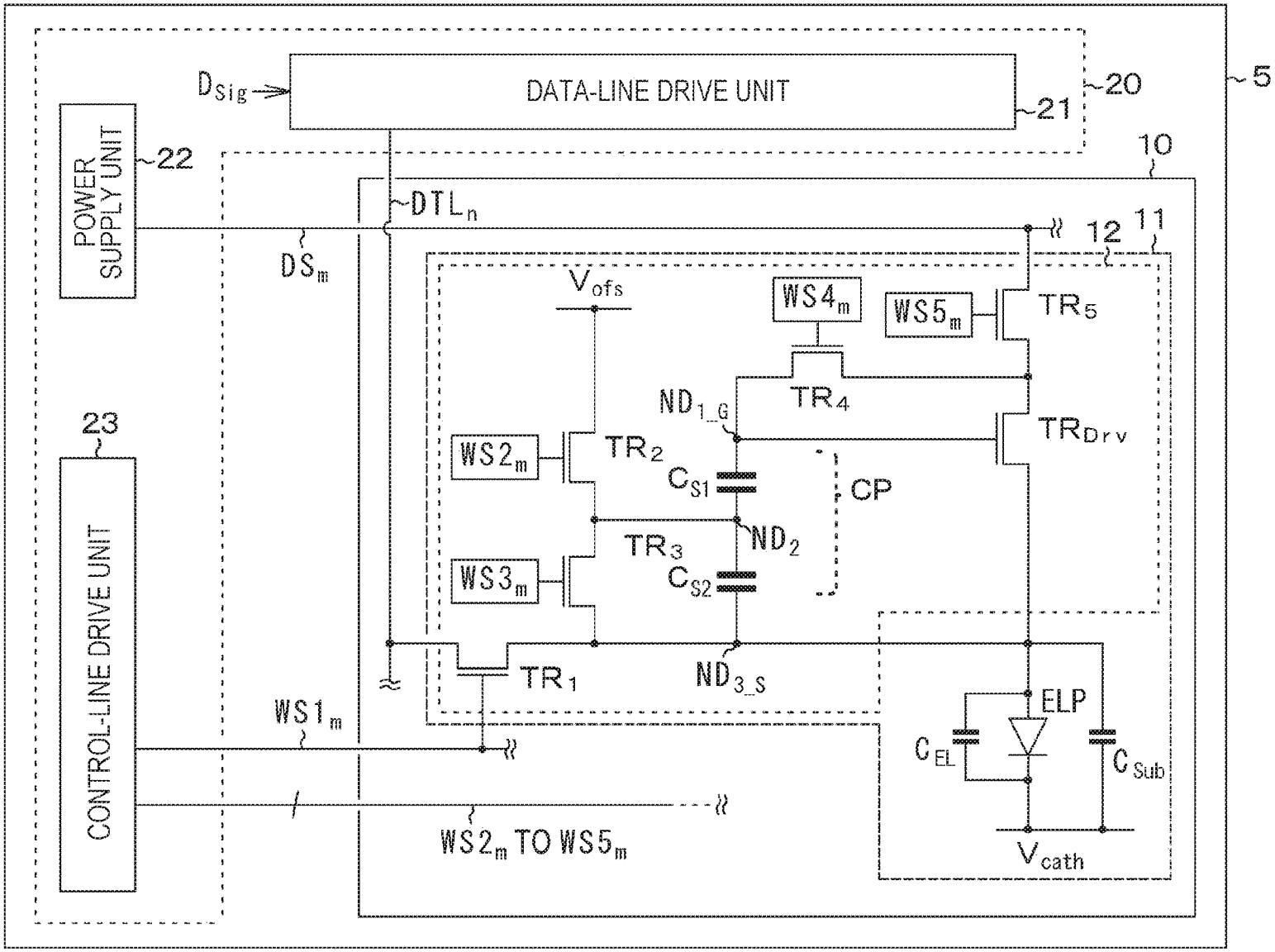
FIG. 25 is a conceptual diagram illustrating a display device according to a fifth embodiment.

FIG. 25 is a conceptual diagram illustrating a display device according to the fifth embodiment.

A display device 5 is also provided with: the display unit 10 in which the display elements 11 are arranged; and the drive unit 20 for driving the display unit 10. In the fifth embodiment, the data-line drive unit 21 supplies the video signal voltage $V_{Sig}$ to the data line DTL. The power supply unit 22 supplies a driving voltage $V_{ccp}$ to the electric supply line DS.

The capacitor unit CP, the driving transistor $TR_{Drv}$, and the first switching transistor $TR_1$ in the display element 11 are configured in a similar manner to that described in the first embodiment, and therefore the description thereof will be omitted. In the fifth embodiment, the drive unit 20 applies the reference voltage $V_{ofs}$ to the second node $ND_2$ and the third node $ND_{3_S}$, and supplies the driving voltage $V_{ccp}$ from the electric supply line DS in a state in which the first node $ND_{1_G}$ and one source/drain region of the driving transistor $TR_{Drv}$ electrically conduct with each other, thereby setting the voltage held by the capacitor unit CP so as to exceed the threshold voltage $V_{th}$ of the driving transistor $TR_{Drv}$. Subsequently, a connection between the electric supply line DS and the driving transistor $TR_{Drv}$ is interrupted in a state in which the reference voltage $V_{ofs}$ is applied to the second node $ND_2$ and the third node $ND_{3_S}$, so as to cause the electric potential of the first node $ND_{1_G}$ to get close to an electric potential obtained by adding the threshold voltage $V_{th}$ of the driving transistor $TR_{Drv}$ to the reference voltage $V_{ofs}$, thereby causing a voltage corresponding to the threshold voltage $V_{th}$ of the driving transistor $TR_{Drv}$ to be held in the first capacitor $C_{S1}$.

In the fifth embodiment, the display element 11 is further provided with the second switching transistor $TR_2$, the third switching transistor $TR_3$, the fourth switching transistor $TR_4$, and the fifth switching transistor $TR_5$. In the second switching transistor $TR_2$, a reference voltage $V_{ofs}$ is applied to one source/drain region, and the other source/drain region is connected to the second node $ND_2$. In the third switching transistor $TR_3$, one source/drain region is connected to the second node $ND_2$, and the other source/drain region is connected to the third node $ND_{3_S}$. A connection between the first node $ND_{1_G}$ and one source/drain region of the driving transistor $TR_{Drv}$ is made through the fourth switching transistor $TR_4$. A connection between the electric supply line DS and one source/drain region of the driving transistor $TR_{Drv}$ is made through the fifth switching transistor $TR_5$. The reference voltage $V_{ofs}$ is applied to the second node $ND_2$ and the third node $ND_{3_S}$ by bringing the second switching transistor $TR_2$ and the third switching transistor $TR_3$ into the conducting state. The first node $ND_{1_G}$ and one source/drain region of the driving transistor $TR_{Drv}$ are brought into the conducting state by bringing the fourth switching transistor $TR_4$ into the conducting state. The connection between the electric supply line DS and the driving transistor $TR_{Drv}$ is interrupted by bringing the fifth switching transistor $TR_5$ into the non-conducting state.

Next, the operation of the display device 5 will be described with reference to the accompanying drawings.

Figure 26:
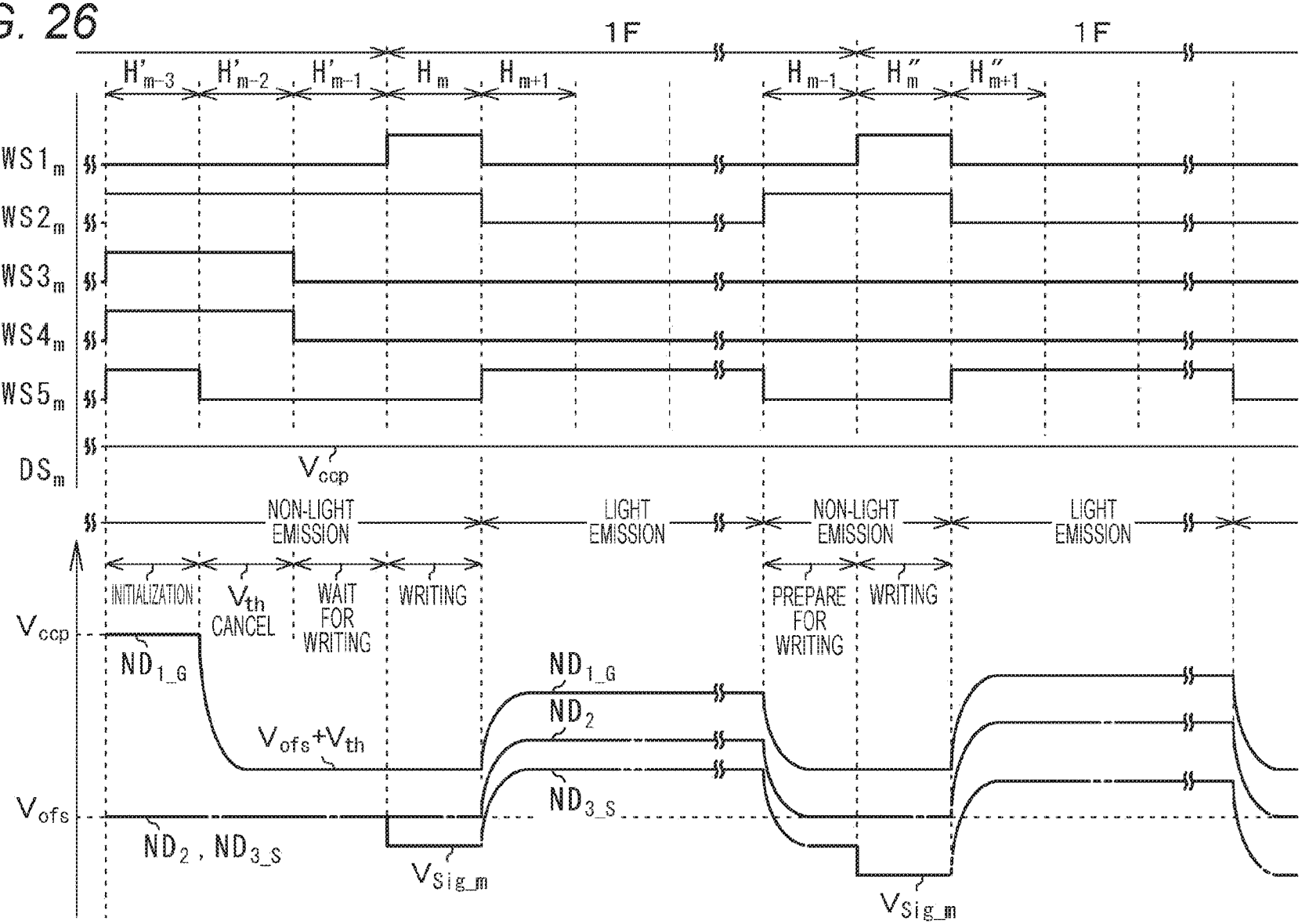
FIG. 26 is a schematic timing chart illustrating the operation of the display device according to the fifth embodiment, more specifically, the operation of the (n, m)th display element of the display device.
Figure 27A:
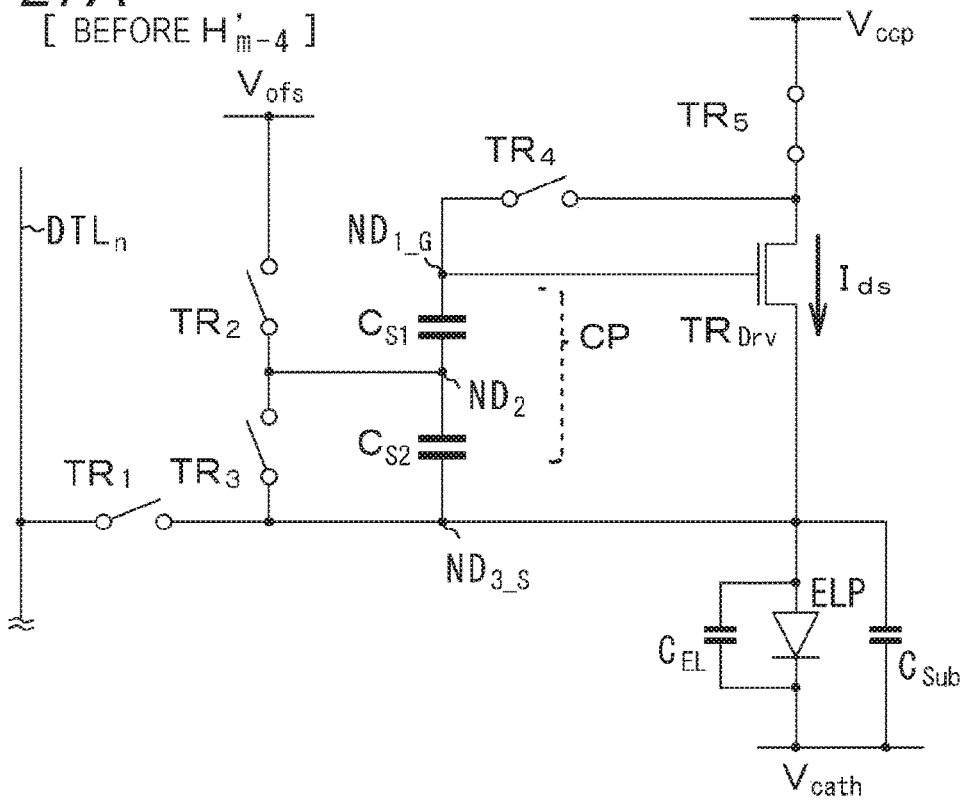
FIGS. 27A and 27B are drawings each schematically illustrating conducting state/non-conducting state and the like of each transistor that is included in a driving circuit of the display element of the display device according to the fifth embodiment.
Figure 27B:
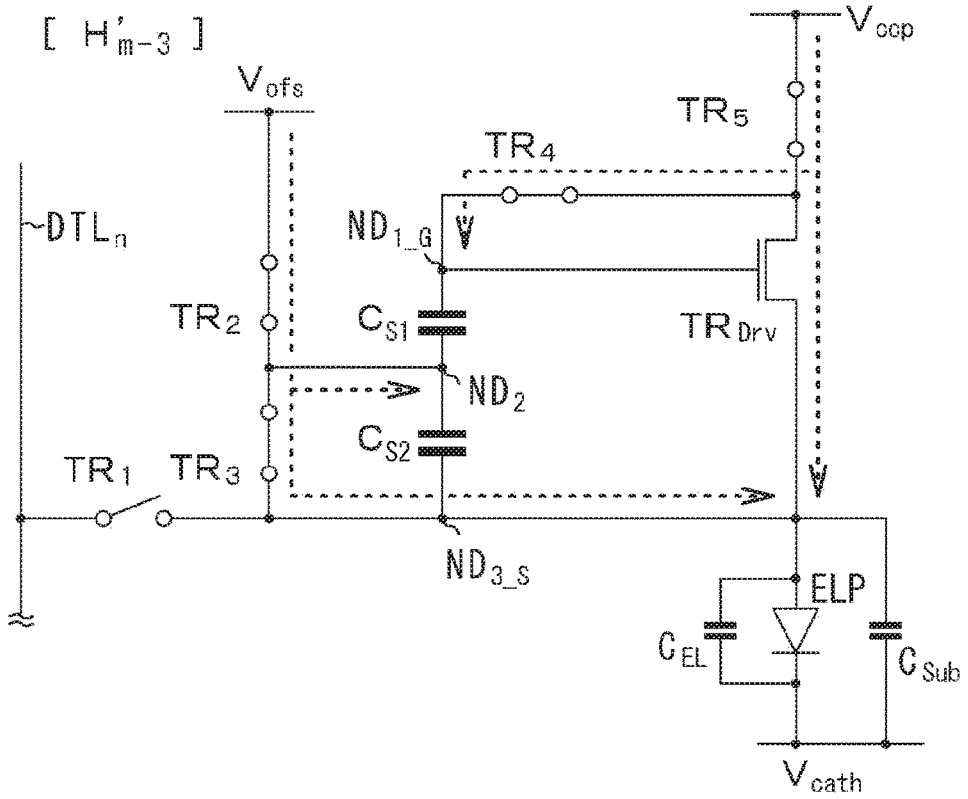

FIG. 26 is a schematic timing chart illustrating the operation of the display device according to the fifth embodiment, more specifically, the operation of the (n, m)th display element of the display device. FIGS. 27A, 27B, 28A, 28B, 29A, 29B, 30A, 30B, 31A, and 31B are drawings each schematically illustrating conducting state/non-conducting state and the like of each transistor that is included in a driving circuit of the display element of the display device according to the fifth embodiment.

[Time period: Before $H'_{m-4}$] (refer to FIG. 27A)

This time period is before the [time period $H'_{m-3}$] shown in FIG. 26, and is a time period during which the (n, m)th display element 11 continues light emission after the completion of various processings last time. The driving voltage $V_{ccp}$ is supplied to the electric supply line $DS_m$. The first to fourth switching transistors $TR_1$ to $TR_4$ are in the non-conducting state, and the fifth switching transistor $TR_5$ is in the conducting state. Although not illustrated in FIG. 26, the first to fourth control lines $WS1_m$ to $WS4_m$ are at a low level, and the fifth control line $WS5_m$ is at a high level. The drain current $I_{ds}$ represented by the above-described equation (1) flows through the light-emitting unit ELP, and thus the light-emitting unit ELP is in a light emitting state.

[Time period: $H'_{m-3}$] (refer to FIGS. 26 and 27B)

Initialization processing is performed during this time period. In other words, the reference voltage $V_{ofs}$ is applied to the second node $ND_2$ and the third node $ND_{3_S}$, and the driving voltage $V_{ccp}$ is supplied from the electric supply line $DS_m$ in a state in which the first node $ND_{1_G}$ and one source/drain region of the driving transistor $TR_{Drv}$ electrically conduct with each other, thereby setting the voltage held by the capacitor unit CP so as to exceed the threshold voltage $V_{th}$ of the driving transistor $TR_{Drv}$.

More specifically, the second to fourth control lines $WS2_m$ to $WS4_m$ are switched to a high level. The other control lines maintain the previous state. The second to fifth switching transistors $TR_2$ to $TR_5$ are in the conducting state. The first switching transistor $TR_1$ is in the non-conducting state.

The second node $ND_2$ and the third node $ND_{3_S}$ are in the conducting state through the third switching transistor $TR_3$. The reference voltage $V_{ofs}$ is applied to the second node $ND_2$ and the third node $ND_{3_S}$ through the second switching transistor $TR_2$. In addition, the driving voltage $V_{ccp}$ is applied from the electric supply line $DS_m$ to the first node $ND_{1_G}$ through the fourth switching transistor $TR_4$. Therefore, the voltage held by the capacitor unit CP becomes $(V_{ccp}-V_{ofs})$, and exceeds the threshold voltage $V_{th}$ of the driving transistor $TR_{Drv}$.

Incidentally, the driving voltage $V_{ccp}$ is applied from the electric supply line $DS_m$ to one end of the light-emitting unit ELP through the fifth switching transistor $TR_5$ and the driving transistor $TR_{Drv}$. Therefore, it is also considered that the light-emitting unit ELP performs unintended light emission. However, one end of the light-emitting unit ELP is connected to the third node $ND_{3_S}$, and therefore a path of a through current is formed through the fifth switching transistor $TR_5$, the driving transistor $TR_{Drv}$, the third switching transistor $TR_3$, and the second switching transistor $TR_2$. Taking the threshold voltage $V_{th\text{-}EL}$ of the light-emitting unit ELP or the like into consideration, it is considered that a current generally flows through the path of the through current.

[Time period: $H'_{m-2}$] (refer to FIGS. 26, 28A, and 28B)

Threshold voltage cancel processing is performed during this time period. In other words, by interrupting the connection between the electric supply line $DS_m$ and the driving transistor $TR_{Drv}$ in a state in which the reference voltage $V_{ofs}$ is applied to the second node $ND_2$ and the third node $ND_{3_S}$, the electric potential of the first node $ND_{1_G}$ is caused to get close to an electric potential obtained by adding the threshold voltage $V_{th}$ of the driving transistor $TR_{Drv}$ to the reference voltage $V_{ofs}$.

More specifically, the fifth control line $WS5_m$ is switched to a low level. The other control lines maintain the previous state. The second to fourth switching transistors $TR_2$ to $TR_4$ are in the conducting state. The first switching transistor $TR_1$ and the fifth switching transistor $TR_5$ are in the non-conducting state.

The reference voltage $V_{ofs}$ is applied to the second node $ND_2$ through the second switching transistor $TR_2$, and the reference voltage $V_{ofs}$ is applied to the third node $ND_{3_S}$ through the second switching transistor $TR_2$ and the third switching transistor $TR_3$.

Figure 28A:
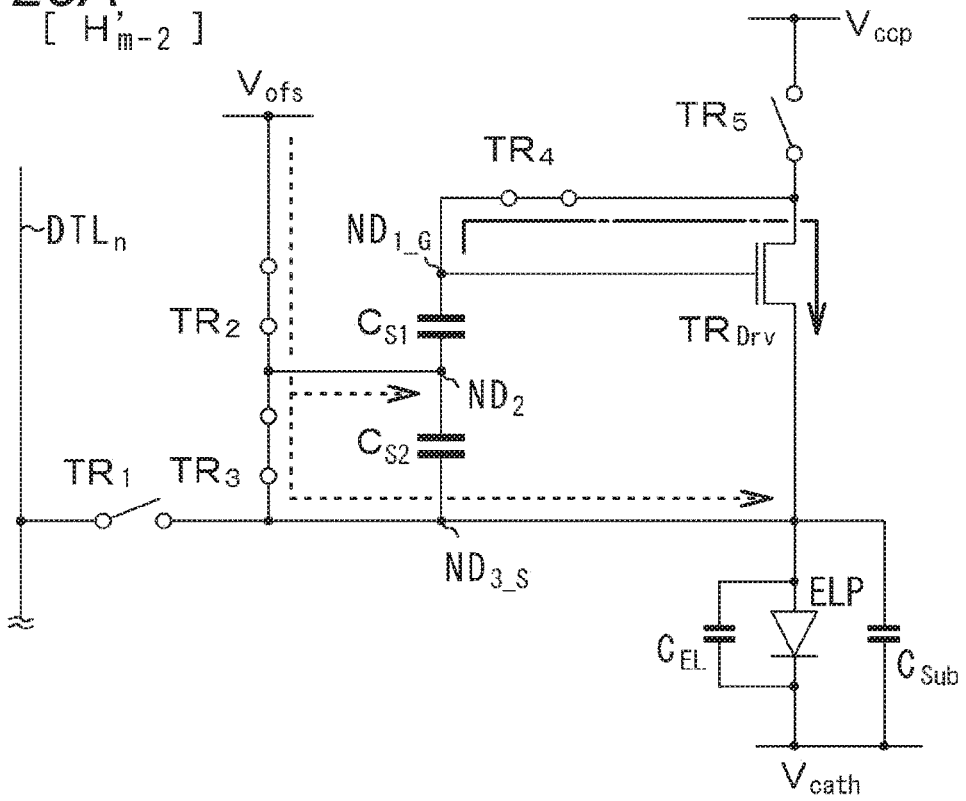

The fifth switching transistor $TR_5$ is in the non-conducting state, and therefore the electric supply line $DS_m$ is electrically isolated from one source/drain region of the driving transistor $TR_{Drv}$. The voltage $V_{gs}$ between the gate and the source of the driving transistor $TR_{Drv}$ is the voltage $(V_{ccp}-V_{ofs})$ held by the capacitor unit CP, and exceeds the threshold voltage $V_{th}$. In addition, the first node $ND_{1_G}$ and one source/drain region of the driving transistor $TR_{Drv}$ electrically conduct with each other by the fourth switching transistor $TR_4$. A current flows from the first node $ND_{1_G}$ through the driving transistor $TR_{Drv}$, which causes the electric potential of the first node $ND_{1_G}$ to decrease (FIG. 28A).

Figure 28B:
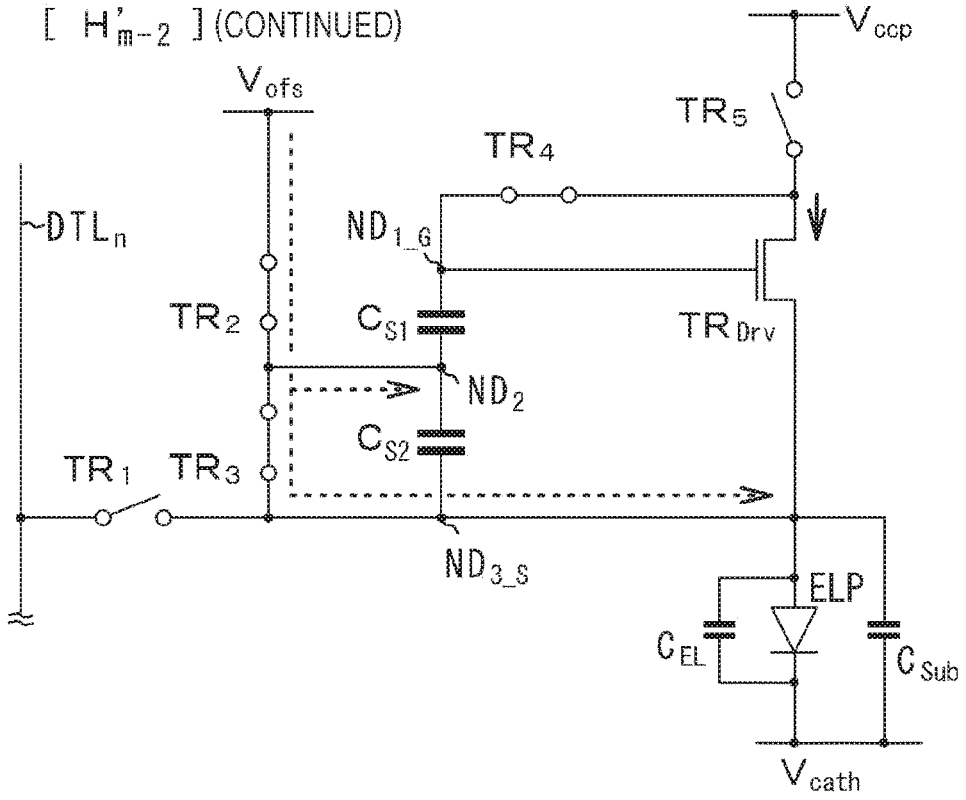
Figure 29A:
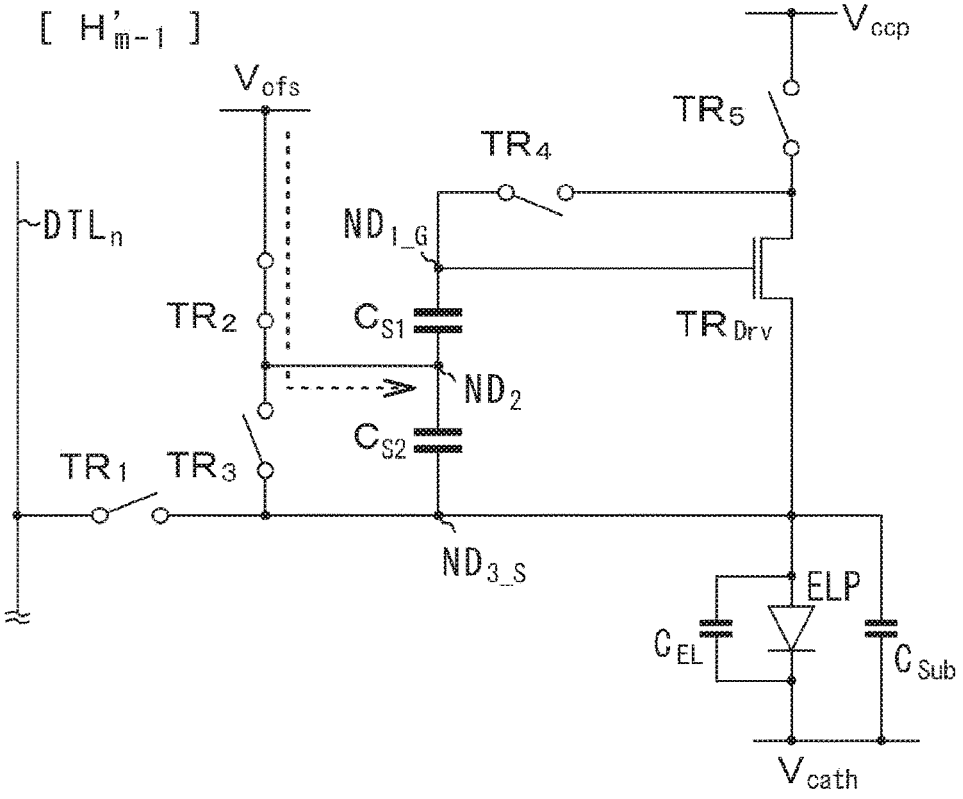
Figure 29B:
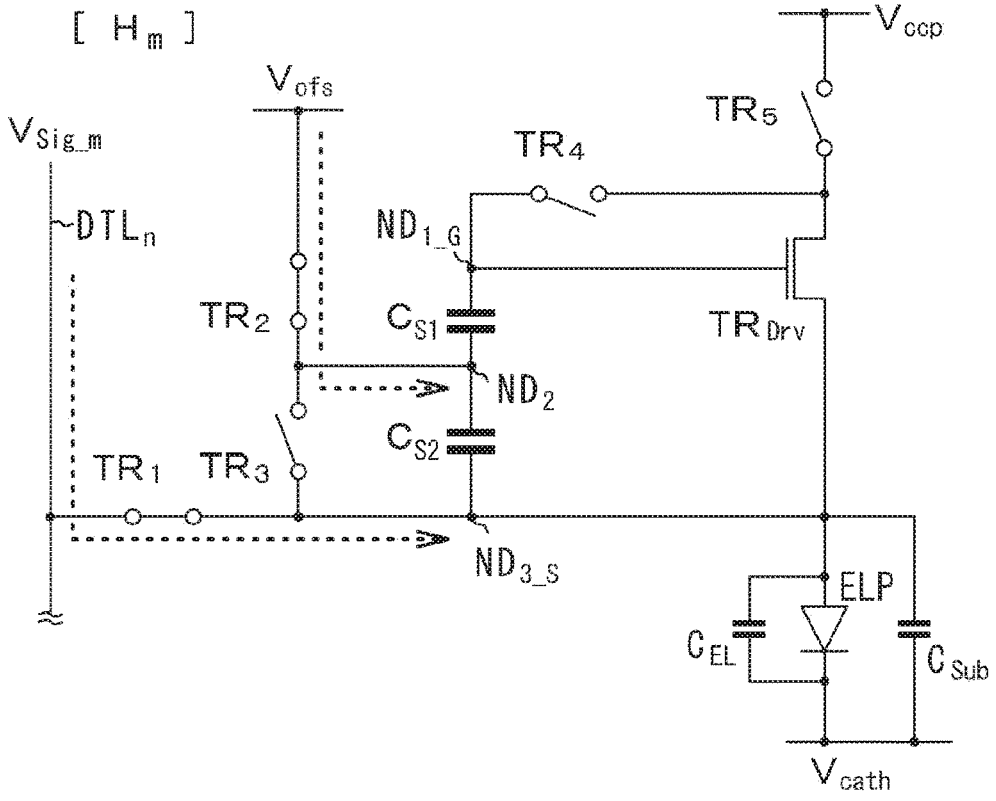
Figure 30A:
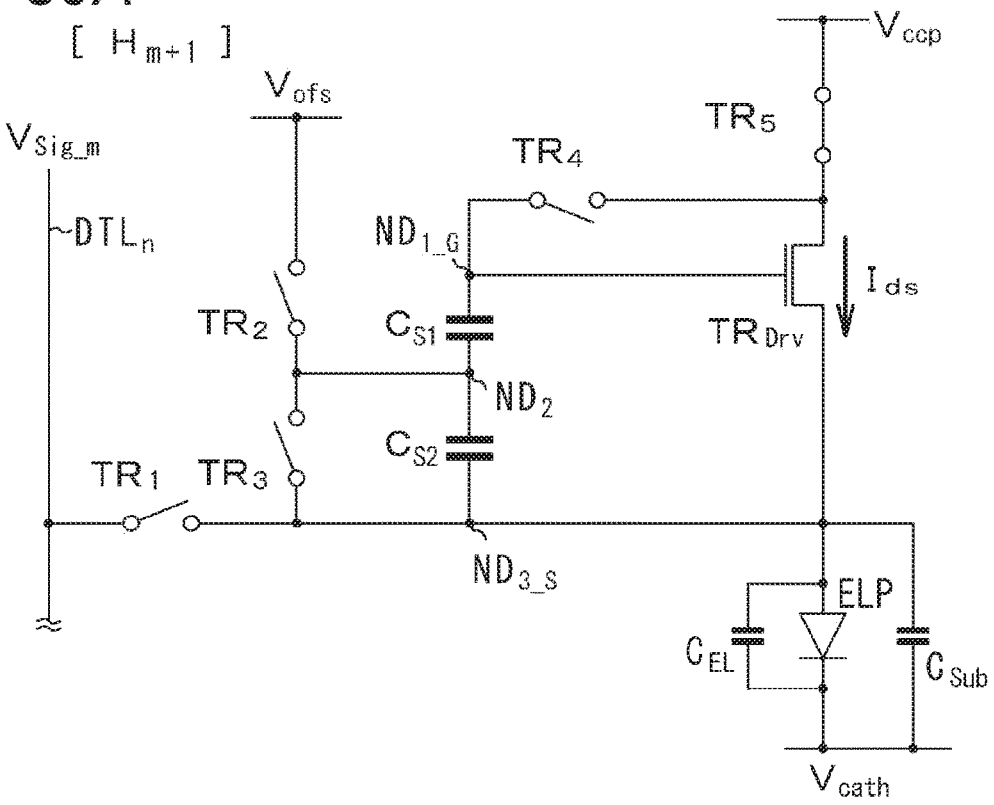
Figure 30B:
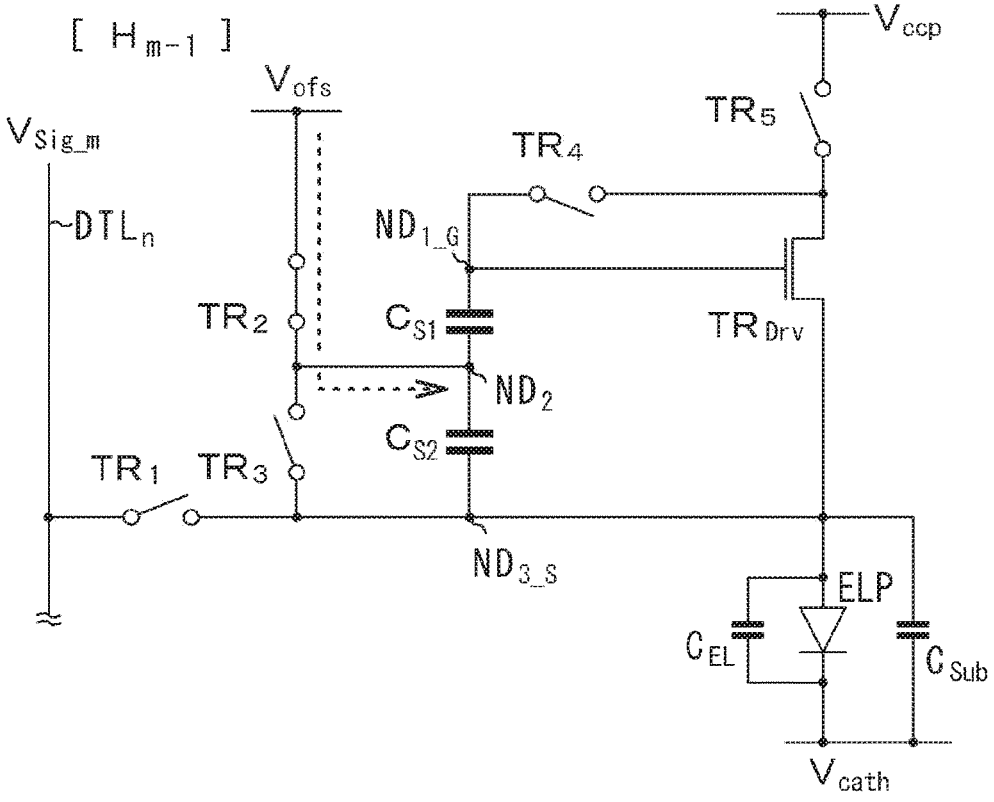
Figure 31A:
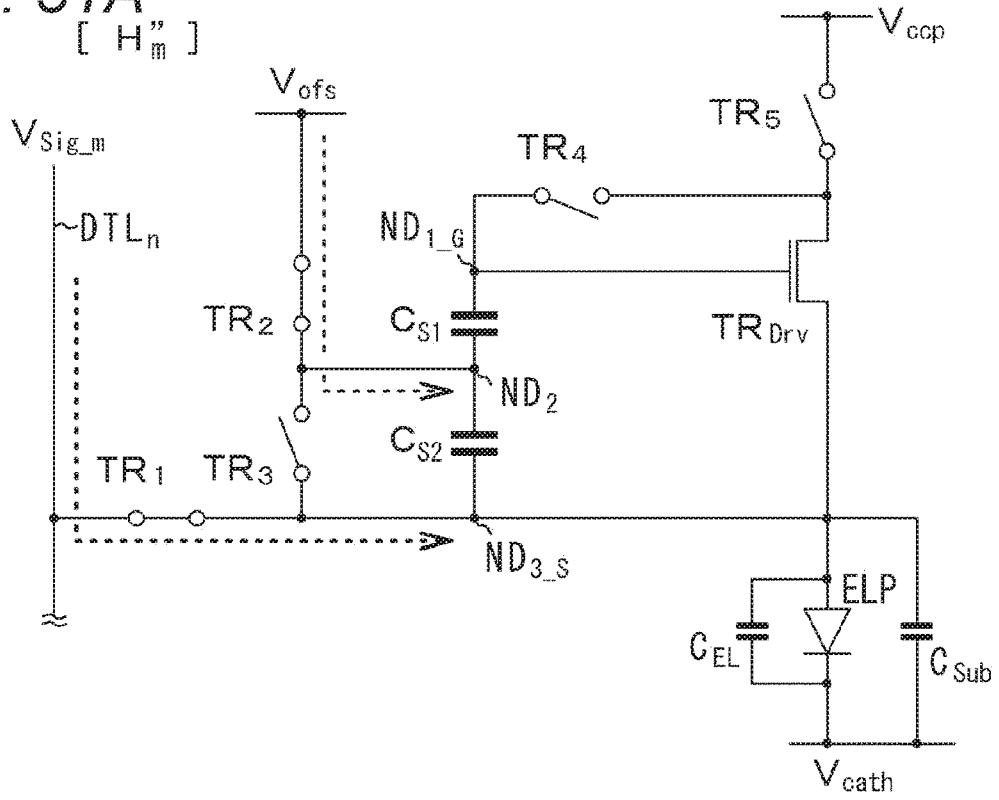
Figure 31B:
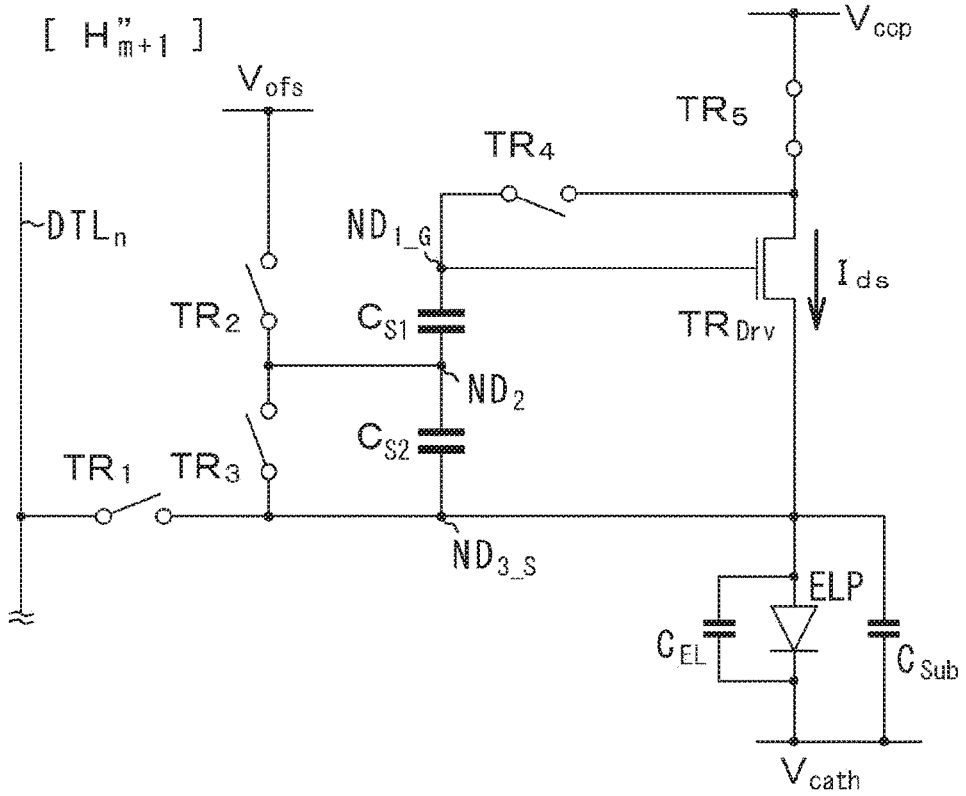

If this time period is sufficiently long, an electric potential difference between the gate electrode of the driving transistor $TR_{Drv}$ and the other source/drain region reaches $V_{th}$, and the driving transistor $TR_{Drv}$ enters the non-conducting state (refer to FIG. 28B). At this point of time, an electric potential difference between the first node $ND_{1_G}$ and the third node $ND_{3_S}$ becomes $V_{th}$. Electric potentials of the second node $ND_2$ and the third node $ND_{3_S}$ are $V_{ofs}$, and therefore the electric potential of the first node $ND_{1_G}$ is $(V_{ofs}+V_{th})$. Therefore, the voltage $V_{th}$ is held in the first capacitor $C_{S1}$. Electric potentials at both ends of the second capacitor $C_{S2}$ are the same, and thus the voltage held is 0 V.

Incidentally, for convenience of explanation, the explanation is made on the assumption that the driving transistor $TR_{Drv}$ is already in the non-conducting state during this time period. However, the present disclosure is not limited to this. A mode may be employed in which the time period ends before the electric potential difference between the gate electrode of the driving transistor $TR_{Drv}$ and the other source/drain region reaches $V_{th}$.

[Time period: $H'_{m-1}$] (refer to FIGS. 26 and 29A)

This time period is a time period immediately before performing the next write processing, and a time period for waiting for writing. The third control line $WS3_m$ and the fourth control line $WS4_m$ are switched to a low level, and the other control lines maintain the previous state.

The second switching transistor $TR_2$ is in the conducting state, and the first switching transistors $TR_1$, the fourth switching transistor $TR_4$, and the fifth switching transistor $TR_5$ are in the non-conducting state. If the driving transistor $TR_{Drv}$ is already in the non-conducting state in the [time period: $H'_{m-2}$], electric potentials of the first node $ND_{1_G}$, the second node $ND_2$, and the third node $ND_{3_S}$ do not substantially change. It should be noted that this time period may be omitted.

[Time period: $H_m$] (refer to FIGS. 26 and 29B)

A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ is switched to the high level. The other control lines maintain the previous state. The first switching transistor $TR_1$ and the second switching transistor $TR_2$ are in the conducting state. The other switching transistors are in the non-conducting state.

In the immediately preceding [time period: $H'_{m-1}$], the electric potential of the first node $ND_{1_G}$ is $(V_{ofs}+V_{th})$, the electric potential of the second node $ND_2$ is $V_{ofs}$, and the voltage $V_{th}$ is held in the first capacitor $C_{S1}$. The reference voltage $V_{ofs}$ is applied to the second node $ND_2$ through the first switching transistor $TR_1$. In addition, the video signal voltage $V_{Sig_m}$ is applied to the third node $ND_{3_S}$ through the first switching transistor $TR_1$. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}+V_{ofs}-V_{Sig_m})$.

[Time period: $H_{m+1}$] (refer to FIGS. 26 and 30A)

A light emission period ranges from this time period until the starting period of a scanning period [time period: $H_{m-1}$] immediately before the scanning period $H''_m$ in the m-th row in the next frame.

More specifically, the first control line $WS1_m$ and the second control line $WS2_m$ are switched to a low level, and the fifth control line $WS5_m$ is switched to a high level. The third control line $WS3_m$ and the fourth control line $WS4_m$ maintain the previous state. The fifth switching transistor $TR_5$ is in the conducting state, and the other switching transistors are in the non-conducting state.

The voltage $V_{gs}$ between the gate and the source of the driving transistor $TR_{Drv}$ becomes a voltage $(V_{th}+V_{ofs}-V_{Sig_m})$ held by the capacitor unit CP. In addition, the driving voltage $V_{ccp}$ is applied to the source/drain region of one end of the driving transistor $TR_{Drv}$, and therefore a current flows towards the light-emitting unit ELP through the driving transistor $TR_{Drv}$, which causes an electric potential of the third node $ND_{3_S}$ to increase. At this point of time, a phenomenon similar to that of so-called a bootstrap circuit occurs in the gate electrode of the driving transistor $TR_{Drv}$. Basically, the electric potential of the first node $ND_{1_G}$ increases so as to maintain the voltage $V_{gs}$ between the gate and the source.

In addition, the electric potential of the third node $ND_{3_S}$ increases, and exceeds $(V_{th\text{-}EL}+V_{cath})$, and therefore the light-emitting unit ELP starts light emission. As described in the first embodiment, the current $I_{ds}$ flowing through the light-emitting unit ELP is represented by the above-described equation (2), and therefore does not depend on the threshold voltage $V_{th}$ of the driving transistor $TR_{Drv}$. In other words, since the influence exerted by the dispersion in threshold voltage $V_{th}$ of the driving transistor $TR_{Drv}$ of the display element 11 is canceled, the uneven brightness is reduced.

[Time period: $H_{m-1}$] (refer to FIGS. 26 and 30A)

This time period is a time period immediately before performing the next write processing. The voltage $V_{th}$ is already held in the first capacitor $C_{S1}$, and thus the operation corresponding to the above-described [time period: $H'_{m-3}$] and [time period: $H'_{m-2}$] is omitted.

More specifically, the second control line $WS2_m$ is switched to a high level, and the fifth control line $WS5_m$ is switched to a low level. The other control lines maintain the previous state. The second switching transistor $TR_2$ is in the conducting state, and the other switching transistors are in the non-conducting state.

The reference voltage $V_{ofs}$ is applied to the second node $ND_2$, and therefore the electric potential of the second node $ND_2$ decreases to become $V_{ofs}$. The first node $ND_{1_G}$ is in a floating state, and therefore the electric potential of the first node $ND_{1_G}$ decreases according to the change in potential of the second node $ND_2$. The first capacitor $C_{S1}$ maintains a state in which the voltage $V_{th}$ is held. Incidentally, the electric potential of the third node $ND_{3_S}$ further decreases from $(V_{th\text{-}EL}+V_{cath})$ to some extent.

[Time period: $H''_m$] (refer to FIGS. 26 and 31A)

The next frame starts from this time period. A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ is switched to the high level. The other control lines maintain the previous state. The first switching transistor $TR_1$ and the second switching transistor $TR_2$ are in the conducting state. The other switching transistors are in the non-conducting state.

In the immediately preceding [time period: $H'_{m-1}$], the voltage $V_{th}$ is held in the first capacitor $C_{S1}$ in a state in which the electric potential of the second node $ND_2$ is $V_{ofs}$. Further, the video signal voltage $V_{Sig_m}$ is applied to the third node $ND_{3_S}$ through the first switching transistor $TR_1$ in the conducting state. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}+V_{ofs}-V_{Sig_m})$.

[Time period: $H''_{m+1}$] (refer to FIGS. 26 and 31B)

The next frame light emission period starts from this time period. More specifically, the first control line $WS1_m$ and the second control line $WS2_m$ are switched to a low level, and the fifth control line $WS5_m$ is switched to a high level. The fifth switching transistor $TR_5$ is in the conducting state, and the other switching transistors are in the non-conducting state. The specific operation is similar to the operation described in the above-described [time period: $H_{m+1}$], and therefore the description thereof will be omitted.

As described above, in the fifth embodiment as well, if the operation of holding the threshold voltage $V_{th}$ in the first capacitor $C_{S1}$ is performed in a certain frame, this operation can be omitted in a subsequent frame. Therefore, the power consumption can be further reduced while canceling the influence exerted by the dispersion in threshold voltage $V_{th}$ of the driving transistor $TR_{Drv}$.

In addition, in the first to fourth embodiments, the initialization voltage $V_{ini}$ as well as the reference voltage $V_{ofs}$ is required. In the fifth embodiment, the initialization voltage $V_{ini}$ is not required. Accordingly, the fifth embodiment also has an advantage of being capable of reducing kinds of voltages supplied by the drive unit.

Sixth Embodiment

The sixth embodiment also relates to the display device, the display device driving method, and the display element according to the present disclosure.

The sixth embodiment mainly differs from the fifth embodiment in the operation of the [time period: $H'_{m-3}$]. More specifically, a transistor is controlled so as not to form a path of a through current. With respect to a schematic diagram of a display device 6 according to the sixth embodiment, the display device 5 has only to be replaced with the display device 6 in FIG. 25.

As with the fifth embodiment, the data-line drive unit 21 supplies the video signal voltage $V_{Sig}$ to the data line DTL. The power supply unit 22 supplies a driving voltage $V_{ccp}$ to the electric supply line DS.

Figure 32:
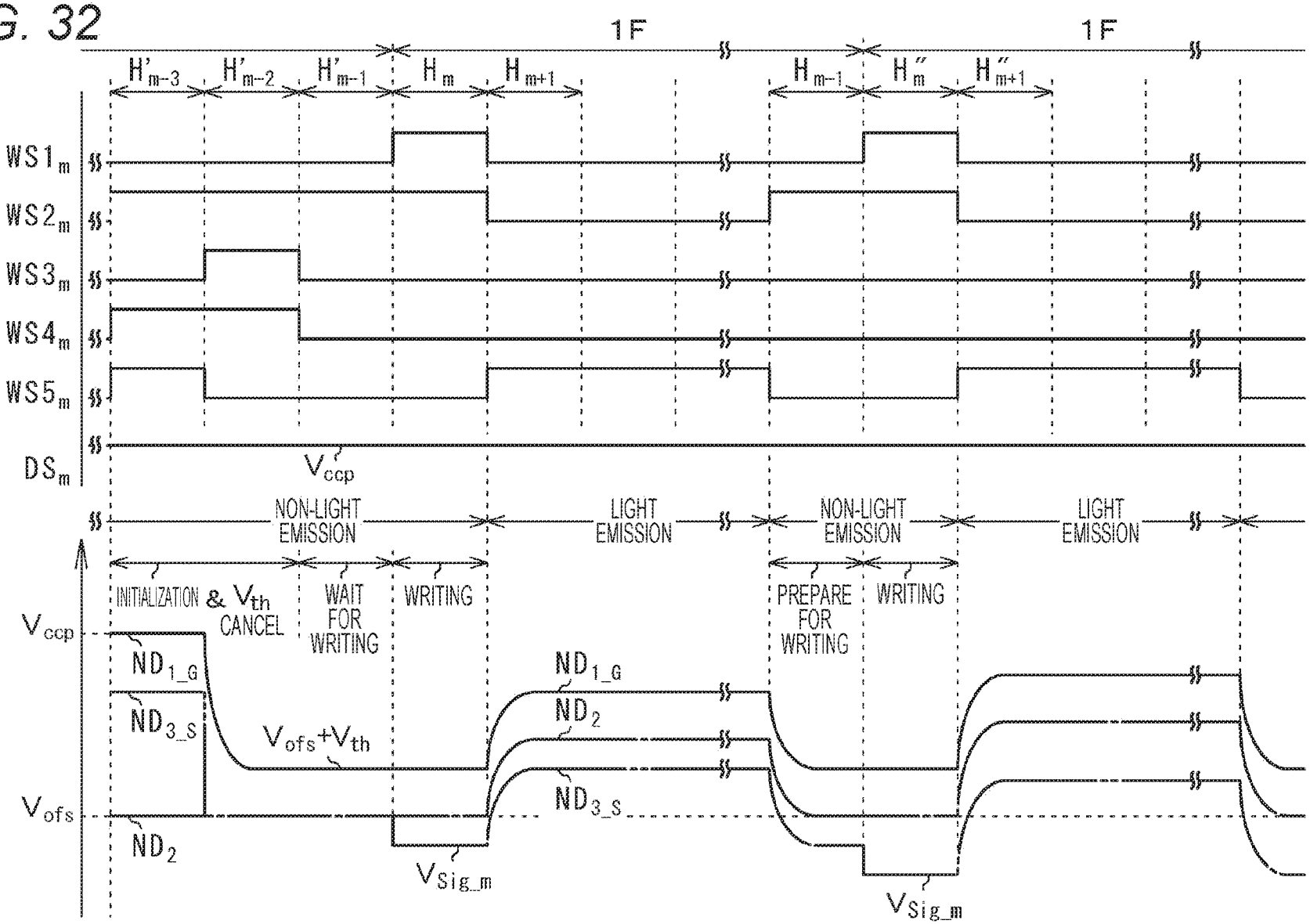
FIG. 32 is a schematic timing chart illustrating the operation of a display device according to a sixth embodiment, more specifically, the operation of the (n, m)th display element of the display device.
Figure 33A:
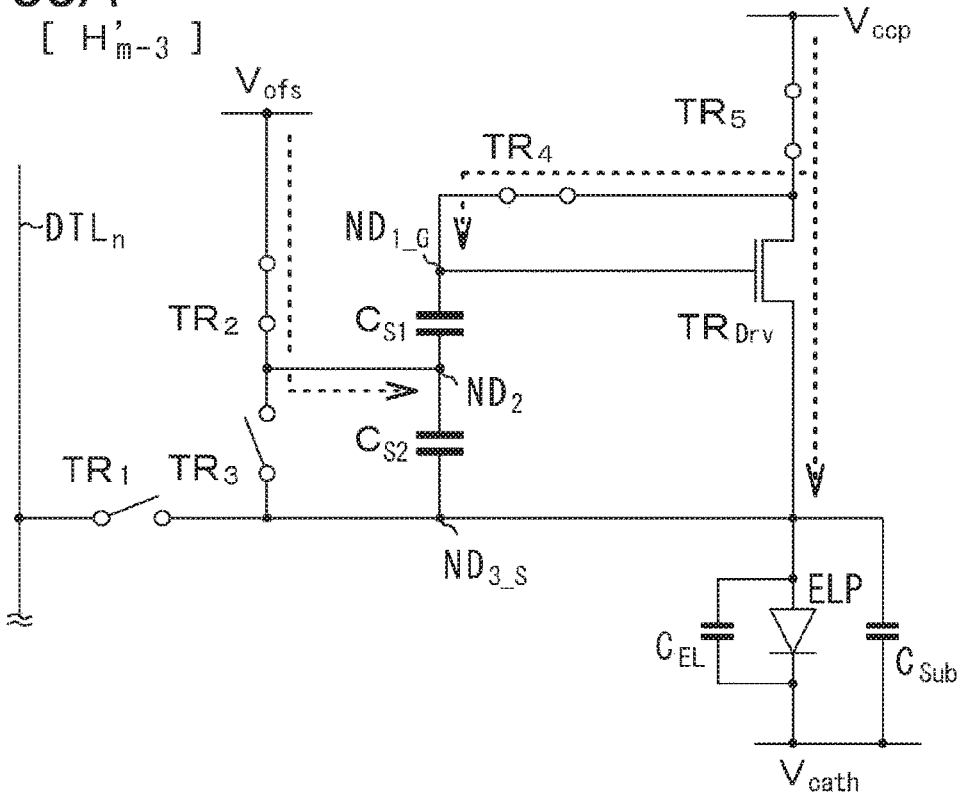
FIGS. 33A and 33B are drawings each schematically illustrating conducting state/non-conducting state and the like of each transistor that is included in a driving circuit of the display element of the display device according to the sixth embodiment.
Figure 33B:
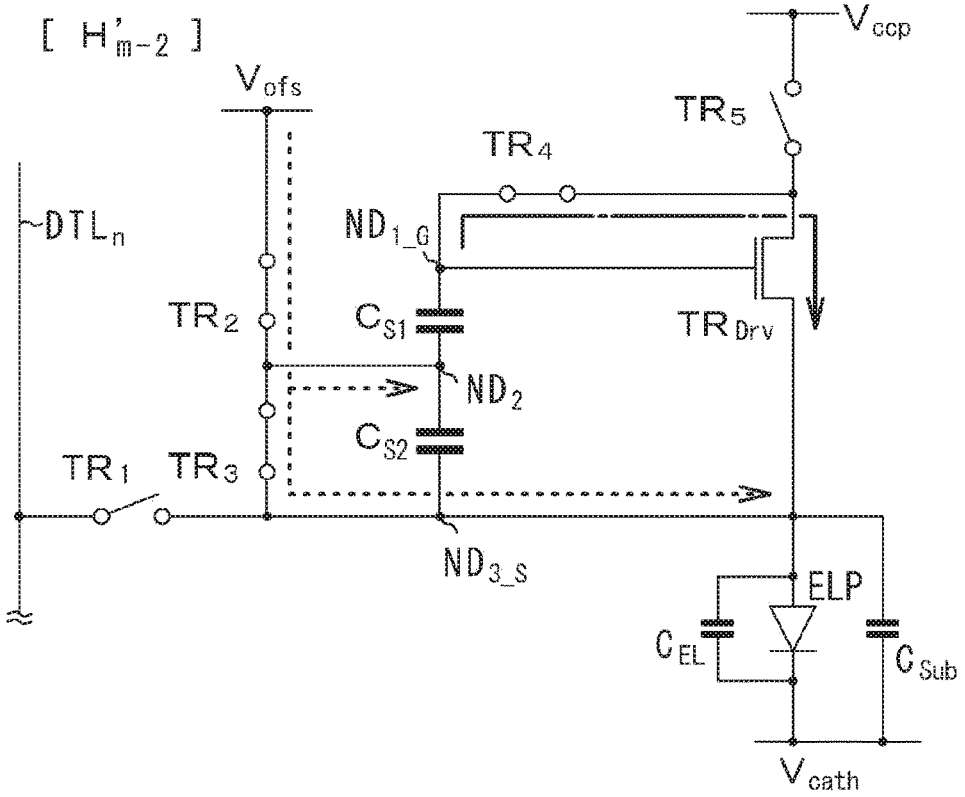

FIG. 32 is a schematic timing chart illustrating the operation of the display device according to the sixth embodiment, more specifically, the operation of the (n, m)th display element of the display device. FIGS. 33A and 33B show drawings each schematically illustrating conducting state/non-conducting state and the like of each transistor that is included in a driving circuit of the display element of the display device according to the sixth embodiment.

The operation before the [time period: $H'_{m-4}$] is similar to the operation described in the fifth embodiment, and therefore the description thereof will be omitted.

[Time period: $H'_{m-3}$] (refer to FIGS. 32 and 33A)

The first half of the initialization processing is performed during this time period. The second control line $WS2_m$ and the fourth control line $WS4_m$ are switched to a high level, and the other control lines maintain the previous state. The second switching transistor $TR_2$ and the fifth switching transistor $TR_5$ are in the conducting state. The other switching transistors are in the non-conducting state.

The reference voltage $V_{ofs}$ is applied to the second node $ND_2$ through the second switching transistor $TR_2$. In addition, the driving voltage $V_{ccp}$ is applied from the electric supply line $DS_m$ to the first node $ND_{1_G}$ through the fourth switching transistor $TR_4$. The driving voltage $V_{ccp}$ is applied from the electric supply line $DS_m$ to one end of the light-emitting unit ELP through the fifth switching transistor $TR_5$ and the driving transistor $TR_{Drv}$. A current flows through the light-emitting unit ELP, and unintended light emission occurs. The electric potential of the third node $ND_{3_S}$ exceeds ($V_{th\text{-}EL}+V_{cath}$), and becomes an electric potential corresponding to the light emission.

[Time period: $H'_{m-2}$] (refer to FIGS. 32 and 33B)

The latter half of the initialization processing and the threshold voltage cancel processing are performed during this time period. The third control line $WS3_m$ is switched to a high level, and the fifth control line $WS5_m$ is switched to a low level. The second to fourth switching transistors $TR_2$ to $TR_4$ are in the conducting state. The first switching transistor $TR_1$ and the fifth switching transistor $TR_5$ are in the non-conducting state.

The reference voltage $V_{ofs}$ is applied to the third node $ND_{3_S}$ through the second switching transistor $TR_2$ and the third switching transistor $TR_3$. In the starting period of this time period, an electric potential of the first node $ND_{1_G}$ is V. Therefore, in the starting period of this time period, the voltage held by the capacitor unit CP becomes ($V_{ofs}-V_{ini}$), and exceeds the threshold voltage $V_{th}$ of the driving transistor $TR_{Drv}$.

The reference voltage $V_{ofs}$ is applied to the second node $ND_2$ through the second switching transistor $TR_2$, and the reference voltage $V_{ofs}$ is applied to the third node $ND_{3_S}$ through the second switching transistor $TR_2$ and the third switching transistor $TR_3$. The fifth switching transistor $TR_5$ is in the non-conducting state, and therefore the electric supply line $DS_m$ is electrically isolated from one source/drain region of the driving transistor $TR_{Drv}$. The voltage $V_{gs}$ between the gate and the source of the driving transistor $TR_{Drv}$ is the voltage ($V_{ccp}-V_{ofs}$) held by the capacitor unit CP, and exceeds the threshold voltage $V_{th}$. In addition, the first node $ND_{1_G}$ and one source/drain region of the driving transistor $TR_{Drv}$ electrically conduct with each other by the fourth switching transistor $TR_4$. A current flows from the first node $ND_{1_G}$ through the driving transistor $TR_{Drv}$, which causes the electric potential of the first node $ND_{1_G}$ to decrease.

If this time period is sufficiently long, an electric potential difference between the gate electrode of the driving transistor $TR_{Drv}$ and the other source/drain region reaches $V_{th}$, and the driving transistor $TR_{Drv}$ enters the non-conducting state (refer to FIG. 28B). At this point of time, an electric potential difference between the first node $ND_{1_G}$ and the third node $ND_{3_S}$ becomes $V_{th}$. Electric potentials of the second node $ND_2$ and the third node $ND_{3_S}$ are $V_{ofs}$, and therefore the electric potential of the first node $ND_{1_G}$ is ($V_{ofs}+V_{th}$). Therefore, the voltage $V_{th}$ is held in the first capacitor $C_{S1}$. Electric potentials at both ends of the second capacitor $C_{S2}$ are the same, and thus the voltage held is 0 V.

The operation after the [time period: $H'_{m-1}$] shown in FIG. 32 is similar to the operation described in the fifth embodiment, and therefore the description thereof will be omitted.

As with the fifth embodiment, the sixth embodiment also does not require the initialization voltage $V_{ini}$, and therefore has the advantage of being capable of reducing kinds of voltages supplied by the drive unit. Further, the sixth embodiment also has the advantage of reducing a load of the element caused by the through current flowing through the transistor. It should be noted that since the contrast decreases due to unintended light emission, it is preferable that a time period during which the processing of the [time period: $H'_{m-3}$] is performed be set to be short.

Seventh Embodiment

The seventh embodiment also relates to the display device, the display device driving method, and the display element according to the present disclosure.

The seventh embodiment mainly differs from the fifth embodiment in that the other source/drain region of the driving transistor $TR_{Drv}$ is connected to one end of the light-emitting unit ELP through the sixth switching transistor. This enables a through current to be prevented from flowing at the time of initialization.

Figure 34:
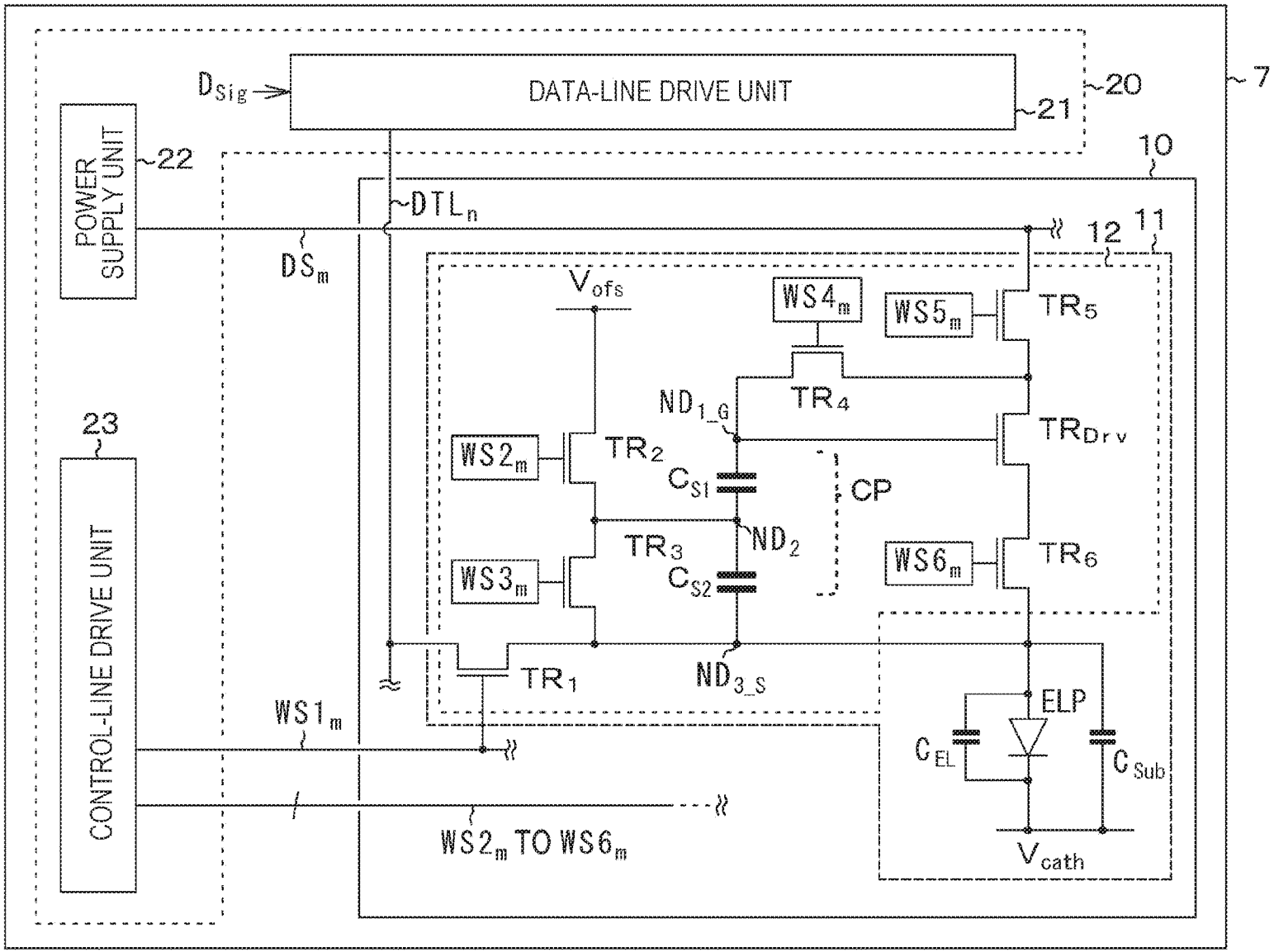
FIG. 34 is a conceptual diagram illustrating a display device according to a seventh embodiment.

FIG. 34 is a conceptual diagram illustrating a display device according to the seventh embodiment.

A display device 7 is also provided with: the display unit 10 in which the display elements 11 are arranged; and the drive unit 20 for driving the display unit 10. As with the sixth embodiment, the data-line drive unit 21 supplies the video signal voltage $V_{Sig}$ to the data line DTL. The power supply unit 22 supplies a driving voltage $V_{ccp}$ to the electric supply line DS.

The capacitor unit CP, the driving transistor $TR_{Drv}$, and the first switching transistor $TR_1$ in the display element 11 are configured in a similar manner to that described in the first embodiment, and therefore the description thereof will be omitted. In addition, the second to fifth switching transistors $TR_2$ to $TR_5$ are configured in a similar manner to that described in the fifth embodiment, and therefore the description thereof will be omitted.

In the seventh embodiment, the display element 11 is further provided with a sixth switching transistor $TR_6$. The other source/drain region of the driving transistor $TR_{Drv}$ is connected to one end of the light-emitting unit ELP through the sixth switching transistor $TR_6$. The conducting state/non-conducting state of the sixth switching transistor $TR_6$ is controlled by a signal of a sixth control line WS6.

Next, the operation of the display device 7 will be described with reference to the accompanying drawings.

Figure 35:
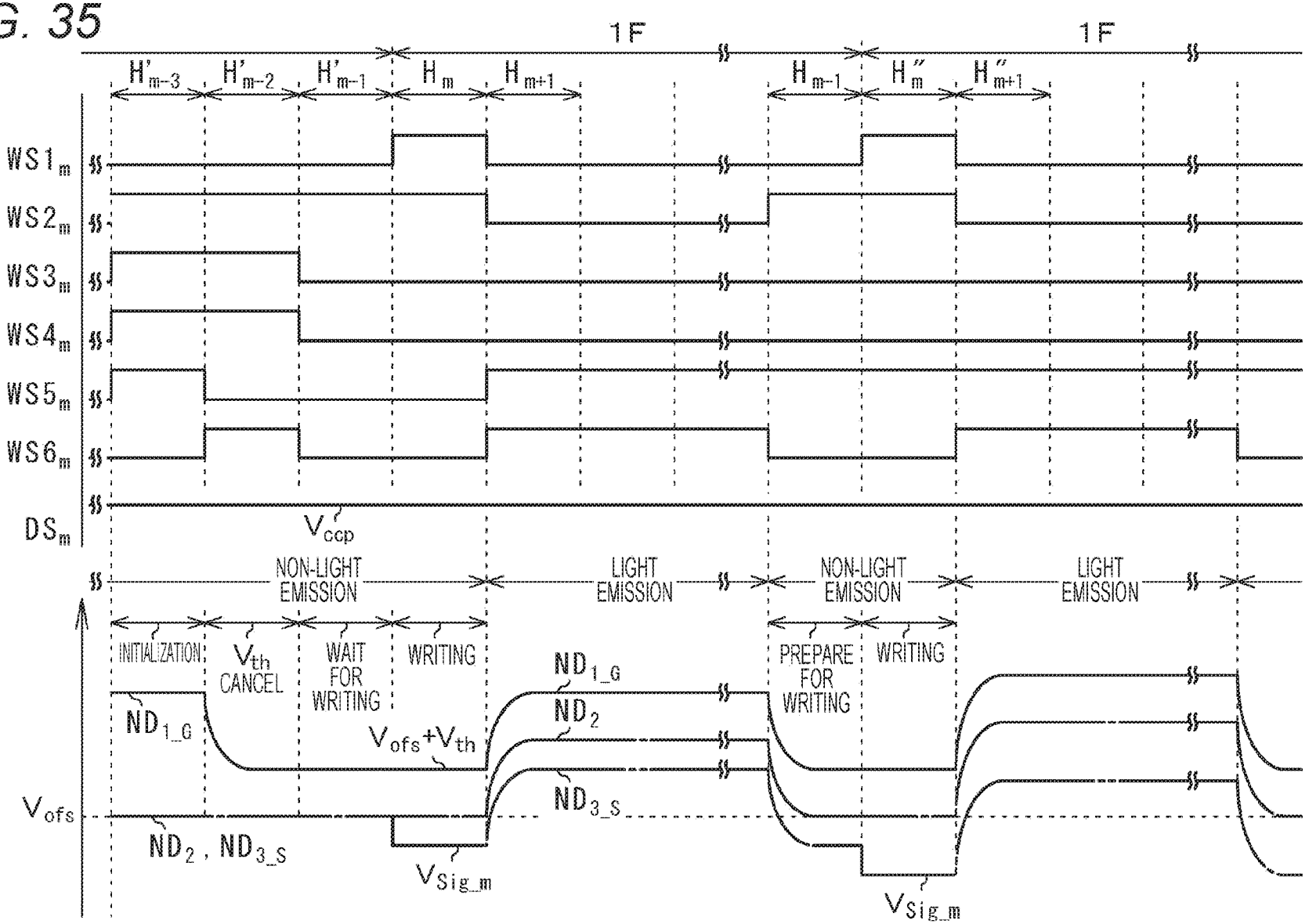
FIG. 35 is a schematic timing chart illustrating the operation of the display device according to the seventh embodiment, more specifically, the operation of the (n, m)th display element of the display device.
Figure 36A:
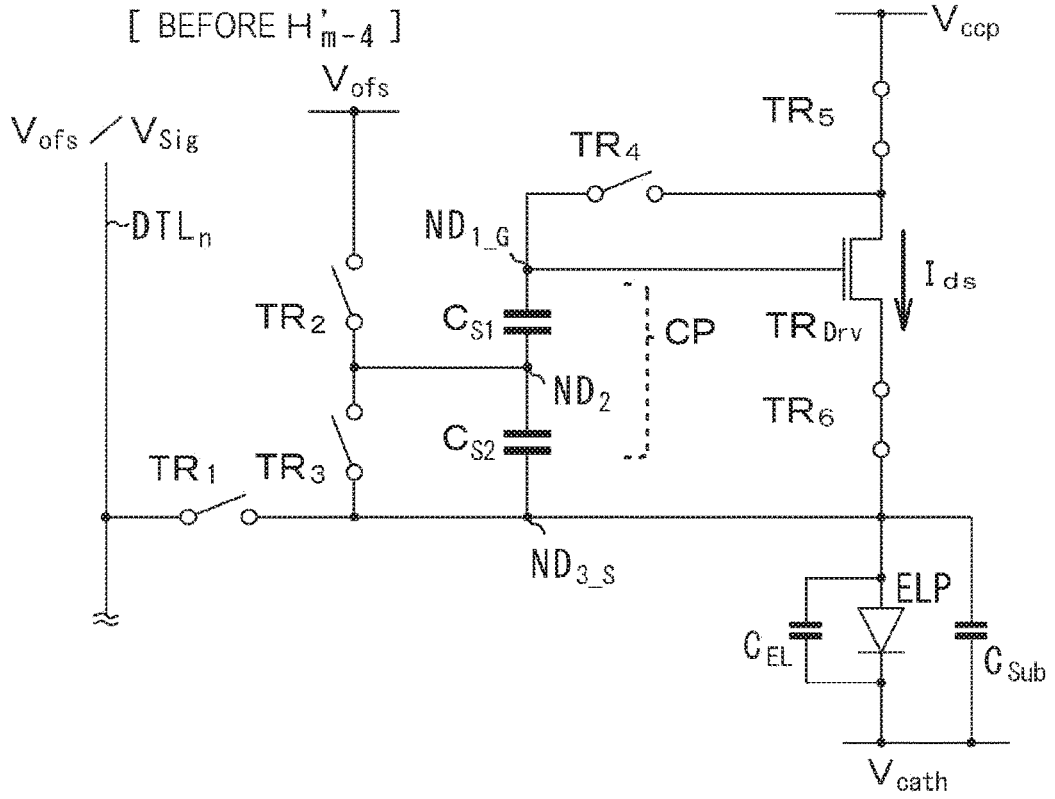
FIGS. 36A and 36B are drawings each schematically illustrating conducting state/non-conducting state and the like of each transistor that is included in a driving circuit of the display element of the display device according to the seventh embodiment.
Figure 36B:
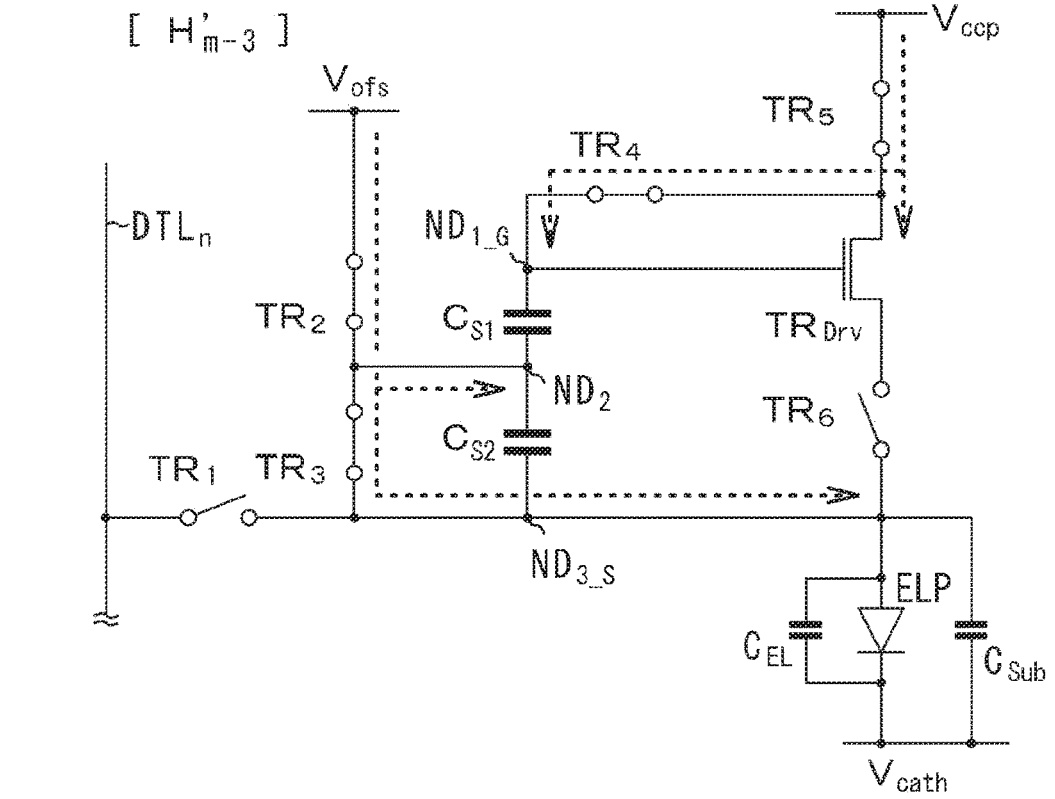

FIG. 35 is a schematic timing chart illustrating the operation of the display device according to the seventh embodiment, more specifically, the operation of the (n, m)th display element of the display device. FIGS. 36A, 36B, 37A, 37B, 38A, 38B, 39A, 39B, 40A, and 40B are drawings each schematically illustrating conducting state/non-conducting state and the like of each transistor that is included in a driving circuit of the display element of the display device according to the seventh embodiment.

[Time period: Before $H'_{m-4}$] (refer to FIG. 36A)

This time period is before the [time period $H'_{m-3}$] shown in FIG. 35, and is a time period during which the (n, m)th display element 11 continues light emission after the completion of various processings last time. The driving voltage $V_{ccp}$ is supplied to the electric supply line $DS_m$. The first to fourth switching transistors $TR_1$ to $TR_4$ are in the non-conducting state, and the fifth switching transistor $TR_5$ and the sixth switching transistor $TR_6$ are in the conducting state. Although not illustrated in FIG. 35, the first to fourth control lines $WS1_m$ to $WS4_m$ are at a low level, and the fifth control line $WS5_m$ and the sixth control line $WS6_m$ are at a high level. The drain current $I_{ds}$ represented by the above-described equation (1) flows through the light-emitting unit ELP, and thus the light-emitting unit ELP is in a light emitting state.

[Time period: $H'_{m-3}$] (refer to FIGS. 35 and 36B)

Initialization processing is performed during this time period. In other words, the reference voltage $V_{ofs}$ is applied to the second node $ND_2$ and the third node $ND_{3_S}$, and the driving voltage $V_{ccp}$ is supplied from the electric supply line $DS_m$ in a state in which the first node $ND_{1_G}$ and one source/drain region of the driving transistor $TR_{Drv}$ electrically conduct with each other, thereby setting the voltage held by the capacitor unit CP so as to exceed the threshold voltage $V_{th}$ of the driving transistor $TR_{Drv}$.

More specifically, the second to fourth control lines $WS2_m$ to $WS4_m$ are switched to a high level, and the sixth control line $WS6_m$ is switched to a low level. The other control lines maintain the previous state. The second to fifth switching transistors $TR_2$ to $TR_5$ are in the conducting state. The first switching transistor $TR_1$ and the sixth switching transistor $TR_6$ are in the non-conducting state.

The second node $ND_2$ and the third node $ND_{3_S}$ are in the conducting state through the third switching transistor $TR_3$. The reference voltage $V_{ofs}$ is applied to the second node $ND_2$ and the third node $ND_{3_S}$ through the second switching transistor $TR_2$. In addition, the driving voltage $V_{ccp}$ is applied from the electric supply line $DS_m$ to the first node $ND_{1_G}$ through the fourth switching transistor $TR_4$. Therefore, the voltage held by the capacitor unit CP becomes $(V_{ccp}-V_{ofs})$, and exceeds the threshold voltage $V_{th}$ of the driving transistor $TR_{Drv}$.

In addition, the sixth switching transistor $TR_6$ is in the non-conducting state, and therefore the light-emitting unit ELP is electrically isolated from the other source/drain region of the driving transistor $TR_{Drv}$. Therefore, differently from the fifth embodiment, a through current does not flow.

[Time period: $H'_{m-2}$] (refer to FIGS. 35, 37A, and 37B)

Threshold voltage cancel processing is performed during this time period. In other words, by interrupting the connection between the electric supply line $DS_m$ and the driving transistor $TR_{Drv}$ in a state in which the reference voltage $V_{ofs}$ is applied to the second node $ND_2$ and the third node $ND_{3_S}$, the electric potential of the first node $ND_{1_G}$ is caused to get close to an electric potential obtained by adding the threshold voltage $V_{th}$ of the driving transistor $TR_{Drv}$ to the reference voltage $V_{ofs}$.

More specifically, the fifth control line $WS5_m$ is switched to a low level, and the sixth control line $WS6_m$ is switched to a high level. The other control lines maintain the previous state. The second switching transistor $TR_2$, the third switching transistor $TR_3$, the fourth switching transistor $TR_4$, and the sixth switching transistor $TR_6$ are in the conducting state. The first switching transistor $TR_1$ and the fifth switching transistor $TR_6$ are in the non-conducting state.

Figure 37A:
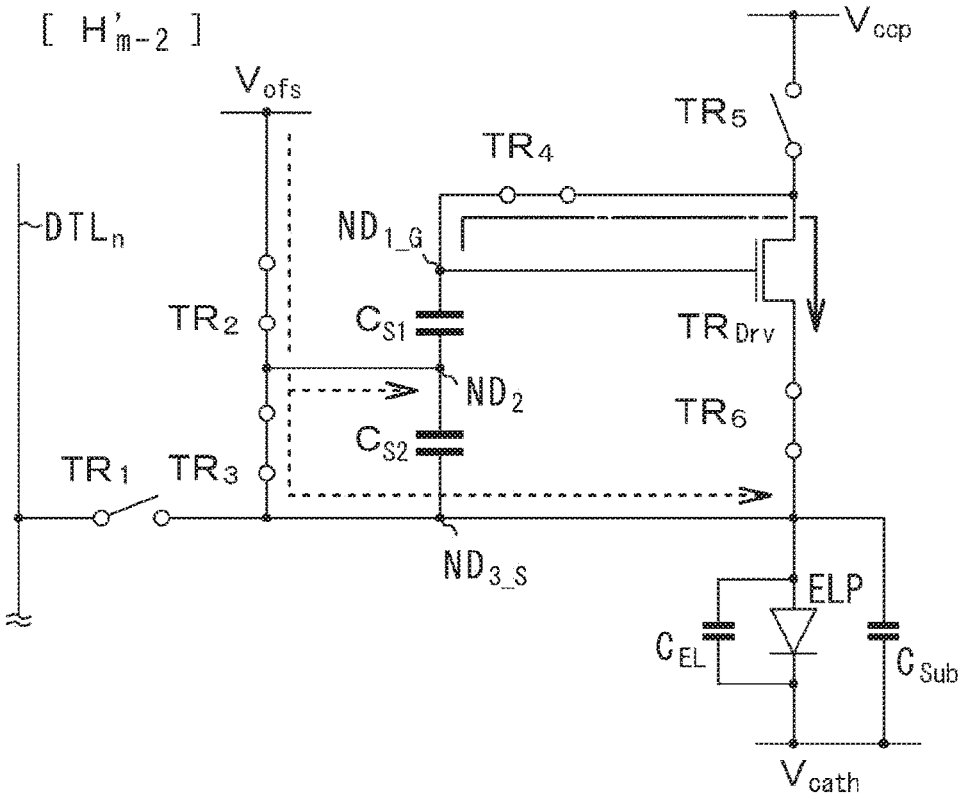
Figure 37B:
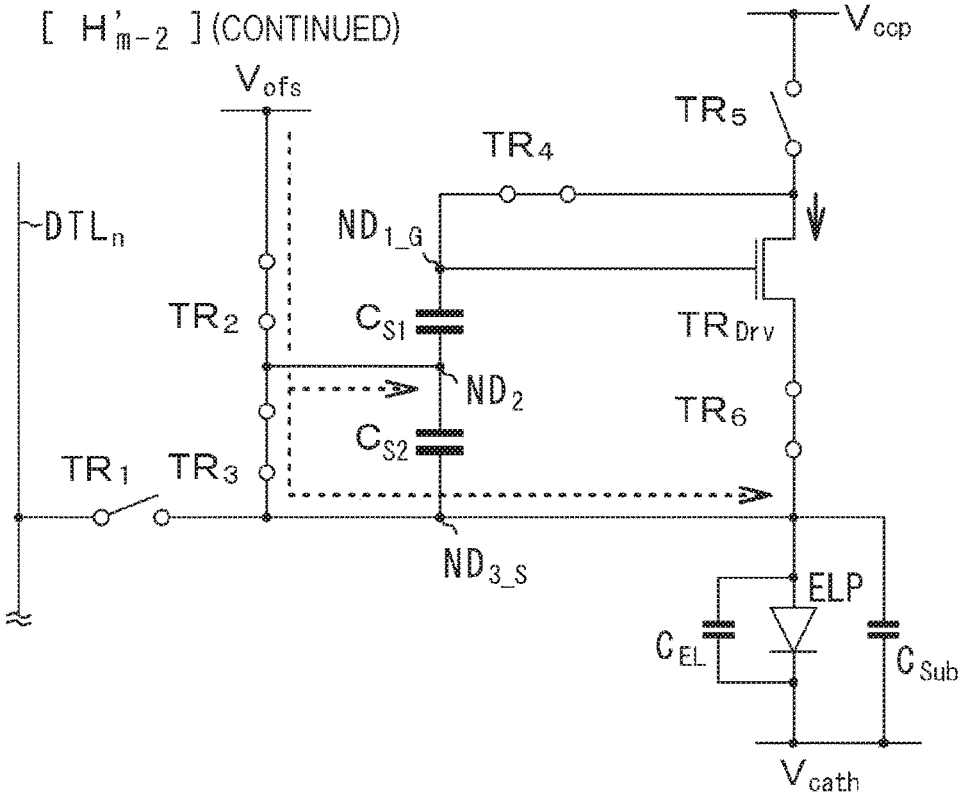
Figure 38A:
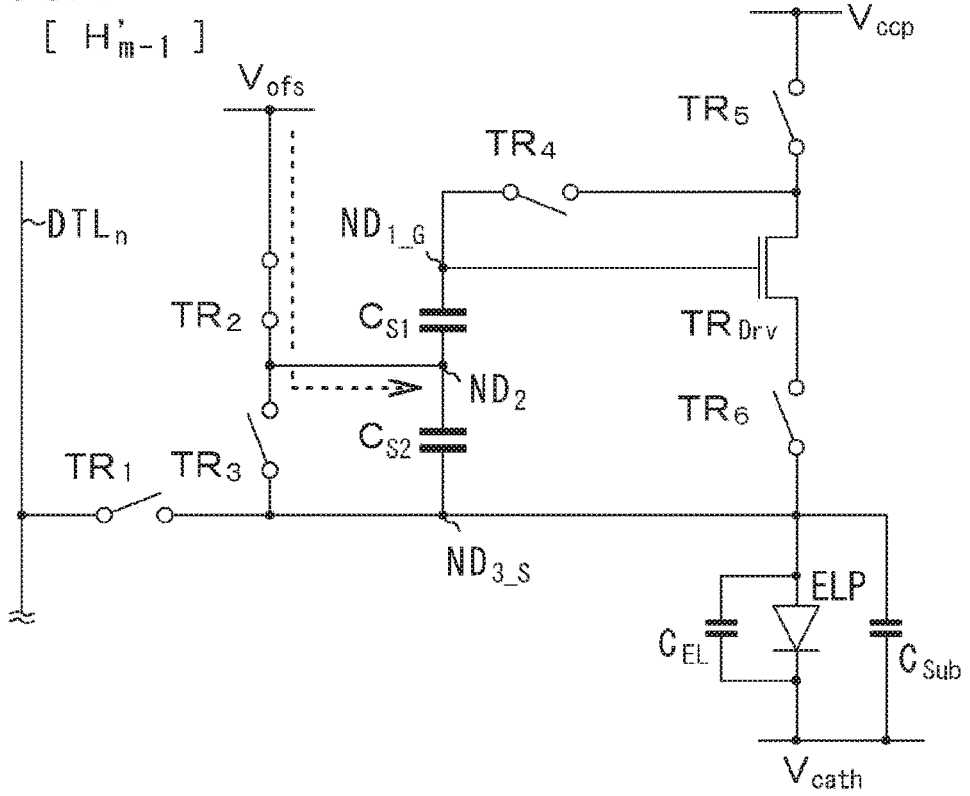
Figure 38B:
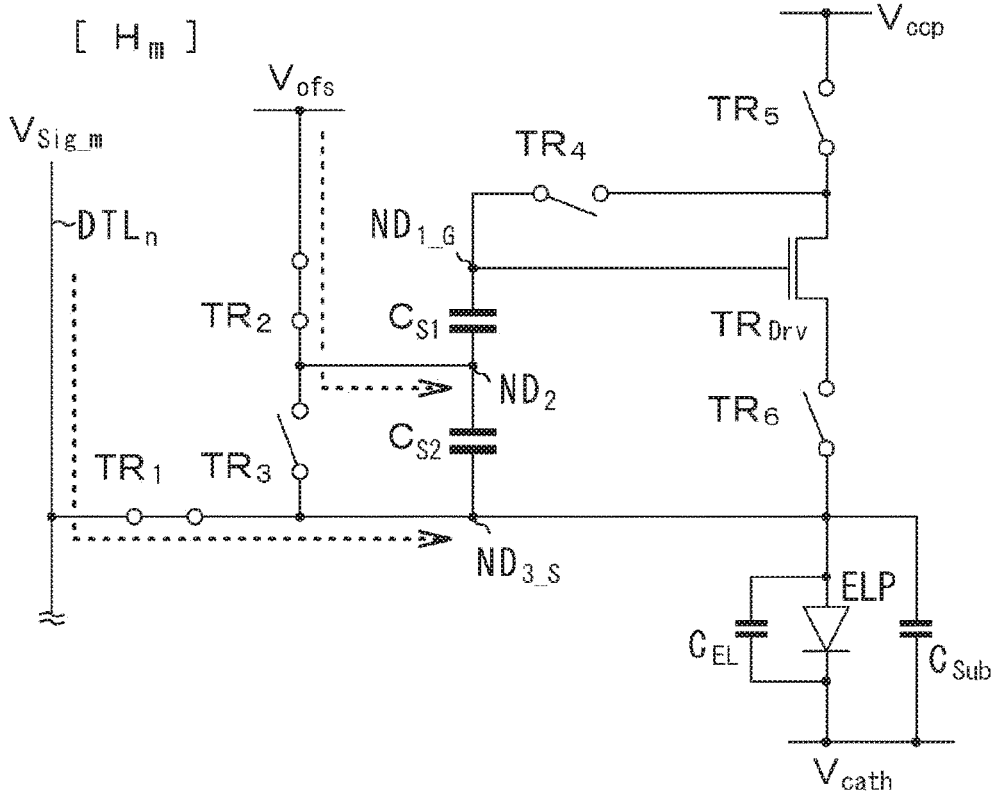

The reference voltage $V_{ofs}$ is applied to the second node $ND_2$ through the second switching transistor $TR_2$, and the reference voltage $V_{ofs}$ is applied to the third node $ND_{3_S}$ through the second switching transistor $TR_2$ and the third switching transistor $TR_3$. The fifth switching transistor $TR_5$ is in the non-conducting state, and therefore the electric supply line $DS_m$ is electrically isolated from one source/drain region of the driving transistor $TR_{Drv}$. The voltage $V_{gs}$ between the gate and the source of the driving transistor $TR_{Drv}$ is the voltage $(V_{ccp}-V_{ofs})$ held by the capacitor unit CP, and exceeds the threshold voltage $V_{th}$. In addition, the first node $ND_{1_G}$ and one source/drain region of the driving transistor $TR_{Drv}$ electrically conduct with each other by the fourth switching transistor $TR_4$. A current flows from the first node $ND_{1_G}$ through the driving transistor $TR_{Drv}$, which causes the electric potential of the first node $ND_{1_G}$ to decrease (FIG. 37A).

If this time period is sufficiently long, an electric potential difference between the gate electrode of the driving transistor $TR_{Drv}$ and the other source/drain region reaches $V_{th}$, and the driving transistor $TR_{Drv}$ enters the non-conducting state (refer to FIG. 33B). At this point of time, an electric potential difference between the first node $ND_{1_G}$ and the third node $ND_{3_S}$ becomes $V_{th}$. Electric potentials of the second node $ND_2$ and the third node $ND_{3_S}$ are $V_{ofs}$, and therefore the electric potential of the first node $ND_{1_G}$ is $(V_{ofs}+V_{th})$. Therefore, the voltage $V_{th}$ is held in the first capacitor $C_{S1}$. Electric potentials at both ends of the second capacitor $C_{S2}$ are the same, and thus the voltage held is 0 V.

Incidentally, for convenience of explanation, the explanation is made on the assumption that the driving transistor $TR_{Drv}$ is already in the non-conducting state during this time period. However, the present disclosure is not limited to this. A mode may be employed in which the time period ends before the electric potential difference between the gate electrode of the driving transistor $TR_{Drv}$ and the other source/drain region reaches $V_{th}$.

[Time period: $H'_{m-1}$] (refer to FIGS. 35 and 38A)

This time period is a time period immediately before performing the next write processing, and a time period for waiting for writing. The third control line $WS3_m$, the fourth control line $WS4_m$, and the sixth control line $WS6_m$ are switched to a low level, and the other control lines maintain the previous state. The second switching transistor $TR_2$ is in the conducting state, and the other switching transistors are in the non-conducting state. If the driving transistor $TR_{Drv}$ is already in the non-conducting state in the [time period: $H'_{m-2}$], electric potentials of the first node $ND_{1_G}$, the second node $ND_2$, and the third node $ND_{3_S}$ do not substantially change. It should be noted that this time period may be omitted.

[Time period: $H_m$] (refer to FIGS. 35 and 38B)

A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ is switched to the high level. The other control lines maintain the previous state. The first switching transistor $TR_1$ and the second switching transistor $TR_2$ are in the conducting state. The other switching transistors are in the non-conducting state.

In the immediately preceding [time period: $H'_{m-1}$], the electric potential of the first node $ND_{1_G}$ is $(V_{ofs}+V_{th})$, the electric potential of the second node $ND_2$ is $V_{ofs}$, and the voltage $V_{th}$ is held in the first capacitor $C_{S1}$. The reference voltage $V_{ofs}$ is applied to the second node $ND_2$ through the first switching transistor $TR_1$. In addition, the video signal voltage $V_{Sig_m}$ is applied to the third node $ND_{3_S}$ through the first switching transistor $TR_1$. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}+V_{ofs}-V_{Sig_m})$.

[Time period: $H_{m+1}$] (refer to FIGS. 35 and 39A)

A light emission period ranges from this time period until the starting period of a scanning period [time period: $H_{m-1}$] immediately before the scanning period $H''_m$ in the m-th row in the next frame.

More specifically, the first control line $WS1_m$ and the second control line $WS2_m$ are switched to a low level, and the fifth control line $WS5_m$ and the sixth control line $WS6_m$ are switched to a high level. The third control line $WS3_m$ and the fourth control line $WS4_m$ maintain the previous state. The fifth switching transistor $TR_5$ and the sixth switching transistor $TR_6$ are in the conducting state, and the other switching transistors are in the non-conducting state.

The voltage $V_{gs}$ between the gate and the source of the driving transistor $TR_{Drv}$ becomes a voltage $(V_{th}+V_{ofs}-V_{Sig_m})$ held by the capacitor unit CP. In addition, the driving voltage $V_{ccp}$ is applied to the source/drain region of one end of the driving transistor $TR_{Drv}$, and therefore a current flows towards the light-emitting unit ELP through the driving transistor $TR_{Drv}$, which causes an electric potential of the third node $ND_{3_S}$ to increase. At this point of time, a phenomenon similar to that of so-called a bootstrap circuit occurs in the gate electrode of the driving transistor $TR_{Drv}$. Basically, the electric potential of the first node $ND_{1_G}$ increases so as to maintain the voltage $V_{gs}$ between the gate and the source.

In addition, the electric potential of the third node $ND_{3_S}$ increases, and exceeds $(V_{th\text{-}EL}+V_{cath})$, and therefore the light-emitting unit ELP starts light emission. As described in the first embodiment, the current $I_{ds}$ flowing through the light-emitting unit ELP is represented by the above-described equation (2), and therefore does not depend on the threshold voltage $V_{th}$ of the driving transistor $TR_{Drv}$. In other words, since the influence exerted by the dispersion in threshold voltage $V_{th}$ of the driving transistor $TR_{Drv}$ of the display element 11 is canceled, the uneven brightness is reduced.

[Time period: $H_{m-1}$] (refer to FIGS. 35 and 39B)

This time period is a time period immediately before performing the next write processing. The voltage $V_{th}$ is already held in the first capacitor $C_{S1}$, and thus the operation corresponding to the above-described [time period: $H'_{m-3}$] and [time period: $H'_{m-2}$] is omitted.

More specifically, the second control line $WS2_m$ is switched to a high level, and the sixth control line $WS6_m$ is switched to a low level. The other control lines maintain the previous state. The second switching transistor $TR_2$ and the fifth switching transistor $TR_5$ are in the conducting state, and the other switching transistors are in the non-conducting state.

The reference voltage $V_{ofs}$ is applied to the second node $ND_2$, and therefore the electric potential of the second node $ND_2$ decreases to become $V_{ofs}$. The first node $ND_{1_G}$ is in a floating state, and therefore the electric potential of the first node $ND_{1_G}$ decreases according to the change in potential of the second node $ND_2$. The first capacitor $C_{S1}$ maintains a state in which the voltage $V_{th}$ is held. Incidentally, the electric potential of the third node $ND_{3_S}$ further decreases from $(V_{th\text{-}EL}+V_{cath})$ to some extent.

[Time period: $H''_m$] (refer to FIGS. 35 and 40A)

The next frame starts from this time period. A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ is switched to the high level. The other control lines maintain the previous state. The first switching transistor $TR_1$, the second switching transistor $TR_2$, and the fifth switching transistor $TR_5$ are in the conducting state. The other switching transistors are in the non-conducting state.

In the immediately preceding [time period: $H'_{m-1}$], the voltage $V_{th}$ is held in the first capacitor $C_{S1}$ in a state in which the electric potential of the second node $ND_2$ is $V_{ofs}$. Further, the video signal voltage $V_{Sig_m}$ is applied to the third node $ND_{3_S}$ through the first switching transistor $TR_1$ in the conducting state. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}+V_{ofs}-V_{Sig_m})$.

[Time period: $H''_{m+1}$] (refer to FIGS. 35 and 40B)

The next frame light emission period starts from this time period.

More specifically, the first control line $WS1_m$ and the second control line $WS2_m$ are switched to a low level, and the sixth control line $WS6_m$ is switched to a high level. The fifth switching transistor $TR_5$ and the sixth switching transistor $TR_6$ are in the conducting state, and the other switching transistors are in the non-conducting state. The specific operation is similar to the operation described in the above-described [time period: $H_{m+1}$], and therefore the description thereof will be omitted.

As with the fifth embodiment, the seventh embodiment also does require the initialization voltage $V_{ini}$, and therefore has the advantage of being capable of reducing kinds of voltages supplied by the drive unit. In addition, a through current does not flow at the time of initialization.

Eighth Embodiment

The eighth embodiment also relates to the display device, the display device driving method, and the display element according to the present disclosure.

In comparison with the fifth embodiment, the eighth embodiment basically has a configuration in which the transistor that connects the first node $ND_{1_G}$ and the second node $ND_2$ is omitted.

FIG. 41 is a conceptual diagram illustrating a display device according to the eighth embodiment.

A display device 8 is provided with: the display unit 10 in which display elements 11 are arranged; and the drive unit 20 for driving the display unit 10. In the eighth embodiment, the data-line drive unit 21 supplies the video signal voltage $V_{Sig}$ and the initialization voltage $V_{ini}$ to the data line DTL. The power supply unit 22 supplies a driving voltage $V_{ccp}$ to the electric supply line DS.

The capacitor unit CP, the driving transistor $TR_{Drv}$, and the first switching transistor $TR_1$ in the display element 11 are configured in a similar manner to that described in the first embodiment, and therefore the description thereof will be omitted. In the eighth embodiment as well, the drive unit 20 applies the reference voltage $V_{ofs}$ to the second node $ND_2$ and the third node $ND_{3_S}$, and supplies the driving voltage $V_{ccp}$ from the electric supply line $DS_m$ in a state in which the first node $ND_{1_G}$ and one source/drain region of the driving transistor $TR_{Drv}$ electrically conduct with each other, thereby setting the voltage held by the capacitor unit CP so as to exceed the threshold voltage $V_{th}$ of the driving transistor $TR_{Drv}$. Subsequently, a connection between the electric supply line $DS_m$ and the driving transistor $TR_{Drv}$ is interrupted in a state in which the reference voltage $V_{ofs}$ is applied to the second node $ND_2$ and the third node $ND_{3_S}$, so as to cause the electric potential of the first node $ND_{1_G}$ to get close to an electric potential obtained by adding the threshold voltage $V_{th}$ of the driving transistor $TR_{Drv}$ to the reference voltage $V_{ofs}$, thereby causing a voltage corresponding to the threshold voltage $V_{th}$ of the driving transistor $TR_{Drv}$ to be held in the first capacitor $C_{S1}$.

In the eighth embodiment, the display elements 11 are each further provided with the second switching transistor $TR_2$, the third switching transistor $TR_3$, and the fourth switching transistor $TR_4$. In the second switching transistor $TR_2$, the reference voltage $V_{ofs}$ is applied to one source/drain region, and with respect to the other source/drain region, a connection is made through the third switching transistor $TR_3$ between the first node $ND_{1_G}$ connected to the second node $ND_2$ and one source/drain region of the driving transistor $TR_{Drv}$. A connection between the electric supply line $DS_m$ and one source/drain region of the driving transistor $TR_{Drv}$ is made through the fourth switching transistor $TR_4$. The reference voltage $V_{ofs}$ is supplied from the data line $DTL_n$ through the first switching transistor $TR_1$, and is then applied to the first node $ND_{1_G}$. The reference voltage $V_{ofs}$ is applied to the second node $ND_2$ by bringing the second switching transistor $TR_2$ into the conducting state. The first node $ND_{1_G}$ and one source/drain region of the driving transistor $TR_{Drv}$ are brought into the conducting state by bringing the third switching transistor $TR_3$ into the conducting state. The connection between the electric supply line $DS_m$ and the driving transistor $TR_{Drv}$ is interrupted by bringing the fourth switching transistor $TR_4$ into the non-conducting state.

Next, the operation of the display device 8 will be described with reference to the accompanying drawings.

FIG. 42 is a schematic timing chart illustrating the operation of the display device according to the eighth embodiment, more specifically, the operation of the (n, m)th display element of the display device. FIGS. 43A, 43B, 44A, 44B, 45A, 45B, 46A, 46B, 47A, and 47B are drawings each schematically illustrating conducting state/non-conducting state and the like of each transistor that is included in a driving circuit of the display element of the display device according to the eighth embodiment.

[Time period: Before $H'_{m-4}$] (refer to FIG. 43A)

This time period is before the [time period $H'_{m-3}$] shown in FIG. 42, and is a time period during which the (n, m)th display element 11 continues light emission after the completion of various processings last time. The driving voltage $V_{ccp}$ is supplied to the electric supply line $DS_m$. The first to third switching transistors $TR_1$ to $TR_3$ are in the non-conducting state, and the fourth switching transistor $TR_4$ is in the conducting state. Although not illustrated in FIG. 42, the first to third control lines $WS1_m$ to $WS3_m$ are at a low level, and the fourth control line $WS4_m$ is at a high level. The drain current $I_{ds}$ represented by the above-described equation (1) flows through the light-emitting unit ELP, and thus the light-emitting unit ELP is in a light emitting state.

[Time period: $H'_{m-3}$] (refer to FIGS. 42 and 43B)

Initialization processing is performed during this time period. In other words, the reference voltage $V_{ofs}$ is applied to the second node $ND_2$ and the third node $ND_{3_S}$, and the driving voltage $V_{ccp}$ is supplied from the electric supply line $DS_m$ in a state in which the first node $ND_{1_G}$ and one source/drain region of the driving transistor $TR_{Drv}$ electrically conduct with each other, thereby setting the voltage held by the capacitor unit CP so as to exceed the threshold voltage $V_{th}$ of the driving transistor $TR_{Drv}$.

More specifically, the initialization voltage $V_{ini}$ is supplied to the data line $DTL_n$. In addition, the first to third control lines $WS1_m$ to $WS3_m$ are switched to a high level. The fourth control line $WS4_m$ maintains the previous state. The first to fourth switching transistors $TR_1$ to $TR_4$ are in the conducting state.

The reference voltage $V_{ofs}$ is applied to the second node $ND_2$ through the second switching transistor $TR_2$. The reference voltage $V_{ofs}$ is applied from the data line $DTL_n$ to the third node $ND_{3_S}$ through the first switching transistor $TR_1$. In addition, the driving voltage $V_{ccp}$ is applied from the electric supply line $DS_m$ to the first node $ND_{1_G}$ through the third switching transistor $TR_3$ and the fourth switching transistor $TR_4$. Therefore, the voltage held by the capacitor unit CP becomes $(V_{ccp}-V_{ofs})$, and exceeds the threshold voltage $V_{th}$ of the driving transistor $TR_{Drv}$.

Incidentally, the driving voltage $V_{ccp}$ is applied from the electric supply line $DS_m$ to one end of the light-emitting unit ELP through the fourth switching transistor $TR_4$ and the driving transistor $TR_{Drv}$. Therefore, it is also considered that the light-emitting unit ELP performs unintended light emission. However, one end of the light-emitting unit ELP is connected to the third node $ND_{3_S}$, and therefore a path of a through current is formed through the fourth switching transistor $TR_4$, the driving transistor $TR_{Drv}$, and the first switching transistor $TR_1$. Taking the threshold voltage $V_{th\text{-}EL}$ of the light-emitting unit ELP or the like into consideration, it is considered that a current generally flows through the path of the through current.

[Time period: $H'_{m-2}$] (refer to FIGS. 42, 44A, and 44B)

Threshold voltage cancel processing is performed during this time period. In other words, by interrupting the connection between the electric supply line $DS_m$ and the driving transistor $TR_{Drv}$ in a state in which the reference voltage $V_{ofs}$ is applied to the second node $ND_2$ and the third node $ND_{3_S}$, the electric potential of the first node $ND_{1_G}$ is caused to get close to an electric potential obtained by adding the threshold voltage $V_{th}$ of the driving transistor $TR_{Drv}$ to the reference voltage $V_{ofs}$.

More specifically, the fourth control line $WS4_m$ is switched to a low level. The other control lines maintain the previous state. The first to third switching transistors $TR_1$ to $TR_3$ are in the conducting state. The fourth switching transistor $TR_4$ is in the non-conducting state.

The reference voltage $V_{ofs}$ is applied to the second node $ND_2$ through the second switching transistor $TR_2$, and the reference voltage $V_{ofs}$ is applied to the third node $ND_{3_S}$ through the first switching transistor $TR_1$.

The fourth switching transistor $TR_4$ is in the non-conducting state, and therefore the electric supply line $DS_m$ is electrically isolated from one source/drain region of the driving transistor $TR_{Drv}$. The voltage $V_{gs}$ between the gate and the source of the driving transistor $TR_{Drv}$ is the voltage $(V_{ccp}-V_{ofs})$ held by the capacitor unit CP, and exceeds the threshold voltage $V_{th}$. A current flows from the first node $ND_{1_G}$ through the driving transistor $TR_{Drv}$, which causes the electric potential of the first node $ND_{1_G}$ to decrease (FIG. 44A).

If this time period is sufficiently long, an electric potential difference between the gate electrode of the driving transistor $TR_{Drv}$ and the other source/drain region reaches $V_{th}$, and the driving transistor $TR_{Drv}$ enters the non-conducting state (refer to FIG. 44B). At this point of time, an electric potential difference between the first node $ND_{1_G}$ and the third node $ND_{3_S}$ becomes $V_{th}$. Electric potentials of the second node $ND_2$ and the third node $ND_{3_S}$ are $V_{ofs}$, and therefore the electric potential of the first node $ND_{1_G}$ is $(V_{ofs}+V_{th})$. Therefore, the voltage $V_{th}$ is held in the first capacitor $C_{S1}$. Electric potentials at both ends of the second capacitor $C_{S2}$ are the same, and thus the voltage held is 0 V.

Incidentally, for convenience of explanation, the explanation is made on the assumption that the driving transistor $TR_{Drv}$ is already in the non-conducting state during this time period. However, the present disclosure is not limited to this. A mode may be employed in which the time period ends before the electric potential difference between the gate electrode of the driving transistor $TR_{Drv}$ and the other source/drain region reaches $V_{th}$.

[Time period: $H'_{m-1}$] (refer to FIGS. 42 and 45A)

This time period is a time period immediately before performing the next write processing, and a time period for waiting for writing. The first control line $WS1_m$ is switched to a low level, and the other control lines maintain the previous state. The second switching transistor $TR_2$ is in the conducting state, and the other switching transistors are in the non-conducting state. If the driving transistor $TR_{Drv}$ is already in the non-conducting state in the [time period: $H'_{m-2}$], electric potentials of the first node $ND_{1_G}$, the second node $ND_2$, and the third node $ND_{3_S}$ do not substantially change. It should be noted that this time period may be omitted.

[Time period: $H_m$] (refer to FIGS. 42 and 45B)

A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ is switched to the high level. The other control lines maintain the previous state. The first switching transistor $TR_1$ and the second switching transistor $TR_2$ are in the conducting state. The other switching transistors are in the non-conducting state.

In the immediately preceding [time period: $H'_{m-1}$], the electric potential of the first node $ND_{1_G}$ is $(V_{ofs}-V_{th})$, the electric potential of the second node $ND_2$ is $V_{ofs}$, and the voltage $V_{th}$ is held in the first capacitor $C_{S1}$. The reference voltage $V_{ofs}$ is applied to the second node $ND_2$ through the first switching transistor $TR_1$. In addition, the video signal voltage $V_{Sig_m}$ is applied to the third node $ND_{3_S}$ through the first switching transistor $TR_1$. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}+V_{ofs}-V_{Sig_m})$.

[Time period: $H_{m+1}$] (refer to FIGS. 42 and 46A)

A light emission period ranges from this time period until the starting period of a scanning period [time period: $H_{m-1}$] immediately before the scanning period $H''_m$ in the m-th row in the next frame.

More specifically, the first control line $WS1_m$ and the second control line $WS2_m$ are switched to a low level, and the fourth control line $WS4_m$ is switched to a high level. The other control lines maintain the previous state. The fourth switching transistor $TR_4$ is in the conducting state, and the other switching transistors are in the non-conducting state.

The voltage $V_{gs}$ between the gate and the source of the driving transistor $TR_{Drv}$ becomes a voltage $(V_{th}+V_{ofs}-V_{Sig_m})$ held by the capacitor unit CP. In addition, the driving voltage $V_{ccp}$ is applied to the source/drain region of one end of the driving transistor $TR_{Drv}$, and therefore a current flows towards the light-emitting unit ELP through the driving transistor $TR_{Drv}$, which causes an electric potential of the third node $ND_{3_S}$ to increase. At this point of time, a phenomenon similar to that of so-called a bootstrap circuit occurs in the gate electrode of the driving transistor $TR_{Drv}$. Basically, the electric potential of the first node $ND_{1_G}$ increases so as to maintain the voltage $V_{gs}$ between the gate and the source.

In addition, the electric potential of the third node $ND_{3_S}$ increases, and exceeds $(V_{th\text{-}EL}+V_{cath})$, and therefore the light-emitting unit ELP starts light emission. As described in the first embodiment, the current $I_{ds}$ flowing through the light-emitting unit ELP is represented by the above-described equation (2), and therefore does not depend on the threshold voltage $V_{th}$ of the driving transistor $TR_{Drv}$. In other words, since the influence exerted by the dispersion in threshold voltage $V_{th}$ of the driving transistor $TR_{Drv}$ of the display element is canceled, the uneven brightness is reduced.

[Time period: $H_{m-1}$] (refer to FIGS. 42 and 46B)

This time period is a time period immediately before performing the next write processing. The voltage $V_{th}$ is already held in the first capacitor $C_{S1}$, and thus the operation corresponding to the above-described [time period: $H'_{m-3}$] and [time period: $H'_{m-2}$] is omitted.

More specifically, the second control line $WS2_m$ is switched to a high level, and the fourth control line $WS4_m$ is switched to a low level. The other control lines maintain the previous state. The second switching transistor $TR_2$ is in the conducting state, and the other switching transistors are in the non-conducting state.

The reference voltage $V_{ofs}$ is applied to the second node $ND_2$, and therefore the electric potential of the second node $ND_2$ decreases to become $V_{ofs}$. The first node $ND_{1_G}$ is in a floating state, and therefore the electric potential of the first node $ND_{1_G}$ decreases according to the change in potential of the second node $ND_2$. The first capacitor $C_{S1}$ maintains a state in which the voltage $V_{th}$ is held. Incidentally, the electric potential of the third node $ND_{3_S}$ further decreases from $(V_{th\text{-}EL}+V_{cath})$ to some extent.

[Time period: $H''_m$] (refer to FIGS. 42 and 47A)

The next frame starts from this time period. A video signal voltage $V_{Sig_m}$ is supplied to the data line $DTL_n$ in accordance with this time period. In addition, during this time period, in a state in which a voltage corresponding to the threshold voltage $V_{th}$ of the driving transistor $TR_{Drv}$ is held by the first capacitor $C_{S1}$, the video signal voltage $V_{Sig_m}$ is written to the second capacitor $C_{S2}$ through the first switching transistor $TR_1$ in the conducting state.

More specifically, the first control line $WS1_m$ is switched to the high level. The other control lines maintain the previous state. The first switching transistor $TR_1$ and the second switching transistor $TR_2$ are in the conducting state. The other switching transistors are in the non-conducting state.

In the immediately preceding [time period: $H'_{m-1}$], the voltage $V_{th}$ is held in the first capacitor $C_{S1}$ in a state in which the electric potential of the second node $ND_2$ is $V_{ofs}$. Further, the video signal voltage $V_{Sig_m}$ is applied to the third node $ND_{3_S}$ through the first switching transistor in the conducting state. The reference voltage $V_{ofs}$ is applied to the second node $ND_2$, and therefore a voltage, for example, $(V_{ofs}-V_{Sig_m})$, is held in the second capacitor $C_{S2}$. As the result, the capacitor unit CP that includes the first capacitor $C_{S1}$ and the second capacitor $C_{S2}$ holds a voltage, for example, $(V_{th}+V_{ofs}-V_{Sig_m})$.

[Time period: $H''_{m+1}$] (refer to FIGS. 42 and 47B)

The next frame light emission period starts from this time period. More specifically, the first control line $WS1_m$ and the second control line $WS2_m$ are switched to a low level, and the fourth control line $WS4_m$ is switched to a high level. The fourth switching transistor $TR_4$ is in the conducting state, and the other switching transistors are in the non-conducting state. The specific operation is similar to the operation described in the above-described [time period: $H_{m+1}$], and therefore the description thereof will be omitted.

The embodiments of the present disclosure have been specifically described above. However, the present disclosure is not limited to the above-described embodiments, and various modifications based on the technical idea of the present disclosure can be made. For example, the numerical values, structures, substrates, materials, processes, and the like mentioned in the embodiments described above are merely examples, and numerical values, structures, substrates, materials, processes, and the like different from the above may be used as necessary.

Display Device According to Modified Examples

For example, FIG. 48 illustrates a configuration example in which various transistors are p-channel type; and FIG. 49 is a schematic timing chart illustrating the operation thereof. In addition, FIG. 50 illustrates another configuration example.

Explanation of Electronic Apparatus, and Others

The display device according to the present disclosure described above can be used as a display unit (display device) of an electronic apparatus in all fields, the display unit (display device) displaying a video signal input into the electronic apparatus, or a video signal generated in the electronic apparatus, as an image or a video. As an example, the display device according to the present disclosure can be used as, for example, a display unit including a television set, a digital still camera, a notebook-type personal computer, a mobile terminal device such as a portable telephone, a video camera, and a head-mounted display (head-mounted display) and the like.

The display device according to the present disclosure also includes a module-shaped display device having a sealed configuration. As an example, the module-shaped display device corresponds to a display module formed by sticking a facing part such as transparent glass on a pixel array part. It should be noted that the display module may be provided with a circuit unit, a flexible printed circuit (FPC), or the like that is used to input/output a signal or the like from the outside to the pixel array part. As a specific example of an electronic apparatus that uses the display device according to the present disclosure, a digital still camera and a head mounted display are presented below. However, the specific examples presented here is merely an example, and thus is not limited to this.

Specific Example 1

FIGS. 51A and 51B shows outside drawings of a lens-interchangeable single-lens reflex type digital still camera, FIG. 51A is a front view thereof, and FIG. 51B is a rear view thereof. The lens-interchangeable single-lens reflex type digital still camera includes, for example, an interchangeable photographic lens unit (interchangeable lens) 312 on the front right side of a camera body part (camera body) 311, and a grip part 313, on the front left side, for being gripped by a photographer.

In addition, a monitor 314 is provided at the substantially center of the back surface of the camera body part 311. The upper part of the monitor 314 is provided with a viewfinder (finder eyepiece window) 315. The photographer looks into the viewfinder 315 to visually recognize an optical image of an object, the optical image being introduced from the photographic lens unit 312. This enables the photographer to perform composition determination.

The display device according to the present disclosure can be used as the viewfinder 315 of the lens-interchangeable single-lens reflex type digital still camera having the above-described configuration. In other words, the lens-interchangeable single-lens reflex type digital still camera according to the present example is manufactured by using the display device according to the present disclosure as the viewfinder 315.

Specific Example 2

FIG. 52 is an outside drawing of a head mounted display. The head mounted display includes, for example, ear hooking parts 412 provided on both sides of a display unit 411 having a glass shape, the ear hooking parts 412 being attached to the head of a user. The display device according to the present disclosure can be used as the display unit 411 of this head mounted display. In other words, the head mounted display according to the present example is manufactured by using the display device according to the present disclosure as the display unit 411.

Specific Example 3

FIG. 53 is an outside drawing illustrating a see-through head mounted display. The see-through head mounted display 511 includes a body part 512, an arm 513, and a lens tube 514.

The body part 512 is connected to the arm 513 and glasses 500. More specifically, an end part in the long-side direction of the body part 512 is joined to the arm 513, and one side of the side surface of the body part 512 is connected to the glasses 500 through a connection member. It should be noted that the body part 512 may be directly mounted to the head of a human body.

A control board used to control the operation of the see-through head mounted display 511 and a display unit are built into the body part 512. The arm 513 connects between the body part 512 and the lens tube 514, and supports the lens tube 514. More specifically, the arm 513 is connected to both an end part of the body part 512 and an end part of the lens tube 514 to fix the lens tube 514. In addition, the arm 513 includes a built-in signal line for communicating data related to an image provided from the body part 512 to the lens tube 514.

Through an eyepiece, the lens tube 514 projects image light, which is provided from the body part 512 through the arm 513, toward eyes of a user who wears the see-through head mounted display 511. The display device according to the present disclosure can be used as the display unit of the body part 512 in this see-through head mounted display 511.

It should be noted that the present disclosure can also employ the following configurations.

[1]

A display device including: a display unit in which display elements are arranged; and a drive unit for driving the display unit, in which:

the display elements each include: a current-driven light-emitting unit; a capacitor unit including a first capacitor and a second capacitor; an n-channel driving transistor that causes a current corresponding to a voltage held by the capacitor unit to flow through the light-emitting unit; and a first switching transistor that writes a video signal voltage to the capacitor unit;

in the capacitor unit, one end of the first capacitor is connected to a gate electrode of the driving transistor to form a first node, the other end of the first capacitor is connected to one end of the second capacitor to form a second node, and the other end of the second capacitor is connected to one end of the light-emitting unit, and to the other source/drain region of the driving transistor to form a third node;

in the driving transistor, one source/drain region is connected to an electric supply line, and the other source/drain region is connected to the light-emitting unit;

in the first switching transistor, one source/drain region is connected to a data line, and the other source/drain region is connected to the third node; and in a state in which the first capacitor holds a voltage corresponding to a threshold voltage of the driving transistor, the drive unit writes a video signal voltage to the second capacitor through the first switching transistor in a conducting state.

[2]

The display device set forth in the above-described [1], in which the drive unit consecutively scans the display elements of the display unit, and performs the operation of holding, in the first capacitor, a voltage corresponding to a threshold voltage of the driving transistor in a part of a plurality of consecutive frames.

[3]

The display device set forth in the above-described [1] or [2], in which the drive unit applies a reference voltage to the first node, and applies an initialization voltage to the second node and the third node, to set a voltage held by the capacitor unit so as to exceed the threshold voltage of the driving transistor, and subsequently applies the reference voltage to the first node, and applies the driving voltage to one source/drain region of the driving transistor in a state in which the second node and the third node electrically conduct with each other, so as to cause electric potentials of the second node and the third node to get close to a voltage obtained by subtracting the threshold voltage of the driving transistor from the reference voltage, consequently causing a voltage corresponding to the threshold voltage of the driving transistor to be held in the first capacitor.

[4]

The display device set forth in the above-described [3], in which:

the display elements each further include a second switching transistor, a third switching transistor, and a fourth switching transistor;

in the second switching transistor, the reference voltage is applied to one source/drain region, and the other source/drain region is connected to the second node;

in the third switching transistor, one source/drain region is connected to the second node, and the other source/drain region is connected to the third node;

in the fourth switching transistor, the reference voltage is applied to one source/drain region, and the other source/drain region is connected to the first node;

the reference voltage is applied to the first node by bringing the fourth switching transistor into the conducting state; and the second node and the third node are brought into the conducting state by bringing the third switching transistor into the conducting state.

[5]

The display device set forth in the above-described [4], in which the initialization voltage is supplied from the data line through the first switching transistor.

[6]

The display device set forth in the above-described [4], in which the initialization voltage is supplied from the electric supply line through the driving transistor.

[7]

The display device set forth in the above-described [4], in which:

the display elements each further include a fifth switching transistor; and the other source/drain region of the driving transistor is connected to one end of the light-emitting unit through the fifth switching transistor.

[8]

The display device set forth in the above-described [3], in which:

the display elements each further include a second switching transistor, a third switching transistor, a fourth switching transistor, and a fifth switching transistor;

in the second switching transistor, the reference voltage is applied to one source/drain region, and the other source/drain region is connected to the second node;

in the third switching transistor, the reference voltage is applied to one source/drain region, and the other source/drain region is connected to the first node;

the second node is connected to the other source/drain region of the driving transistor and one end of the light-emitting unit through the fourth switching transistor;

the third node is connected to the other source/drain region of the driving transistor and one end of the light-emitting unit through the fifth switching transistor;

the reference voltage is applied to the first node by bringing the third switching transistor into the conducting state; and the initialization voltage is supplied from the electric supply line, and is applied to the second node and the third node through the fourth switching transistor and the fifth switching transistor that are in the conducting state.

[9]

The display device set forth in the above-described [1] or [2], in which the drive unit applies a reference voltage to the first node, and applies an initialization voltage to the second node and the third node, to set a voltage held by the capacitor unit so as to exceed the threshold voltage of the driving transistor, and subsequently applies the driving voltage to one source/drain region of the driving transistor in a state in which the reference voltage is applied to the first node, so as to cause an electric potential of the third node to get close to a voltage obtained by subtracting the threshold voltage of the driving transistor from the reference voltage, consequently causing a voltage corresponding to the threshold voltage of the driving transistor to be held in the first capacitor.

[10]

The display device set forth in the above-described [9], in which:

the display elements each further include a second switching transistor, a third switching transistor, and a fourth switching transistor;

in the second switching transistor, the initialization voltage is applied to one source/drain region, and the other source/drain region is connected to the second node;

in the third switching transistor, the reference voltage is applied to one source/drain region, and the other source/drain region is connected to the first node;

the other source/drain region of the driving transistor is connected to one end of the light-emitting unit through the fourth switching transistor;

the reference voltage is applied to the first node by bringing the third switching transistor into the conducting state;

the initialization voltage is applied to the second node by bringing the second switching transistor into the conducting state; and a conducting state/a non-conducting state of the second switching transistor are controlled by a control line in common with the first switching transistor.

[11]

The display device set forth in the above-described [1], in which the drive unit applies a reference voltage to the second node and the third node, and supplies a driving voltage from the electric supply line in a state in which the first node and one source/drain region of the driving transistor electrically conduct with each other, to set a voltage held by the capacitor unit so as to exceed a threshold voltage of the driving transistor, and subsequently interrupts a connection between the electric supply line and the driving transistor in a state in which the reference voltage is applied to the second node and the third node, so as to cause an electric potential of the first node to get close to an electric potential obtained by adding the threshold voltage of the driving transistor to the reference voltage, consequently causing a voltage corresponding to the threshold voltage of the driving transistor to be held in the first capacitor.

[12]

The display device set forth in the above-described [11], in which:

the display elements each further include a second switching transistor, a third switching transistor, a fourth switching transistor, and a fifth switching transistor;

in the second switching transistor, the reference voltage is applied to one source/drain region, and the other source/drain region is connected to the second node;

in the third switching transistor, one source/drain region is connected to the second node, and the other source/drain region is connected to the third node;

a connection between the first node and one source/drain region of the driving transistor is made through the fourth switching transistor;

a connection between the electric supply line and one source/drain region of the driving transistor is made through the fifth switching transistor;

the reference voltage is applied to the second node and the third node by bringing the second switching transistor and the third switching transistor into the conducting state;

the first node and one source/drain region of the driving transistor are brought into the conducting state by bringing the fourth switching transistor into the conducting state; and the connection between the electric supply line and the driving transistor is interrupted by bringing the fifth switching transistor into the non-conducting state.

[13]

The display device set forth in the above-described [12], in which:

the display elements each further include a sixth switching transistor; and the other source/drain region of the driving transistor is connected to one end of the light-emitting unit through the sixth switching transistor.

[14]

The display device set forth in the above-described [11], in which:

the display elements each further include a second switching transistor, a third switching transistor, and a fourth switching transistor;

in the second switching transistor, the reference voltage is applied to one source/drain region, and the other source/drain region is connected to the second node;

a connection between the first node and one source/drain region of the driving transistor is made through the third switching transistor;

a connection between the electric supply line and one source/drain region of the driving transistor is made through the fourth switching transistor;

the reference voltage is supplied from the data line through the first switching transistor, and is applied to the first node, and the reference voltage is applied to the second node by bringing the second switching transistor into the conducting state;

the first node and one source/drain region of the driving transistor are brought into the conducting state by bringing the third switching transistor into the conducting state; and the connection between the electric supply line and the driving transistor is interrupted by bringing the fourth switching transistor into the non-conducting state.

[15]

A method for driving a display device, the display device including: a display unit in which display elements are arranged; and a drive unit for driving the display unit, in which:

the display elements each include: a current-driven light-emitting unit; a capacitor unit including a first capacitor and a second capacitor; an n-channel driving transistor that causes a current corresponding to a voltage held by the capacitor unit to flow through the light-emitting unit; and a first switching transistor that writes a video signal voltage to the capacitor unit;

in the capacitor unit, one end of the first capacitor is connected to a gate electrode of the driving transistor to form a first node, the other end of the first capacitor is connected to one end of the second capacitor to form a second node, and the other end of the second capacitor is connected to one end of the light-emitting unit, and to the other source/drain region of the driving transistor to form a third node;

in the driving transistor, one source/drain region is connected to an electric supply line, and the other source/drain region is connected to the light-emitting unit;

in the first switching transistor, one source/drain region is connected to a data line, and the other source/drain region is connected to the third node; and in a state in which the first capacitor holds a voltage corresponding to a threshold voltage of the driving transistor, the drive unit writes a video signal voltage to the second capacitor through the first switching transistor in a conducting state.

[16]

A display element including: a current-driven light-emitting unit; a capacitor unit including a first capacitor and a second capacitor; an n-channel driving transistor that causes a current corresponding to a voltage held by the capacitor unit to flow through the light-emitting unit; and a first switching transistor that writes a video signal voltage to the capacitor unit;

in which:

in the capacitor unit, one end of the first capacitor is connected to a gate electrode of the driving transistor to form a first node, the other end of the first capacitor is connected to one end of the second capacitor to form a second node, and the other end of the second capacitor is connected to one end of the light-emitting unit, and to the other source/drain region of the driving transistor to form a third node;

in the driving transistor, one source/drain region is connected to an electric supply line, and the other source/drain region is connected to the light-emitting unit;

in the first switching transistor, one source/drain region is connected to a data line, and the other source/drain region is connected to the third node; and in a state in which the first capacitor holds a voltage corresponding to a threshold voltage of the driving transistor, a video signal voltage is written to the second capacitor through the first switching transistor in a conducting state.

[17]

An electronic apparatus including a display device, in which:

the display device includes: a display unit in which display elements are arranged; and a drive unit for driving the display unit;

the display elements each include: a current-driven light-emitting unit; a capacitor unit including a first capacitor and a second capacitor; an n-channel driving transistor that causes a current corresponding to a voltage held by the capacitor unit to flow through the light-emitting unit; and a first switching transistor that writes a video signal voltage to the capacitor unit;

in the capacitor unit, one end of the first capacitor is connected to a gate electrode of the driving transistor to form a first node, the other end of the first capacitor is connected to one end of the second capacitor to form a second node, and the other end of the second capacitor is connected to one end of the light-emitting unit, and to the other source/drain region of the driving transistor to form a third node;

in the driving transistor, one source/drain region is connected to an electric supply line, and the other source/drain region is connected to the light-emitting unit;

in the first switching transistor, one source/drain region is connected to a data line, and the other source/drain region is connected to the third node; and in a state in which the first capacitor holds a voltage corresponding to a threshold voltage of the driving transistor, the drive unit writes a video signal voltage to the second capacitor through the first switching transistor in a conducting state.

REFERENCE SIGNS LIST

1, 2, 3, 4, 5, 6, 7, 8, 9 Display device
10 Display unit
11 Display element
12 Driving circuit
13 Capacitor unit
20 Drive unit
21 Data-line drive unit
22 Power supply unit
23 Control-line drive unit
31 Support base
32 Transparent substrate
41 Gate electrode
42 Gate insulating layer
43 Semiconductor layer
44 Channel-forming region
45A One source/drain region
45B The other source/drain region
46 One electrode
47 The other electrode
48, 49 Wiring line
50 Interlayer insulating layer
61 Anode electrode
62 Positive hole transport layer, light-emitting layer, and electron transport layer
63 Cathode electrode
64 Second interlayer insulating layer
65, 66 Contact hole
311 Camera body part
312 Photographic lens unit
313 Grip part
314 Monitor
315 Viewfinder
500 Glasses
511 See-through head mounted display
512 Body part
513 Arm
514 Lens tube
DTL Data line
DS Electric supply line
WS1 First control line (scanning line)
WS2 Second control line
WS3 Third control line
WS4 Fourth control line
WS5 Fifth control line
WS6 Sixth control line
WS7 Seventh control line
$TR_{Drv}$ Driving transistor
$TR_1$ First switching transistor
$TR_2$ Second switching transistor
$TR_3$ Third switching transistor
$TR_4$ Fourth switching transistor
$TR_5$ Fifth switching transistor
$TR_6$ Sixth switching transistor
$TR_7$ Seventh switching transistor
CP Capacitor unit
$C_{S1}$ First capacitor
$C_{S2}$ Second capacitor
$ND_{1_G}$ First node
$ND_2$ Second node
$ND_{3_S}$ Third node
ELP Organic electroluminescent light-emitting unit
$C_{EL}$ Capacitance of light-emitting unit ELP
$V_{ini}$ Initialization voltage
$V_{ofs}$ Reference voltage
$V_{ccp}$ Driving voltage
$V_{Sig}$ Video signal voltage
$V_{th}$ Threshold voltage of driving transistor $TR_{Drv}$
$V_{cath}$ Voltage applied to cathode electrode of light-emitting unit ELP
$V_{th\text{-}EL}$ Threshold voltage of light-emitting unit ELP

The invention claimed is:

1. A display device, comprising:

a plurality of display elements; and a drive unit configured to drive at least one of the plurality of display elements, wherein the at least one of the plurality of display elements includes:

a light-emitting unit;

a capacitor unit;

a switching transistor configured to supply a signal voltage from a signal line to the capacitor unit;

a drive transistor configured to supply a drive current from a first voltage line to the light-emitting unit according to a voltage stored in the capacitor unit;

a first transistor electrically connected between the first voltage line and the drive transistor; and a second transistor electrically connected between a second voltage line and a gate electrode of the drive transistor.

2. The display device according to claim 1, wherein a cathode electrode of the light-emitting unit is electrically connected to a third voltage line, and the third voltage line is different from the second voltage line.

3. The display device according to claim 1, wherein the second transistor is further configured to turn off when the first transistor is in an off state.

4. The display device according to claim 1, further comprising a third transistor electrically connected between the drive transistor and the light-emitting unit.

5. The display device according to claim 4, wherein a gate electrode of the first transistor is electrically connected to a first control line, and a gate electrode of the third transistor is electrically connected to a second control line.

6. The display device according to claim 4, further comprising a fourth transistor electrically connected between the light-emitting unit and a fourth voltage line.

7. The display device according to claim 6, wherein a cathode electrode of the light-emitting unit is electrically connected to the fourth voltage line.

8. The display device according to claim 6, wherein the switching transistor, the drive transistor, the first transistor, the second transistor, the third transistor and the fourth transistor are p-channel type transistors.

9. The display device according to claim 1, wherein the capacitor unit includes a first capacitor and a second capacitor.

10. The display device according to claim 1, wherein the drive unit is further configured to supply a specific voltage to the first voltage line.

* * * * *